US010116053B2

(12) United States Patent
Tanaka et al.

(10) Patent No.: US 10,116,053 B2
(45) **Date of Patent: *Oct. 30, 2018**

(54) ANTENNA COIL COMPONENT, ANTENNA UNIT, AND METHOD OF MANUFACTURING THE ANTENNA COIL COMPONENT

(71) Applicant: SUMIDA CORPORATION, Chuo-ku, Tokyo (JP)

(72) Inventors: Kei Tanaka, Natori (JP); Takanobu Rokuka, Natori (JP); Hitoshi Moriya, Natori (JP); Shigeru Mahara, Natori (JP); Noriaki Iwasaki, Natori (JP); Yoshinori Miura, Natori (JP); Kei Nagabayashi, Natori (JP); Yoshimasa Abe, Natori (JP)

(73) Assignee: SUMIDA CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/648,844

(22) Filed: Jul. 13, 2017

(65) Prior Publication Data

US 2017/0310011 A1 Oct. 26, 2017

Related U.S. Application Data

(63) Continuation of application No. 14/446,529, filed on Jul. 30, 2014, now Pat. No. 9,768,509.

(30) Foreign Application Priority Data

Aug. 9, 2013 (JP) ..... 2013-166256
May 13, 2014 (JP) ..... 2014-099486

(51) Int. Cl.
*H01Q 7/08* (2006.01)
*H01Q 7/00* (2006.01)
(Continued)

(52) U.S. Cl.
CPC ..... *H01Q 7/00* (2013.01); *H01Q 1/3241* (2013.01); *H01Q 1/3291* (2013.01); *H01Q 7/08* (2013.01);
(Continued)

(58) Field of Classification Search
CPC ..... H01Q 1/3241; H01Q 7/08; H01Q 1/3291
(Continued)

(56) References Cited

U.S. PATENT DOCUMENTS 7,773,046 B2 8/2010 Shigemoto
8,420,188 B2 4/2013 Kawashima et al.
(Continued)

FOREIGN PATENT DOCUMENTS

CN 101118983 A 2/2008
JP S57041305 U 8/1955
(Continued)

OTHER PUBLICATIONS

SIPO Notification of the First Office Action corresponding to Chinese Application No. 201410390275.0, dated Jul. 12, 2016, with English translation.
(Continued)

*Primary Examiner* — Dameon E Levi
*Assistant Examiner* — Hasan Islam
(74) *Attorney, Agent, or Firm* — Cantor Colburn LLP

(57) ABSTRACT

Provided is an antenna coil component including a bobbin around which a winding is wound, a base provided at least at one end side of the bobbin, and one or more metal terminals each fixed to the base, at least one metal terminal among these metal terminals including a fixing part for fixing the metal terminal to the base, a mounting part provided at a position away from the fixing part, and a neck part for connecting the fixing part and the mounting part to each other. The neck part has a length in a direction
(Continued)

substantially orthogonal to a direction from the fixing part to the mounting part and substantially parallel to surfaces of the mounting part, which is narrower than that of the mounting part. Provided as well are an antenna unit using the antenna coil component, and a method of manufacturing the antenna coil component.

10 Claims, 38 Drawing Sheets

(51) Int. Cl.
*H01Q 1/32* (2006.01)
*H01Q 23/00* (2006.01)

(52) U.S. Cl.
CPC ..... *H01Q 23/00* (2013.01); *Y10T 29/49016* (2015.01)

(58) Field of Classification Search
USPC ..... 343/788, 866–870
See application file for complete search history.

(56) References Cited

U.S. PATENT DOCUMENTS

| | | | |
|---|---|---|---|
| 2005/0219139 | A1 | 10/2005 | Kimura et al. |
| 2007/0091007 | A1 | 4/2007 | Sako |
| 2007/0139288 | A1 | 6/2007 | Shigemoto |
| 2008/0030423 | A1 | 2/2008 | Shigemoto |
| 2009/0243952 | A1 | 10/2009 | Sako et al. |
| 2011/0215987 | A1 | 9/2011 | Ohara et al. |
| 2011/0241957 | A1 | 10/2011 | Ohara |

FOREIGN PATENT DOCUMENTS

| | | | |
|---|---|---|---|
| JP | S61021112 | U | 2/1986 |
| JP | H05020755 | U | 3/1993 |
| JP | H06013213 | U | 2/1994 |
| JP | H06045306 | U | 6/1994 |
| JP | 2006121278 | A | 5/2006 |
| JP | 2007043527 | A | 2/2007 |
| JP | 2008042237 | A | 2/2008 |
| JP | 2010016549 | A | 1/2010 |
| JP | 4883096 | B2 | 12/2011 |
| JP | 2012204961 | A | 10/2012 |
| WO | 2008087802 | A1 | 7/2008 |

OTHER PUBLICATIONS

Extended European Search Report corresponding to Application No. 14180378.3-1812, dated Dec. 15, 2014.
JP Notice of Reasons for Rejection corresponding to Application No. 2013-166256, dated May 9, 2017.
Decision to Grant a Patent for corresponding JP Application No. 2014-099486, dated Mar. 20, 2018.
JP Notification of Reasons for Refusal corresponding to Application No. 2013-166256, dated Oct. 31, 2017.

570

ANTENNA COIL COMPONENT, ANTENNA UNIT, AND METHOD OF MANUFACTURING THE ANTENNA COIL COMPONENT

CROSS-REFERENCE TO RELATED APPLICATIONS

The present application is a continuation application of U.S. patent application Ser. No. 14/446,529, filed on Jul. 30, 2014, the entire contents of which are incorporated herein by reference and priority to which is hereby claimed. Application Ser. No. 14/446,529 claims priority under 35 U.S.C. § 119(a) and 35 U.S.C. § 365(b) to Japanese Application No. 2013-166256, filed on Aug. 9, 2013, and Japanese Application No. 2014-099486, filed on May 13, 2014, the disclosure of which is also incorporated herein by reference.

BACKGROUND OF THE INVENTION

1. Field of the Invention

The present invention relates to an antenna coil component, an antenna unit, and a method of manufacturing the antenna coil component.

2. Description of the Related Art

A keyless entry system used for locking or unlocking a door has been mainly used for automobiles. In the keyless entry system, an antenna unit for transmission is mounted on the side of a device or structure having a door such as a vehicle. In such an antenna unit, main parts thereof include an antenna coil component including a bobbin and a coil or the like made of a winding wound around the bobbin and a magnetic core accommodated and disposed in the bobbin. In addition to the bobbin and the coil, the antenna coil component may further include various electronic components such as a capacitor forming a resonance circuit together with the coil and a resistor for stabilizing an output (Japanese Patent Application Laid-open No. 2010-16549, Japanese Patent No. 4883096, and Japanese Patent Application Laid-open No. 2006-121278).

The electronic component is mounted on a metal terminal fixed to a resin body part of the bobbin or the like forming the main parts of the antenna coil component by soldering through use of a spot reflow method.

However, in the related art antenna coil component also including an electronic component, there is a risk in that a solder connecting part for connecting the metal terminal and the electronic component may be cracked when a stress generated by expansion and contraction of the resin material forming the body part along with a temperature change is transmitted to the metal terminal. The occurrence of cracks may result in a malfunction of the antenna unit.

SUMMARY OF THE INVENTION

The present invention has been made in view of the above-mentioned circumstance, and it is an object of the present invention to provide an antenna coil component capable of preventing a solder connecting part from being cracked by a temperature change in the case where an electronic component is also mounted by soldering, and to provide an antenna unit using the antenna coil component and a method of manufacturing the antenna coil component.

The above-mentioned object is achieved by embodiments of the present invention described below.

According to one embodiment of the present invention, there is provided an antenna coil component, including at least: a bobbin having a tubular shape and formed of an insulating material; a winding wound around an outer circumferential side of the bobbin; a base provided at least at one end side of the bobbin and formed of an insulating material; and one or more metal terminals each having conductivity and fixed to the base, in which at least one metal terminal among the one or more metal terminals includes at least: a fixing part for fixing the at least one metal terminal to the base; a mounting part having a plate shape and provided at a position spaced from the fixing part; and a neck part for connecting the fixing part and the mounting part to each other, the neck part having a length narrower than a length of the mounting part in a direction substantially orthogonal to a direction from the fixing part to the mounting part and substantially parallel to front and rear surfaces of the mounting part.

In an antenna coil component according to one embodiment of the present invention, it is preferred that the mounting part have an electronic component disposed thereon through intermediation of a solder connecting part.

In an antenna coil component according to another embodiment of the present invention, it is preferred that the electronic component be a chip capacitor.

In an antenna coil component according to another embodiment of the present invention, it is preferred that the at least one metal terminal include two metal terminals each including at least the fixing part, the mounting part, and the neck part.

In an antenna coil component according to another embodiment of the present invention, it is preferred that the at least one metal terminal including at least the fixing part, the mounting part, and the neck part include one mounting part and one neck part.

In an antenna coil component according to another embodiment of the present invention, it is preferred that an entire periphery of an end of the mounting part be spaced from the base.

In an antenna coil component according to another embodiment of the present invention, it is preferred that the fixing part be buried in the base.

In an antenna coil component according to another embodiment of the present invention, it is preferred that the bobbin and the base be formed integrally with each other, the base have a ring shape forming a hollow part which passes through the base in a direction substantially orthogonal to an axial direction of the bobbin, and the at least one metal terminal including at least the fixing part, the mounting part, and the neck part be disposed so that the mounting part and the neck part are positioned in the hollow part.

In an antenna coil component according to another embodiment of the present invention, it is preferred that the insulating material forming the bobbin and the insulating material forming the base be heat-labile resins.

In an antenna coil component according to another embodiment of the present invention, it is preferred that the antenna coil component be used for an in-vehicle antenna unit.

According to one embodiment of the present invention, there is provided an antenna unit, including at least: an antenna coil component including at least: a bobbin having a tubular shape and formed of an insulating material; a winding wound around an outer circumferential side of the bobbin; a base provided at least at one end side of the bobbin and formed of an insulating material; and one or more metal terminals each having conductivity and fixed to the base, at least one metal terminal among the one or more metal terminals including at least: a fixing part for fixing the at least one metal terminal to the base; amounting part having a plate shape and provided at a position spaced from the fixing part; and a neck part for connecting the fixing part and the mounting part to each other, the neck part having a length narrower than a length of the mounting part in a direction substantially orthogonal to a direction from the fixing part to the mounting part and substantially parallel to front and rear surfaces of the mounting part; a magnetic core disposed in the bobbin; an electronic component disposed on the mounting part through intermediation of a solder connecting part; and a case for accommodating the antenna coil component.

According to one embodiment of the present invention, there is provided a method of manufacturing an antenna coil component, including at least: disposing a metal member in a mold, the metal member including at least: a fixing part; a mounting part having a plate shape and provided at a position spaced from the fixing part; and a neck part for connecting the fixing part and the mounting part to each other, the neck part having a length narrower than a length of the mounting part in a direction substantially orthogonal to a direction from the fixing part to the mounting part and substantially parallel to front and rear surfaces of the mounting part; injecting a heat-labile resin into the mold, to thereby mold at least a base formed of the heat-labile resin and simultaneously bury the fixing part in the base; applying a cream solder to at least one surface of the mounting part; and disposing an electronic component on the at least one surface of the mounting part to which the cream solder has been applied, and then soldering the electronic component to the mounting part by a spot reflow method.

According to one embodiment of the present invention, it is possible to provide the antenna coil component capable of preventing the solder connecting part from being cracked by a temperature change in the case where the electronic component is also mounted by soldering, and to provide the antenna unit using the antenna coil component and the method of manufacturing the antenna coil component.

BRIEF DESCRIPTION OF THE DRAWINGS

FIG. 16A is a top view of the connector pin, FIG. 16B is a side view of the connector pin, and FIG. 16C is a sectional view illustrating an example of a sectional structure taken along the line A-A of FIG. 16B.

FIG. 32A is a view illustrating a mounting part heating step, FIG. 32B is a view illustrating a solder supplying step, and FIG. 32C is a view illustrating an electronic component arrangement step.

FIG. 33A is a view illustrating a solder supplying step, FIG. 33B is a view illustrating an electronic component arrangement step, and FIG. 33C is a view illustrating a mounting part heating step.

DETAILED DESCRIPTION OF THE PREFERRED EMBODIMENTS

First Embodiment

Figure 1:
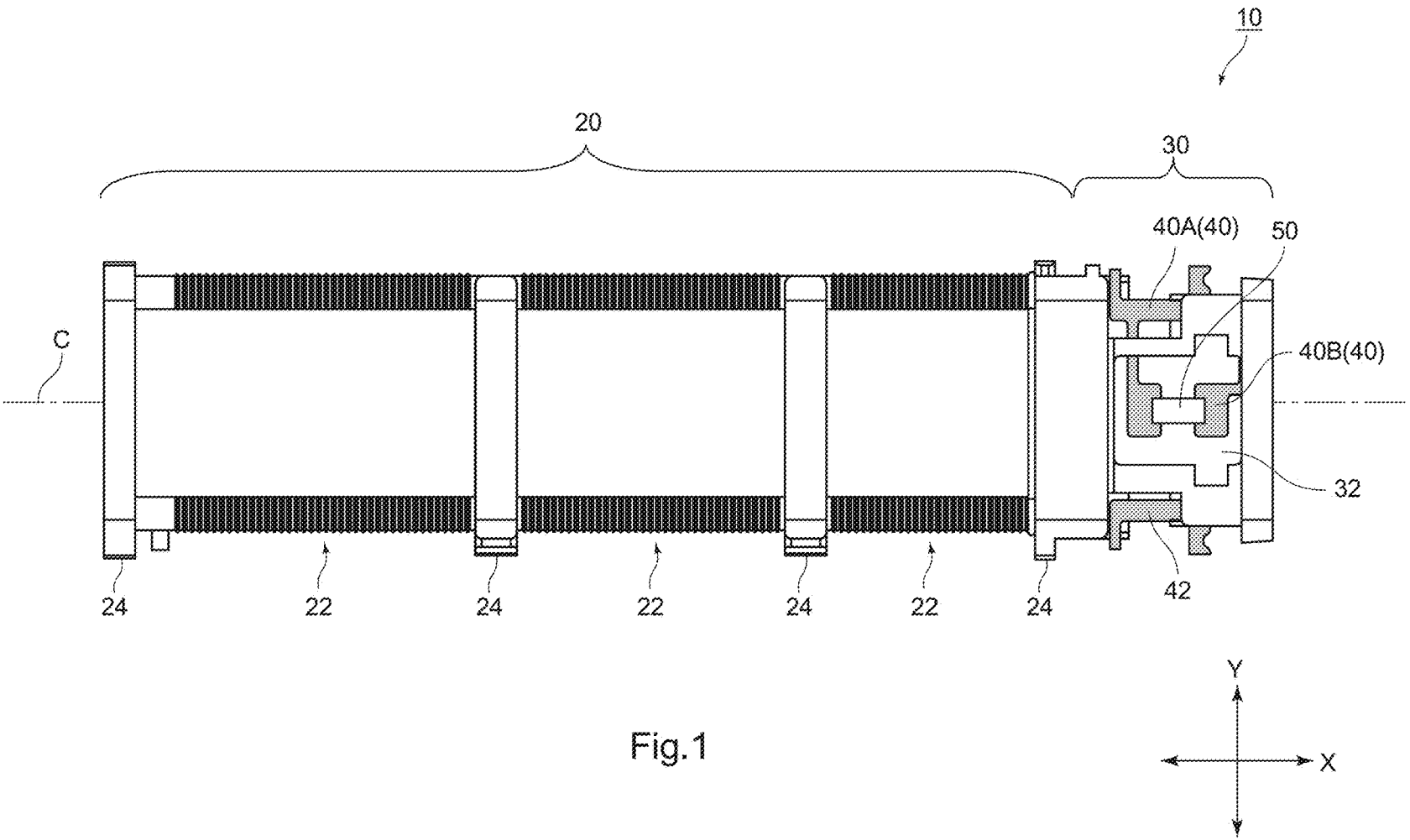
FIG. 1 is a schematic plan view illustrating an example of an antenna coil component according to a first embodiment of the present invention.

FIG. 1 is a schematic plan view illustrating an example of an antenna coil component according to a first embodiment of the present invention, specifically, illustrating main parts of the antenna coil component. Note that, in FIG. 1, an X-direction and a Y-direction indicated by two-headed arrows are orthogonal to each other, and the X-direction is also parallel to an axial direction C illustrated in FIG. 1. In this case, one side (right side in FIG. 1) of the X-direction is referred to as "right side" or "right direction", the other side thereof (left side in FIG. 1) is referred to as "left side" or "left direction", one side (upper side in FIG. 1) of the Y-direction is referred to as "upper side" or "upward direction", and the other side thereof (lower side in FIG. 1) is referred to as "lower side" or "downward direction". Note that, the same applies to FIG. 2 and the subsequent figures.

An antenna coil component 10 illustrated in FIG. 1 includes a tubular bobbin 20 made of an insulating material, a winding (metal wire covered with an insulating film (not shown)) wound around an outer circumferential surface 22 of the bobbin 20, a base 30 provided on one end side (right end side in FIG. 1) of the bobbin 20 and made of an insulating material, and three metal terminals 40A (40), 40B (40), 42 each having conductivity and fixed to the base 30. A chip capacitor 50 is mounted to the metal terminals 40A and 40B so as to bridge the metal terminals 40A and 40B.

Note that, the bobbin 20 is provided with a plurality of flange parts 24 forming convex portions with respect to the outer circumferential surface 22 in the axial direction C. In this case, the winding is wound around the outer circumferential surface 22 between two flange parts 24 adjacent to each other in the axis direction C. The other end side (left end side in FIG. 1) of the bobbin 20 is provided with an opening part (not shown).

The bobbin 20 and the base 30 are formed integrally with each other. In this case, the base 30 forms a ring shape forming a hollow part 32 which passes through the base 30 in a direction substantially orthogonal to the axial direction C of the bobbin 20. Further, as the insulating material forming the bobbin 20 and the base 30, a resin material is generally used.

Further, in the example illustrated in FIG. 1, the metal terminal 40A is connected to one end of the winding (not shown), and the metal terminal 40B is connected to first wiring (or a first terminal) (not shown) used for connecting the antenna coil component 10 to external equipment or the like. The metal terminal 42 is connected to the other end of the winding (not shown) and connected to second wiring (or a second terminal) (not shown) used for connecting the antenna coil component 10 to external equipment or the like. Note that, the metal terminals 40A, 40B, 42 may be appropriately provided with binding parts for binding and connecting the winding and wiring as necessary. Further, an electronic component such as the chip capacitor 50 may not be mounted on the antenna coil component 10.

Figure 2:
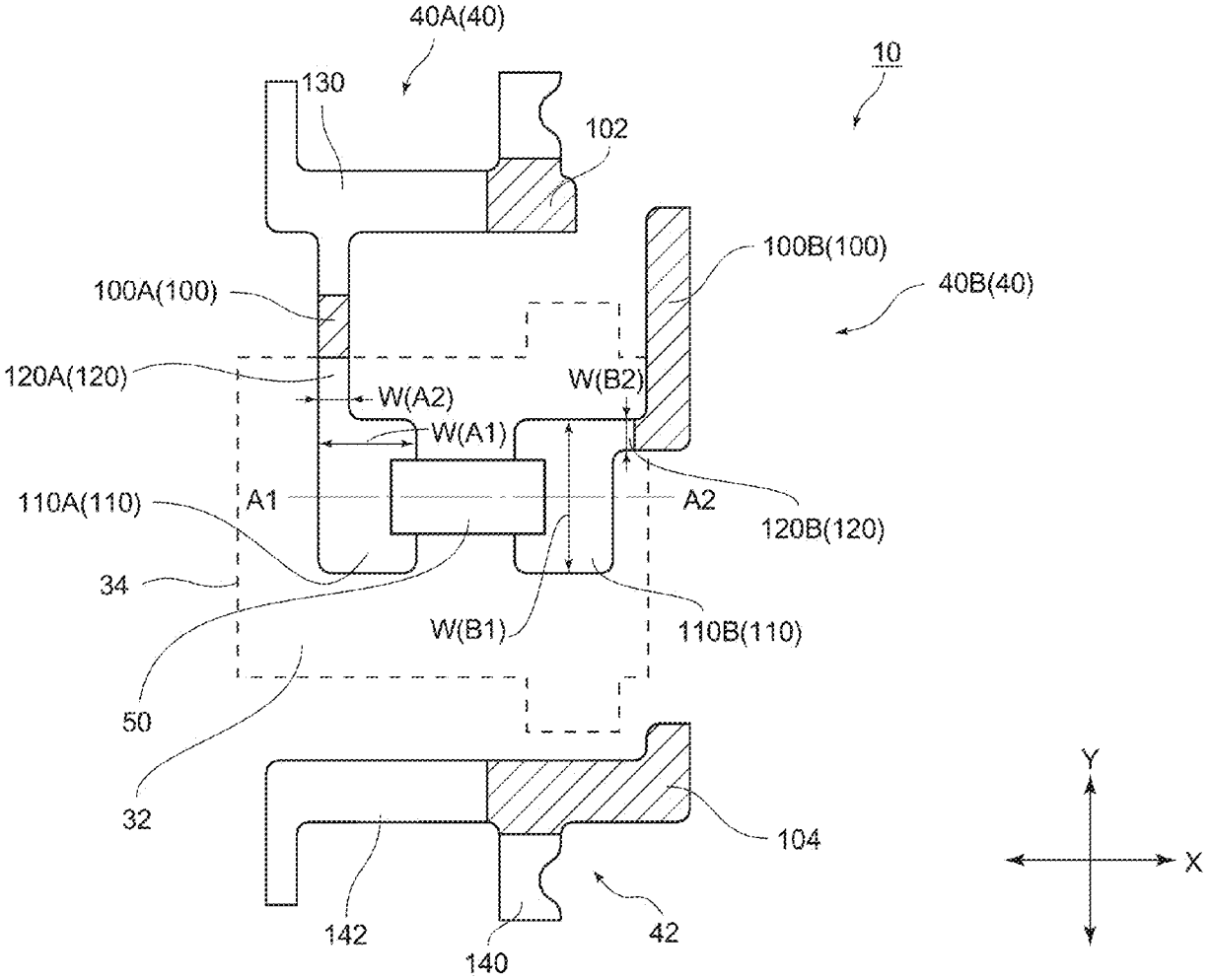
FIG. 2 is a schematic plan view illustrating a structure in the vicinity of a base forming the antenna coil component according to the first embodiment illustrated in FIG. 1.

Next, the structure of the vicinity of the base 30 of the antenna coil component 10 illustrated in FIG. 1 is described in more detail. FIG. 2 is a schematic plan view illustrating a structure of the vicinity of the base 30 forming the antenna coil component 10 according to the first embodiment illustrated in FIG. 1. In this case, the broken line of FIG. 2 indicates a contour line 34 of the hollow part 32, and shaded regions in the metal terminals 40A, 40B, 42 are parts (fixing parts) fixed to the base 30 while being buried in the base 30.

In FIG. 2, the metal terminal 40A is disposed so as to occupy a region extending from a position within the hollow part 32 on the left side of the center to a position outside the hollow part 32 on the upper side. The metal terminal 40B is disposed so as to occupy a region extending from a position within the hollow part 32 on the right side of the center to a position outside the hollow part 32 on the upper right side. The metal terminal 42 is disposed so as to occupy a region outside the hollow part 32 on the lower side.

In this case, the metal terminal 40A includes fixing parts 110A (100), 102 for fixing the metal terminal 40A to the base 30, a mounting part 110A (110) in a rectangular plate shape provided at a position spaced from the fixing part 100A, and a neck part 120A (120) for connecting the fixing part 100A and the mounting part 110A to each other. The neck part 120A (120) has a length (width W) narrower than that of the mounting part 110A in a direction (X-direction in FIG. 2) substantially orthogonal to a direction (Y-direction in FIG. 2) from the fixing part 100A to the mounting part 110A and substantially parallel to front and rear surfaces of the mounting part 110A.

Note that, the respective parts forming the metal terminal 40A are arranged in the following order: the mounting part 110A, the neck part 120A, the fixing part 100A, a connecting part 130 for connecting the fixing part 100A and the fixing part 102 to each other, and the fixing part 102 in the case where the mounting part 110A is defined as a start point and the fixing part 102 is defined as a final point. The mounting part 110A and the neck part 120A are disposed on an inner side of the contour line 34, and the fixing part 100A, the connecting part 130, and the fixing part 102 are disposed on an outer side of the contour line 34. Further, the contour line 34 forms a boundary line between the fixing part 100A and the neck part 120A.

Further, the metal terminal 40B includes a fixing part 100B (100) for fixing the metal terminal 40B to the base 30, amounting part 110B (110) in a rectangular plate shape provided at a position spaced from the fixing part 100B, and a neck part 120B (120) for connecting the fixing part 100B and the mounting part 110B to each other. The neck part 120B (120) has a length (width W) narrower than that of the mounting part 110B in a direction (Y-direction in FIG. 2) substantially orthogonal to a direction (X-direction in FIG. 2) from the fixing part 100B to the mounting part 110B and substantially parallel to front and rear surfaces of the mounting part 110B.

In FIG. 2, in the X-direction, the mounting part 110A forming the metal terminal 40A and the mounting part 110B forming the metal terminal 40B are disposed so as to be opposed to each other at a predetermined distance. The chip capacitor 50 is disposed so as to bridge the two mounting parts 110A and 110B through intermediation of a solder connecting part (not shown in FIG. 2). That is, one external electrode (not shown in FIG. 2) of the chip capacitor 50 is connected to the mounting part 110A by soldering, and the other external electrode (not shown in FIG. 2) thereof is connected to the mounting part 110B by soldering.

Note that, the respective parts for forming the metal terminal 40B are arranged in the following order: the mounting part 110B, the neck part 120B, and the fixing part 100B in the case where the mounting part 110B is defined as a start point and the fixing part 100B is defined as a final point. The mounting part 110B and the neck part 120B are disposed on an inner side of the contour line 34, and the fixing part 100B is disposed on an outer side of the contour line 34. Further, the contour line 34 forms a boundary line between the fixing part 100B and the neck part 120B.

Further, the metal terminal 42 includes a fixing part 104 for fixing the metal terminal 42 to the base 30 and other parts 140, 142 connected to the fixing part 104. The entire metal terminal 42 is disposed on an outer side of the contour line 34.

In the case where the antenna coil component 10 is subjected to a temperature change, an insulating material forming the base 30 expands or contracts. A stress generated by the expansion or the contraction is transmitted to the entire metal terminal 40A through the fixing parts 100A, 102, and simultaneously transmitted to the entire metal terminal 40B through the fixing part 100B. In this case, the mounting part 110A fixing the chip capacitor 50 through intermediation of the solder connecting part is connected to the fixing part 100A through the neck part 120A, and the mounting part 110B fixing the chip capacitor 50 through intermediation of the solder connecting part is connected to the fixing part 100B through the neck part 120B. Therefore, originally, the stress transmitted to the fixing part 100A is transmitted to the mounting part 110A through the neck part 120A, and the stress transmitted to the fixing part 100B is transmitted to the mounting part 110B through the neck part 120B. Therefore, finally, there is a risk in that the stress transmitted to the mounting parts 110A, 110B may be concentrated on the solder connecting part.

However, in the antenna coil component 10 according to the first embodiment, the width W(A2) of the neck part 120A is narrower than the width W(A1) of the mounting part 110A, and the width W(B2) of the neck part 120B is narrower than the width W(B1) of the mounting part 110B. That is, the neck parts 120A, 120B are likely to be deformed due to the low stiffness, and hence the stress transmitted to the neck part 120A through the fixing part 100A and the stress transmitted to the neck part 120B through the fixing part 100B are absorbed and relaxed by the deformation of the neck parts 120A and 120B. Consequently, the stress finally transmitted to the mounting parts 110A and 110B becomes weak, and the stress concentration on the solder connecting part is suppressed greatly. Therefore, in the antenna coil component 10 according to the first embodiment, the solder connecting part can be prevented from being cracked more reliably compared to a related-art antenna coil component.

Further, a ratio [W(A2)/W(A1)] of the width W(A2) to the width W(A1) in the metal terminal 40A is not particularly limited as long as the ratio is less than 1. However, from the viewpoint of preventing the solder connecting part from being cracked more reliably, in general, the ratio is preferably 0.7 or less, more preferably 0.5 or less, still more preferably 0.3 or less. Further, a lower limit value of the ratio [W(A2)/W(A1)] is not particularly limited. However, from the viewpoint of ensuring the strength of the neck part 120A, it is practically preferred that the lower limit value be 0.1 or more. Note that, the same also applies to the metal terminal 40B.

Note that, the term "neck part" as used herein refers to a member for connecting a fixing part and a mounting part to each other. In this case, the planar shape of the neck part is provided in such a manner that a maximum length (width W(A2) in the neck part 120A illustrated in FIG. 2, for example) in a direction substantially orthogonal to a direction from the fixing part to the mounting part and substantially parallel to front and rear surfaces of the mounting part is narrower than a width (width W(A1) in the mounting part 110A illustrated in FIG. 2, for example) of the mounting part in a state where the antenna coil component is completed. As long as this condition is satisfied, there is no particular limit to the planar shape of the neck part.

Note that, the metal terminal 40A includes two fixing parts 100A, 102, and the fixing part 102 provided at a position which is not continuous from the neck part 120A is longer in a stress transmission distance to the mounting part 110A than the fixing part 100A. Therefore, in the case of considering adverse effects on the solder connecting part by a stress, it is substantially sufficient that only the fixing part 100A provided at a position which is continuous from the neck part 120A be taken into consideration. Further, from the viewpoint of whether directly supporting and fixing the neck part 120A and the mounting part 110A, the fixing part 100A serves as a direct fixing part, and the fixing part 102 serves as an indirect fixing part.

In the embodiment illustrated in FIG. 2, although the entire perimeter of an end of the mounting part 110 is spaced from the contour line 34 (that is, the base 30), a part of the end may be in contact with the contour line 34. However, in order to make the absorption and relaxation of a stress by the neck part 120 more effective, it is preferred that the entire perimeter of the end of the mounting part 110 be spaced from the contour line 34.

Further, in the embodiment illustrated in FIG. 2, as the metal terminal 40 (hereinafter sometimes referred to as "metal terminal 40 with a neck part") including at least the fixing part 100, the mounting part 110, and the neck part 120, two metal terminals 40A and 40B are used, but the number of the metal terminals 40 with a neck part to be used may be 1 or 3 or more. Further, as an electronic component to be arranged on the mounting part 110 through intermediation of the solder connecting part, known electronic components such as a resistor, an IC chip, and a transistor can be used besides the chip capacitor 50 illustrated in FIG. 2, and as necessary, 2 or more electronic components of the same kind, or 2 or more different kinds of electronic components can also be used. Further, it is sufficient that the electronic component be arranged on the mounting part 110 of at least one metal terminal 40 with a neck part through intermediation of the solder connecting part. In this case, there is no particular limit to a connection form of connecting portions between the electronic component and the other metal terminals or wiring, etc., and wire bonding and the like can be appropriately used besides solder connection. Note that, the number of the metal terminals 40 with a neck part to be used is, in general, preferably two, and the chip capacitor 50 is, in general, preferred as the electronic component to be used. Further, in the case of using 2 or more metal terminals to be connected to the electronic component by soldering, it is preferred that all the metal terminals to be connected to the electronic component through intermediation of the solder connecting part be the metal terminals 40 with a neck part.

There is no particular limit to a fixing form of the fixing part 100 with respect to the base 30, and a known fixing form can be adopted. Examples of the fixing form include: (1) a first fixing form in which the fixing part 100 is buried in the base 30 as illustrated in FIGS. 1 and 2; (2) a second fixing form in which the fixing part 100 is fixed to the base 30 by heat fusion; (3) a third fixing form in which the fixing part 100 is fixed to the base 30 with an adhesive; (4) a fourth fixing form in which the fixing part 100 forming a male pattern is fixed to the base 30 having a female pattern mechanically by fitting the male pattern in the female pattern; and (5) a fifth fixing form in which at least two kinds of the four fixing forms are combined. In this case, in order to perform fixing in the first fixing form in the example illustrated in FIGS. 1 and 2, for example, the base 30 and the bobbin 20 to be integrated therewith may be subjected to injection molding under the condition of disposing the metal terminal 40 in a mold. Thus, in the case where the fixing part 100 is buried in the base 30, the surface of the fixing part 100 and the base 30 are brought into close contact with each other without any gap. Accordingly, the first fixing form is more excellent in fixing strength than the fourth fixing form in which a predetermined clearance is present between the surface of the fixing part 100 and the base 30 in terms of dimension. Further, the first to fifth fixing forms can also be appropriately adopted with respect to the fixing parts 102, 104. Note that, it is particularly preferred that the first fixing form be used from the viewpoint of obtaining high fixing strength and excellent productivity.

Note that, although the metal terminals 40A, 40B in which one mounting part 110 is fixed to the base 30 through one neck part 120 are illustrated in FIGS. 1 and 2, one mounting part 110 may be fixed to the base 30 through 2 or more neck parts 120.

Figure 3:
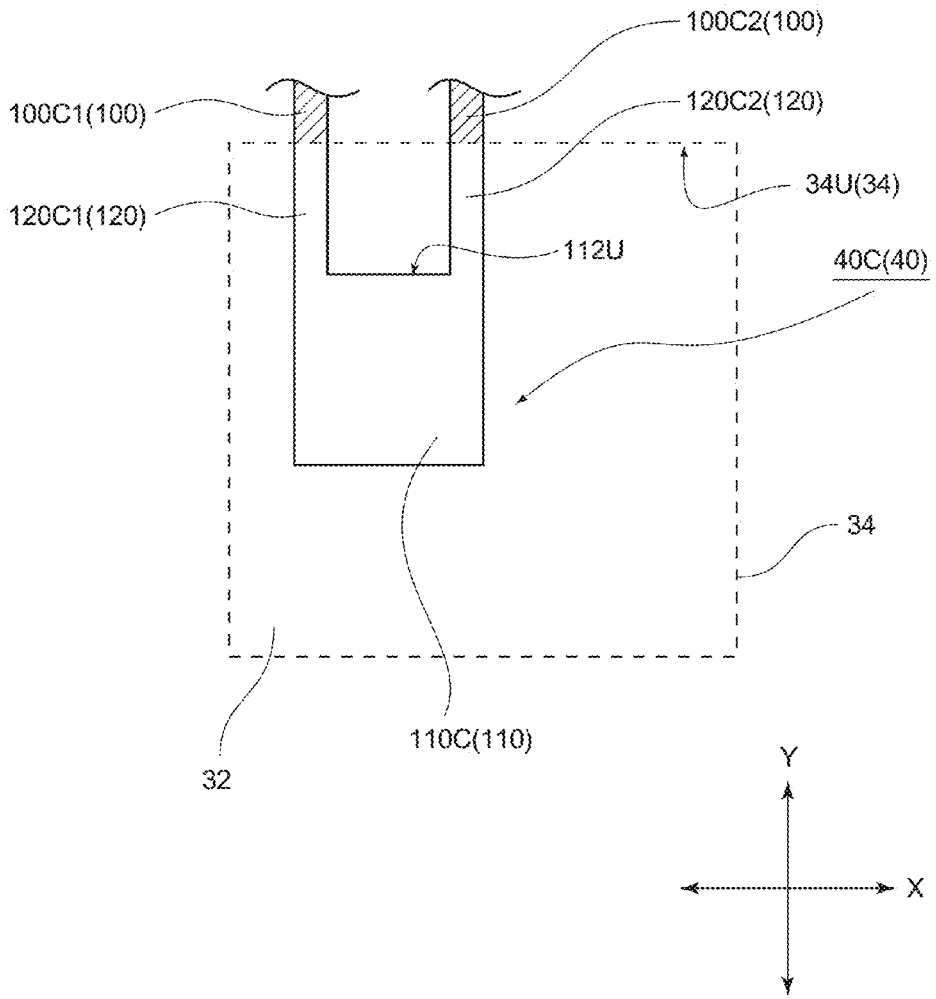
FIG. 3 is a schematic plan view illustrating another example of a metal terminal with a neck part used in the antenna coil component according to the first embodiment.
Figure 4:
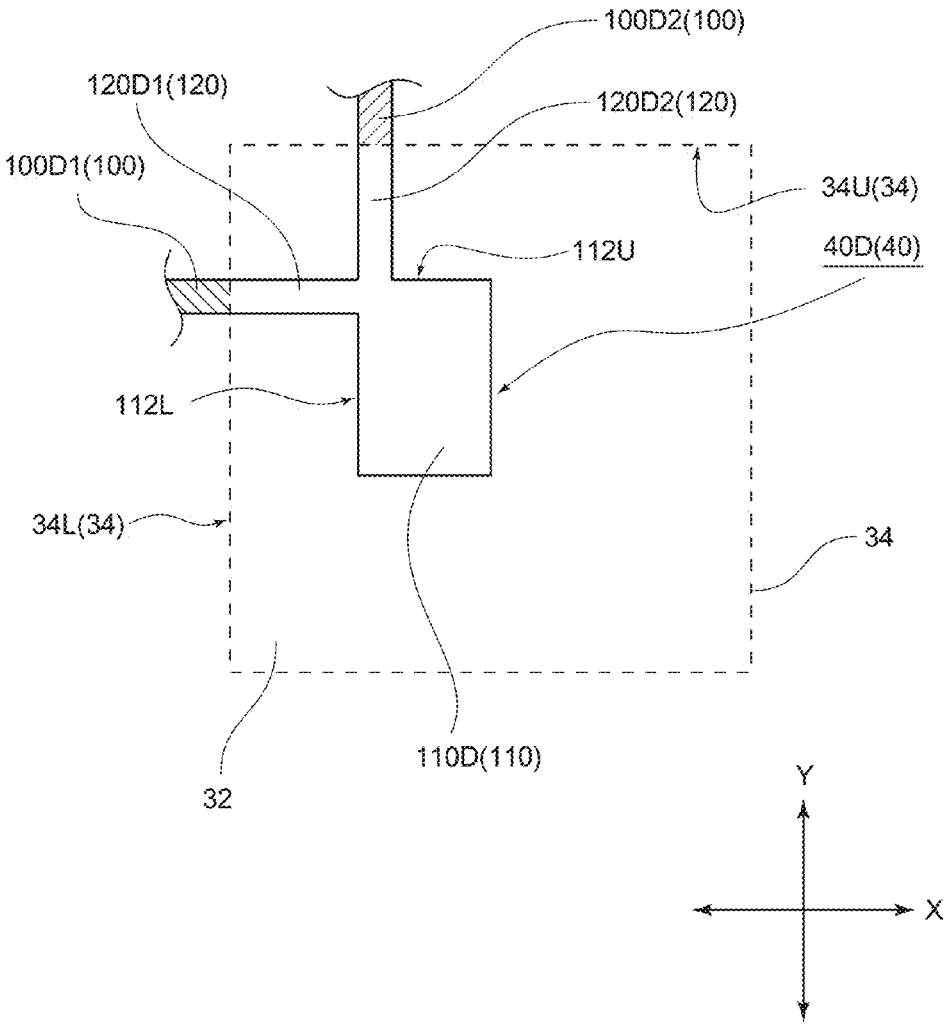
FIG. 4 is a schematic plan view illustrating another example of the metal terminal with a neck part used in the antenna coil component according to the first embodiment.
Figure 5:
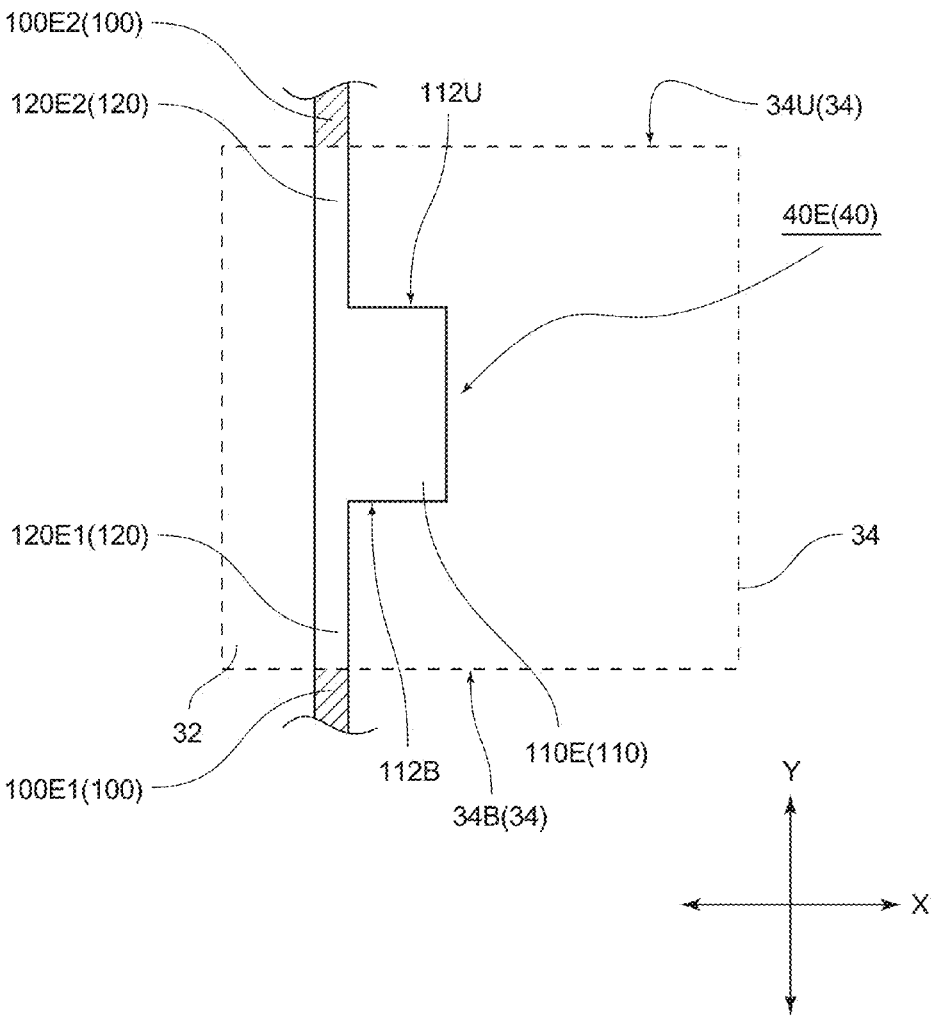
FIG. 5 is a schematic plan view illustrating another example of the metal terminal with a neck part used in the antenna coil component according to the first embodiment.

FIGS. 3 to 5 are schematic plan views illustrating other examples of the metal terminal 40 with a neck part, specifically, specific examples of the metal terminal 40 with a neck part in which one mounting part 110 is fixed to the base 30 through two neck parts 120. Note that, in FIGS. 3 to 5, only one metal terminal 40 with a neck part is illustrated, and the electronic component such as the chip capacitor 50 and other metal terminals are not shown. Further, the base 30 to which the metal terminal 40 with a neck part is fixed forms a ring shape forming the substantially square hollow part 32.

A metal terminal 40C (40) illustrated in FIG. 3 includes a mounting part 110C (110) in a rectangular plate shape, a first fixing part 100C1 (100), a first neck part 120C1 (120), a second fixing part 100C2 (100), and a second neck part 120C2 (120).

In this case, the first neck part 120C1 and the second neck part 120C2 are respectively connected to one end side and the other end side of one side (upper side 112U) of two sides parallel to the X-direction among four sides forming an outer circumferential end of the mounting part 110C. The first neck part 120C1 is connected to the first fixing part 100C1 provided outside of one side (upper side 34U) of two sides parallel to the X-direction among four sides forming the contour line 34 in a substantially square shape, and the second neck part 120C2 is connected to the second fixing part 100C2 provided outside of the upper side 34U of the contour line 34.

That is, in the metal terminal 40C, the axial direction of the first neck part 120C1 and the axial direction of the second neck part 120C2 are the same direction (Y-direction), and the first neck part 120C1 and the second neck part 120C2 are arranged on the same side with respect to the mounting part 110C. Note that, although the two fixing parts 100C1, 100C2 are provided so as to correspond to the two neck parts 120C1, 120C2 in the example illustrated in FIG. 3, the two fixing parts 100C1, 100C2 may form one continuous fixing part 100.

A metal terminal 40D (40) illustrated in FIG. 4 includes a mounting part 110D (110) in a rectangular plate shape, a first fixing part 100D1 (100), a first neck part 120D1 (120), a second fixing part 100D2 (100), and a second neck part 120D2 (120).

In this case, the first neck part 120D1 is connected to one side (left side 112L in FIG. 4) of two sides parallel to the Y-direction among four sides forming an outer circumferential end of the mounting part 110D. Further, the second neck part 120D2 is connected to one side (upper side 112U in FIG. 4) of two sides parallel to the X-direction among the four sides forming the outer circumferential end of the mounting part 110D. The first neck part 120D1 is connected to the first fixing part 100D1 provided outside of one side (left side 34L) of two sides parallel to the Y-direction among the four sides forming the contour line 34, and the second neck part 120D2 is connected to the second fixing part 100D2 provided outside of the upper side 34U of the contour line 34.

That is, in the metal terminal 40D, the axial direction of the first neck part 120D1 and the axial direction of the second neck part 120D2 are orthogonal to each other. Note that, although two fixing parts 100D1, 100D2 are provided so as to correspond to the two neck parts 120D1, 120D2, respectively, in the example illustrated in FIG. 4, the two fixing parts 100D1, 100D2 may form one continuous fixing part 100.

A metal terminal 40E (40) illustrated in FIG. 5 includes a mounting part 110E (110) in a rectangular plate shape, a first fixing part 100E1 (100), a first neck part 120E1 (120), a second fixing part 100E2 (100), and a second neck part 120E2 (120).

In this case, the first neck part 120E1 is connected to one side (bottom side 112B) of two sides parallel to the X-direction among four sides forming an outer circumferential end of the mounting part 110E. Further, the second neck part 120E2 is connected to an upper side 112U, which is parallel to the bottom side 112B and is opposed thereto, among the four sides forming the outer circumferential end of the mounting part 110E. The first neck part 120E1 is connected to the first fixing part 100E1 provided outside of one side (bottom side 34B) of two sides parallel to the X-direction among the four sides forming the contour line 34, and the second neck part 120E2 is connected to the second fixing part 100E2 provided outside of the upper side 34U, which is parallel to the bottom side 34B and is opposed thereto, among the four sides forming the contour line 34.

That is, in the metal terminal 40E, the axial direction of the first neck part 120E1 and the axial direction of the second neck part 120E2 are the same direction (Y-direction). Further, the first neck part 120E1 is arranged on one side with respect to the mounting part 110E, and the second neck part 120E2 is arranged on another side with respect to the mounting part 110E.

As described above, in the case where the metal terminal 40 with a neck part has two neck parts 120, the metal terminal 40 with a neck part can have any form selected from the following first to third forms.

(1) First form in which the axial direction of one neck part 120 and the axial direction of the other neck part 120 are substantially parallel to each other (note that, the term "substantially parallel" also includes the case where the axial direction of one neck part 120 and the axial direction of the other neck part 120 cross each other so as to form an angle of less than) 30°, and the two neck parts 120 are positioned on the same side with respect to the mounting part 110, as illustrated in an example in FIG. 3

(2) Second form in which the axial direction of one neck part 120 and the axial direction of the other neck part 120 are substantially orthogonal to each other or cross each other so as to form an angle of 30° or more, as illustrated in an example in FIG. 4

(3) Third form in which the axial direction of one neck part 120 and the axial direction of the other neck part 120 are substantially parallel to each other (note that, the term "substantially parallel" also includes the case where the axial direction of one neck part 120 and the axial direction of the other neck part 120 cross each other so as to form an angle of less than) 30°, and the one neck part 120 and the other neck part 120 are positioned on opposite sides with respect to the mounting part 110, as illustrated in an example in FIG. 5

In this case, in the case where one mounting part 110 is supported only by one neck part 120 as illustrated in FIG. 2, the mounting part 110 forming one end portion of the metal terminal 40 serves as a free end, and hence the mobility is high. Therefore, a stress transmitted from the fixing part 100 is unlikely to be accumulated in the mounting part 110. On the other hand, in the case where the mounting part 110 is supported by the 2 or more neck parts 120 as illustrated in FIGS. 3 to 5, although the stability of support of the mounting part 110 increases, the mobility decreases. Therefore, compared to the case where one neck part 120 is used, a stress transmitted from the fixing part 100 is likely to be accumulated in the mounting part 110. When the stress accumulated in the mounting part 110 increases, the solder connecting part becomes likely to be cracked. Accordingly, in order to support the mounting part 110 more stably, the number of the neck parts 120 is preferably about 2 to 4, most preferably 2 for practical use even in the case where one mounting part 110 is supported by the 2 or more neck parts 120.

Further, the form in which one mounting part is supported only by one neck part 120 illustrated in FIG. 2 is substantially the same as the first form in that the neck part 120 is present only on one side of the mounting part 110. From the viewpoint of a biased degree of an arrangement position of two neck parts 120 with respect to the mounting part 110, the first form has the largest biased degree, the second form has the second largest biased degree, and the third form has the smallest biased degree. Considering the foregoing, even in the case where one mounting part 110 is supported by two neck parts 120, the first form or the second form is preferred, and the first form is more preferred from the viewpoint of suppressing the accumulation of a stress in the mounting part 110.

Similarly, in the case where the mounting part 110 is supported by the 3 or more neck parts 120, the forms described in the following items (A) to (C) are preferred, the form described in the following item (A) or (B) is more preferred, and the form described in the following item (A) is most preferred.

(A) Case where all the combinations of any two neck parts 120 selected arbitrarily from 3 or more neck parts 120 satisfy the first form (B) Case where part of the combinations of any two neck parts 120 selected arbitrarily from 3 or more neck parts 120 satisfy the first form, and the remaining combinations satisfy the second form (C) Case where all the combinations of any two neck parts 120 selected arbitrarily from 3 or more neck parts 120 satisfy the second form In the example illustrated in FIG. 1, the base 30 is formed integrally with the bobbin 20 and has a ring shape forming the hollow part 32. However, the base 30 may be a member separate from the bobbin 20. The base 30 may also be formed of 2 or more components or portions. In addition, the shape of the base 30 is not particularly limited as long as the shape does not impair the fixing of the metal terminal 40 with a neck part and the other metal terminals 42 to be used as necessary, and the wiring connection with respect to the metal terminals 40, 42. For example, the base 30 may be formed of a first portion formed integrally with the bobbin 20, and a second portion provided so as to be spaced from the first portion and disposed so as to be opposed to the first portion in the axial direction C of the bobbin 20. As the base 30 formed of those two portions, there is given a structure in which, in FIG. 1, the ring-shaped base 30 is divided into two portions in a direction substantially orthogonal to the axial direction C so as to pass through a substantially center portion of the chip capacitor 50. However, from the viewpoint of ensuring the productivity and the entire strength of the antenna coil component 10, it is particularly preferred that the entire base 30 be formed integrally with the bobbin 20 as illustrated in FIG. 1, and the base 30 have a ring shape forming the hollow part 32. Further, although the base 30 is provided only on one end side of the bobbin 20 in the axial direction C in the example illustrated in FIG. 1, the base 30 can also be provided on both of one end side and the other end side of the bobbin 20.

In the case of using a resin material as the insulating material for forming the bobbin 20 and the base 30, any known resin material can be used. On the other hand, in the antenna coil component 10 according to the first embodiment, an electronic component is mounted on the mounting part 110 as necessary by soldering, and in the case of manufacturing an antenna unit through use of the antenna coil component 10 according to the first embodiment, an electronic component is mounted on the mounting part 110 by soldering. Therefore, a high-temperature process is to be performed for soldering.

However, in the antenna coil component 10 according to the first embodiment, the metal terminal 40 including the mounting part 110 is in contact with the base 30 only in a portion of the fixing part 100 mainly, and the mounting part 110 is supported by the base 30 through the neck part 120 and the fixing part 100. Therefore, when a spot reflow method is used for soldering the electronic component such as the chip capacitor 50 to the mounting part 110, the temperatures of only the electronic component such as the chip capacitor 50, the mounting part 110, and the vicinity thereof become high during soldering. In addition, the heat generated during soldering is transmitted from the mounting part 110 to the base 30 via the neck part 120 and the fixing part 100 successively, and hence a heat transfer path is long. Therefore, a thermal loss caused by the time when the heat reaches the base 30 is great. Therefore, the base 30 is not heated to a temperature as high as that of the mounting part 110 during soldering using the spot reflow method. Thus, it is not necessary to use a reflow furnace for heating the entire antenna coil component 10 for soldering in the course of manufacturing the antenna coil component 10 according to the first embodiment, and the base 30 is not heated to high temperature, either, even when the spot reflow method is used. Therefore, in the case of using a resin material as the insulating material forming the bobbin 20 and the base 30, it is generally preferred to use a heat-labile resin which is less expensive than a heat-resistant resin in terms of cost.

Note that, the term "heat-labile resin" as used herein refers to a resin (resin which is changed in dimension and has its function degraded when passing through a reflow furnace due to low heat resistance) which cannot be passed through a reflow furnace. Specific examples of the heat-labile resin include a polypropylene resin and a polybutylene terephthalate resin. Further, the term "heat-resistant resin" refers to a resin other than the above-mentioned heat-labile resins, and in general, there can be given various engineering plastics.

Further, the antenna coil component 10 according to the first embodiment is used in an antenna unit, and it is particularly preferred that the antenna coil component 10 be used in an in-vehicle antenna unit. In the in-vehicle antenna unit, the antenna coil component 10 is exposed to vibration during the operation of a vehicle, and hence the vibration is also transmitted to the electronic component such as the chip capacitor 50 via the metal terminal 40. However, in the antenna coil component 10 according to the first embodiment, the vibration transmitted to the antenna coil component 10 is transmitted from the fixing part 100 fixed to the base 30 to the electronic component connected by soldering to the mounting part 110 through the neck part 120. However, the neck part 120 having the width W smaller than that of the mounting part 110 serves as a flat spring due to its relatively low stiffness, and absorbs and attenuates the vibration transmitted from the fixing part 100 side very easily. Consequently, the vibration transmitted to the solder connecting part and the electronic component such as the chip capacitor 50 can be weakened, with the result that it is possible to prevent adverse effects (for example, deterioration of reliability of the electronic component, disconnection of the solder connecting part, etc.) caused when the solder connecting part and the electronic component are exposed to the vibration for a long period of time.

Figure 6:
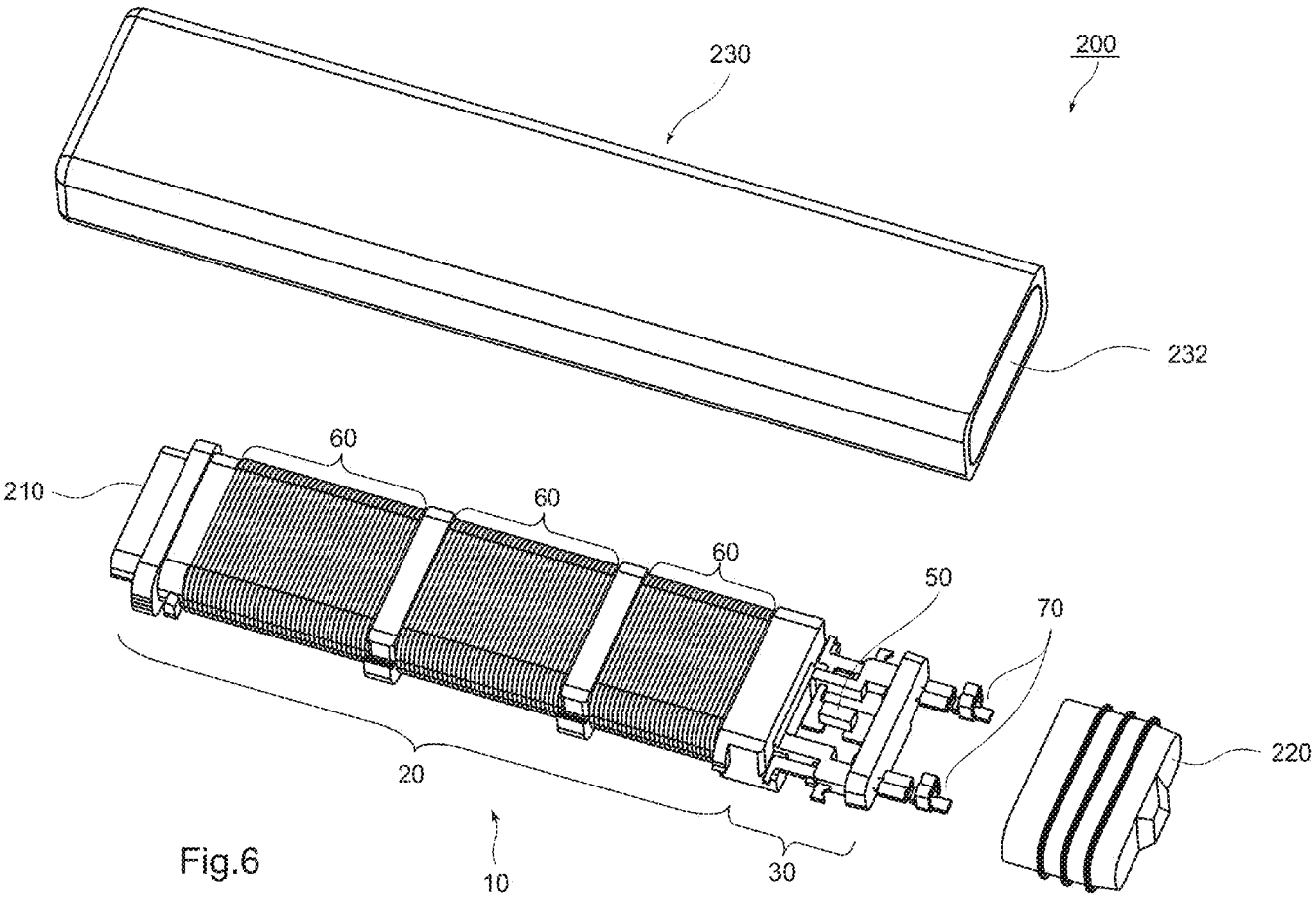
FIG. 6 is an exploded perspective view illustrating an example of an antenna unit according to the first embodiment.

Next, an antenna unit using the antenna coil component 10 according to the first embodiment is described. FIG. 6 is an exploded perspective view illustrating an example of the antenna unit according to the first embodiment. The antenna unit 200 illustrated in FIG. 6 includes the antenna coil component 10 on which the chip capacitor 50 is mounted as illustrated in FIG. 1, a bar-shaped magnetic core 210 disposed in the bobbin 20 of the antenna coil component 10, a tubular grommet 220, and a bottomed tubular case 230 for accommodating the antenna coil component 10 containing the magnetic core 210 and the grommet 220. Note that, in the antenna coil component 10 illustrated in FIG. 6, a winding 60 is wound around the outer circumferential surface 22 of the bobbin 20 unlike FIG. 1. Further, in the antenna coil component 10, two harness terminals 70 are further mounted to the side of the antenna coil component 10 on which the base 30 is provided. One harness terminal 70 is connected to the metal terminal 40B, and the other harness terminal 70 is connected to the metal terminal 42. Wiring (not shown) for connection to a device, a power source, and the like outside of the antenna unit 200 is connected to each harness terminal 70.

In this case, the antenna coil component 10 is accommodated in the case 230 together with the grommet 220 so that the base 30 side is directed to an opening part 232 side of the case 230 while the grommet 220 is fitted to the base 30 side so as to cover the two harness terminals 70. Further, the opening part 232 of the case 230 for accommodating the antenna coil component 10 and the like is sealed with a sealing member.

There is no particular limit to a method of manufacturing the antenna coil component 10 according to the first embodiment, and the antenna coil component 10 can be manufactured appropriately by a known manufacturing method. However, it is preferred that the antenna coil component 10 according to the first embodiment be manufactured at least through an injection molding step, a solder application step, and a soldering step. Now, a method of manufacturing the antenna coil component 10 according to the first embodiment is described in the order of steps.

First, the injection molding step includes preparing a metal member including at least the fixing part 100, the mounting part 110 in a plate shape provided at a position spaced from the fixing part 100, and the neck part 120 which connects the fixing part 100 and the mounting part 110 to each other, the neck part 120 having a length in a direction substantially orthogonal to a direction from the fixing part 100 to the mounting part 110 and substantially parallel to front and rear surfaces of the mounting part 110, which is smaller than that of the mounting part 110. The metal member may be the metal terminal 40 with a neck part forming the antenna coil component 10. However, from the viewpoint of the productivity and handling property, in general, it is particularly preferred to use one metal member in which at least all the metal terminals 40A, 40B, 42 forming the antenna coil component 10 are mounted to an outer frame. Note that, two harness terminals 70 may be further mounted to the outer frame of the metal member.

Figure 7:
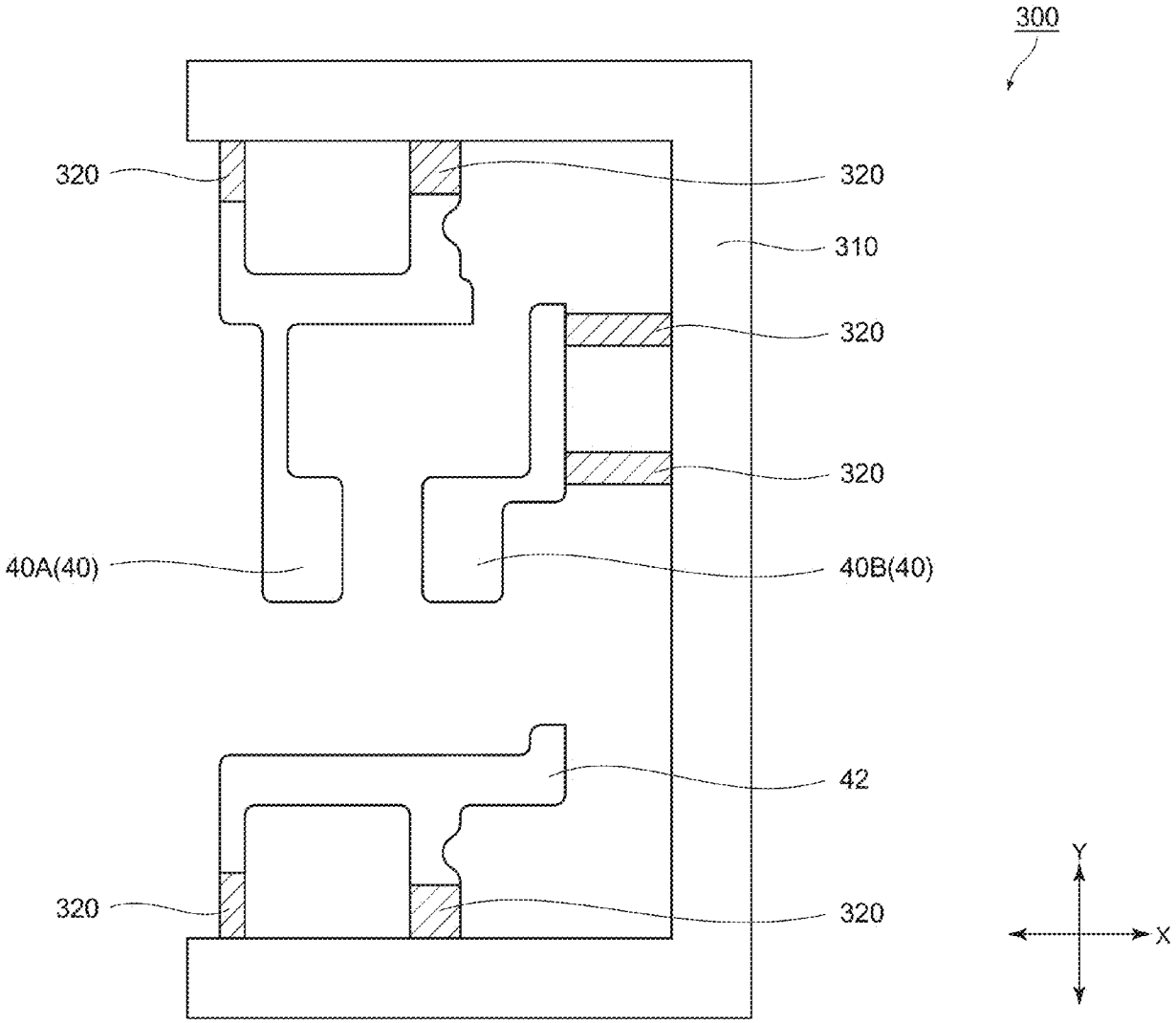
FIG. 7 is a schematic plan view illustrating an example of a metal member used in a method of manufacturing the antenna coil component according to the first embodiment.

FIG. 7 is a schematic plan view illustrating an example of a metal member used for the method of manufacturing the antenna coil component 10 according to the first embodiment. A metal member 300 illustrated in FIG. 7 includes an outer frame 310 having a U-shape brought down to the left side, the metal terminals 40A, 40B, 42 disposed on an inner side of the outer frame 310, and connecting parts 320 (shaded regions in FIG. 7) for connecting the outer frame 310 and the metal terminals 40A, 40B, 42 to each other. Note that, the metal terminal 40A is connected to an upper side of the outer frame 310 (right side of the U-shape), the metal terminal 40B is connected to a right side of the outer frame 310 (bottom side of the U-shape), and the metal terminal 42 is connected to a bottom side of the outer frame 310 (left side of the U-shape). Then, the relative arrangement relationship of the three metal terminals 40A, 40B, 42 is the same as the arrangement relationship in the antenna coil component 10. Note that, the shape of the outer frame 310 and the shape and arrangement position of the connecting parts 320 can be appropriately selected without being limited to the example illustrated in FIG. 7.

The metal member 300 is disposed in a mold, and thereafter a resin is injection-molded into the mold. Thus, the base 30 made of a resin material is formed, and at the same time, the fixing parts 100A, 102, 100B, 104 are buried in the base 30. Consequently, the base 30 is formed, and at the same time, the metal terminals 40A, 40B, 42 are fixed to the base 30. Note that, in the case of manufacturing the antenna coil component 10 illustrated in FIG. 1, the bobbin 20 as well as the base 30 is integrally formed during injection molding. Note that, in a state where the antenna coil component 10 is completed, the metal terminals 40A, 40B, 42 are respectively separate members independent from each other as illustrated in FIG. 2. However, in the course of manufacturing the antenna coil component 10, one metal terminal in which the three metal terminals 40A, 40B, 42 are continuously connected to each other may be configured without the outer frame 310. In this case, it is sufficient that the connecting parts for connecting the three metal terminals 40A, 40B, 42 be cut at appropriate timing during the manufacturing process.

After the injection molding step is completed, a solder application step of applying a cream solder to at least one of front and rear surfaces of each of the mounting part 110A of the metal terminal 40A and the mounting part 110B of the metal terminal 40B is performed. Then, the electronic component such as the chip capacitor 50 is disposed on the surfaces of the mounting parts 110A, 110B to which the cream solder has been applied, and thereafter, a soldering step of soldering the electronic component to the mounting part 110 is performed by a spot reflow method. After that, as needed, various post-processes such as the winding of the winding 60 around the bobbin 20 and the removal of the outer frame 310 from the metal terminals 40A, 40B, 42 by cutting are performed, with the result that the antenna coil component 10 according to the first embodiment can be obtained.

Note that, local heating by the spot reflow method is performed instead of entire heating with a reflow furnace during the soldering step, and hence a heat-labile resin can be used as the insulating material forming the base 30 and the bobbin 20 formed integrally therewith. Further, as the spot reflow method, known spot reflow methods can be used appropriately, such as a hot blast nozzle system of soldering by jetting hot blast from a nozzle and a light beam system of soldering by irradiation of condensed light from a light source such as a halogen lamp or irradiation of laser light. Note that, of those systems, it is preferred to use the hot blast nozzle system.

When soldering is performed by the hot blast nozzle system, soldering may be performed by selectively blowing hot blast output from a nozzle to only the vicinity of a connecting portion between the electronic component such as the chip capacitor 50 and the mounting part 110A and the vicinity of a connecting portion between the electronic component such as the chip capacitor 50 and the mounting part 110B, thereby heating only those portions in a concentrated manner. Hot blast may also be jetted, with the tip end of the nozzle and the center portion of the electronic component such as the chip capacitor 50 being substantially matched with each other, in planar directions of the metal components 40A, 40B. Hot blast may also be blown from surfaces of the mounting parts 110A and 110B on which the electronic component such as the chip capacitor 50 is mounted or may be blown from surfaces on an opposite side thereto.

Now, various embodiments of soldering by the hot blast nozzle system are described with reference to the drawings by exemplifying, as a specific example, the case of manufacturing the antenna coil component 10 illustrated in FIGS. 1 and 2. Note that, FIGS. 8, 9, and 11 to 13 described below are schematic end views taken along the line A1-A2 of FIG. 2, each illustrating a state in which a nozzle 400 or the like is further disposed in the vicinity of the chip capacitor 50 illustrated in FIG. 2. Further, the chip capacitor 50 illustrated in FIG. 2 has already been soldered, but the chip capacitors 50 illustrated in FIGS. 8, 9, and 11 to 13 have not been soldered.

Figure 8:
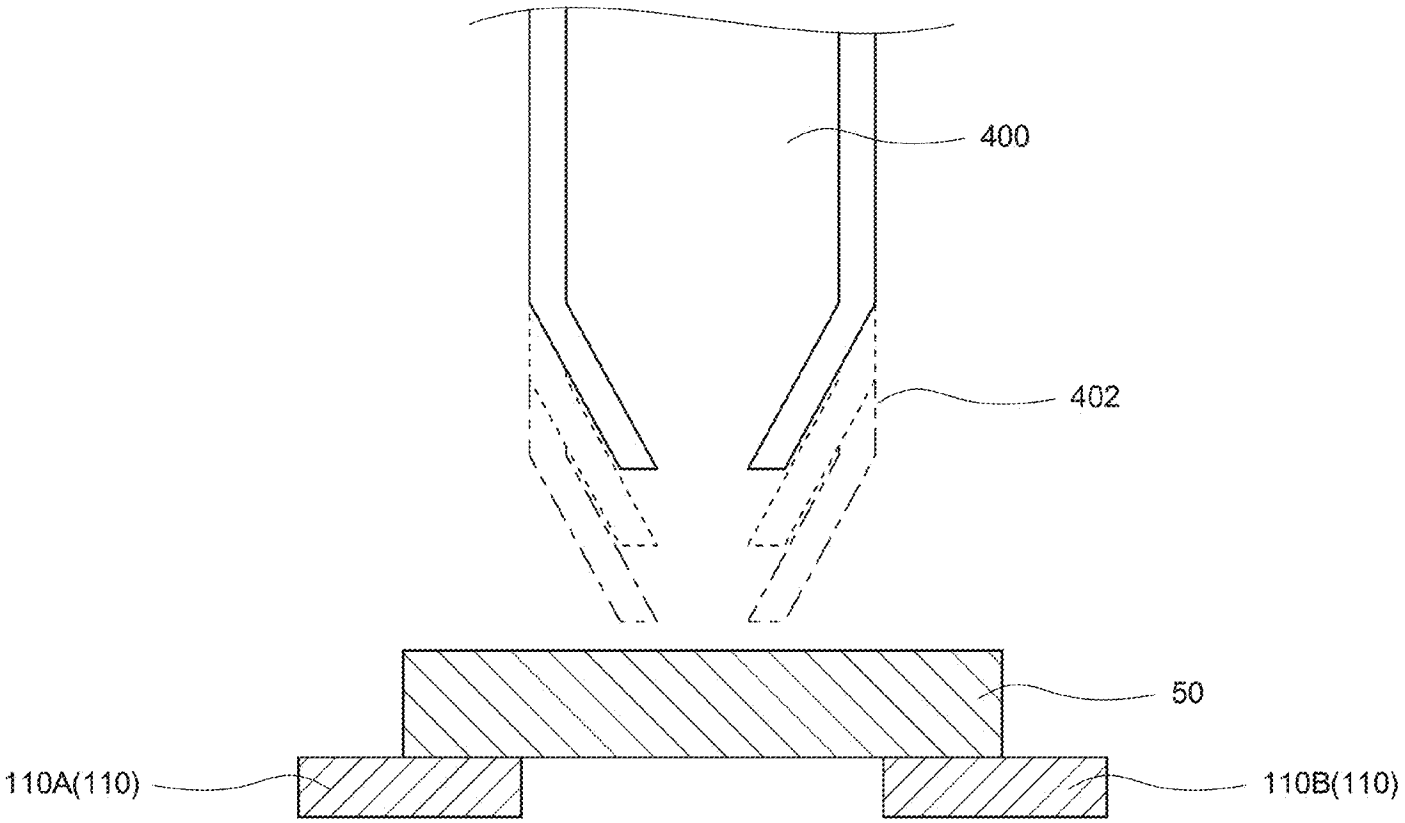
FIG. 8 is a schematic end view illustrating an example of soldering by a hot blast nozzle system in the method of manufacturing the antenna coil component according to the first embodiment.
Figure 9:
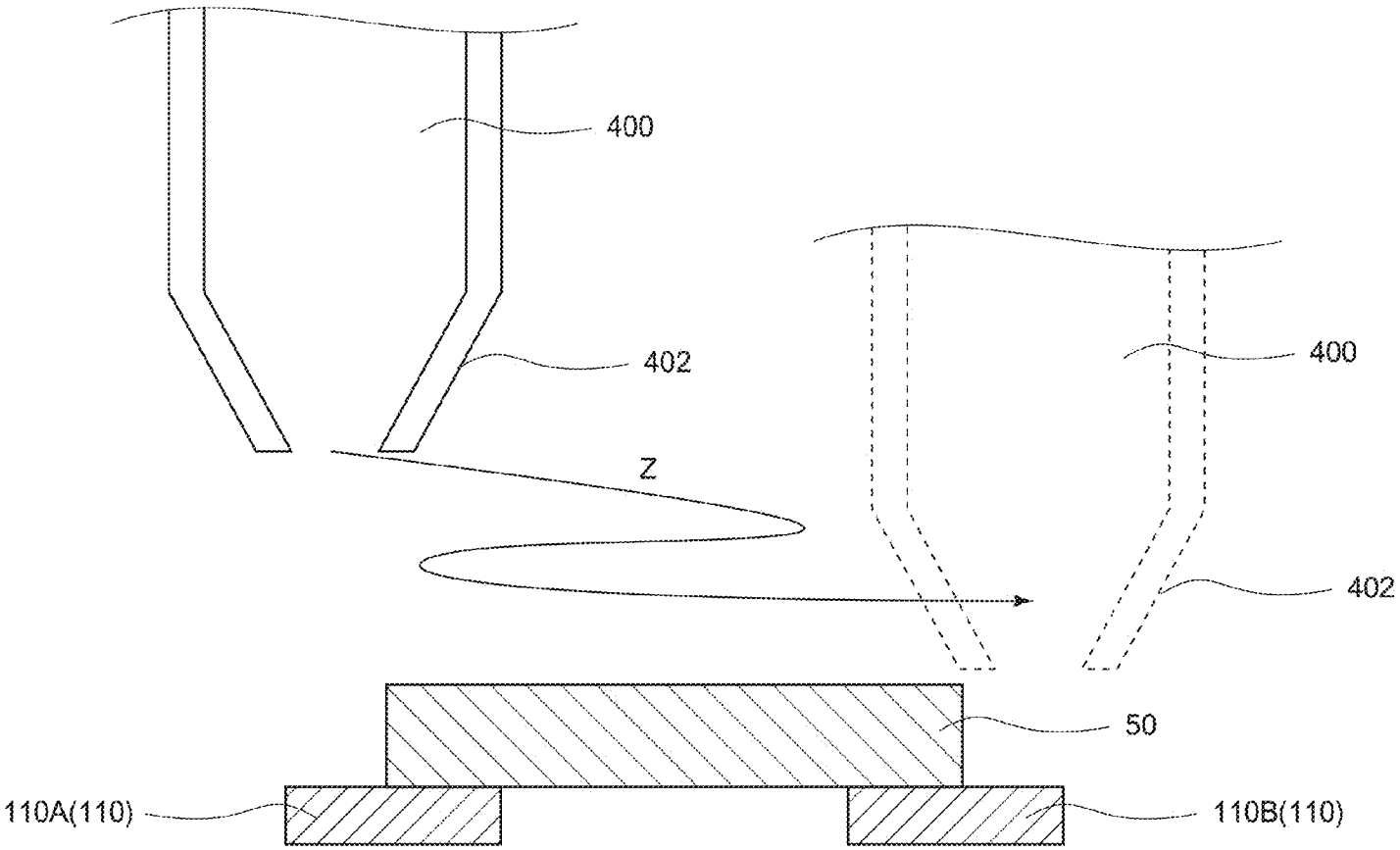
FIG. 9 is a schematic end view illustrating another example of soldering by the hot blast nozzle system in the method of manufacturing the antenna coil component according to the first embodiment.

First, when hot blast is jetted, the distance from a plane including the mounting parts 110A and 110B to the tip end of the nozzle is not particularly limited, but it is preferred that the distance be appropriate adjusted in a range of about 0.5 cm to about 10 cm. In addition, (1) the hot blast may be jetted while the distance (jetting distance) from a tip end 402 of the nozzle 400 to the mounting parts 110A, 110B is reduced gradually. For example, in the case where hot blast is jetted substantially in a direction right below under the condition that the nozzle 400 is disposed right above the chip capacitor 50 as illustrated in FIG. 8, (a) a jetting distance can be shortened after the first jetting of hot blast at a position of the tip end 402 indicated by the solid line in FIG. 8, (b) next, the second jetting of hot blast can be performed at a position of the tip end 402 indicated by the dotted line in FIG. 8, and the jetting distance can be further shortened, and (c) after that, the third jetting of hot blast can be performed at a position of the tip end 402 indicated by the alternate long and short dash lines in FIG. 8. (2) Further, hot blast may be jetted while the tip end 402 of the nozzle 400 is moved in a direction substantially parallel to the front and rear surfaces of the mounting parts 110A, 110B in a zigzag manner as indicated by an arrow "Z" in FIG. 9 so that the jetting distance becomes shorter gradually, so as to equally control the temperatures at both ends of the chip capacitor 50 disposed on the mounting parts 110A, 110B as illustrated in FIG. 9. In this case, it is preferred that the temperature in the vicinity of the tip end 402 (jetting port) of the nozzle 400 be set to a substantially constant value (this temperature is higher than the melting point of a cream solder) irrespective of any heating system described in the items (1) and (2).

Figure 10:
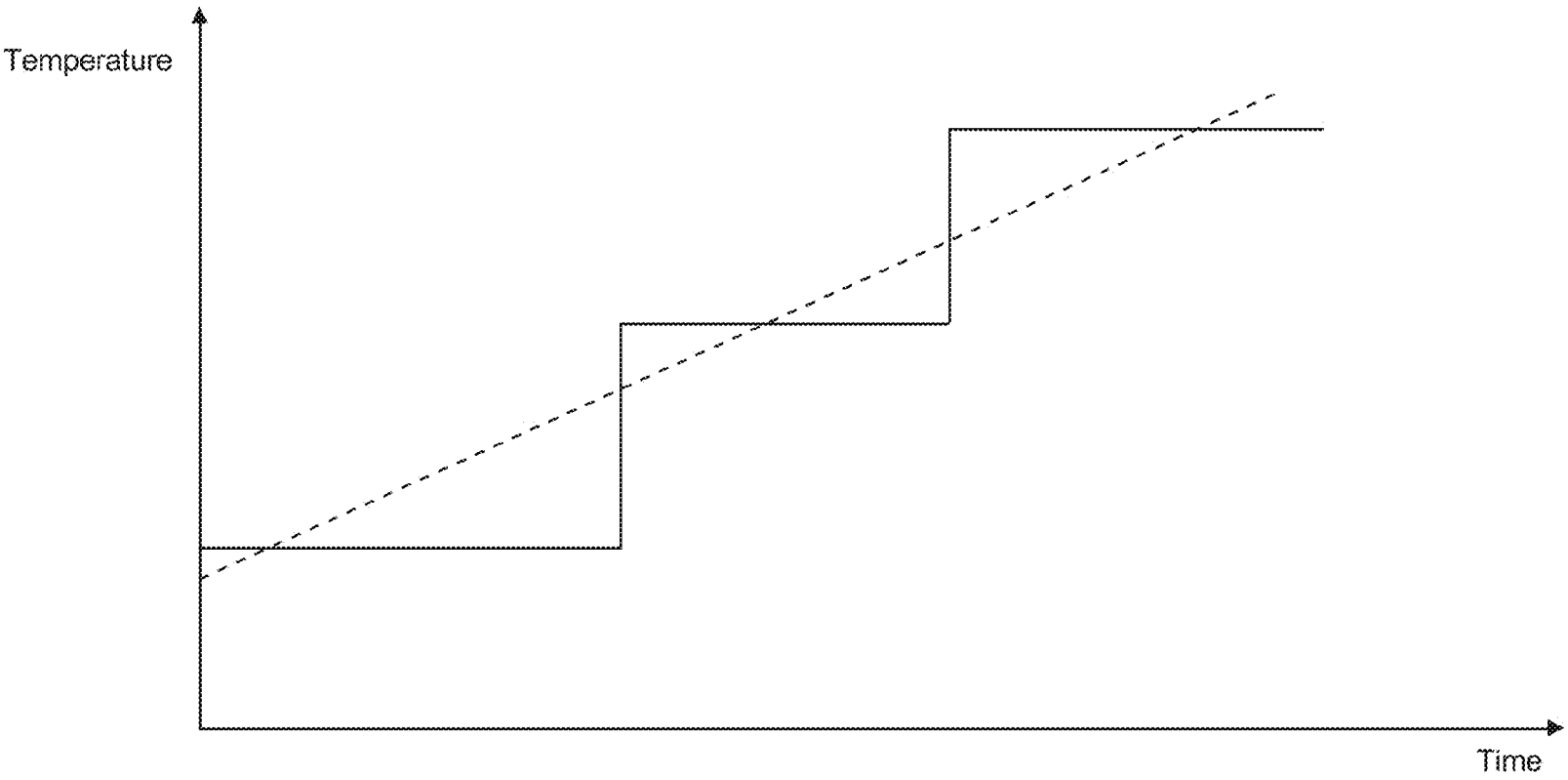
FIG. 10 is a graph showing an example of a relationship between the temperature of hot blast in the vicinity of a nozzle tip end and time when soldering by the hot blast nozzle system is performed in the method of manufacturing the antenna coil component according to the first embodiment.

Further, as shown in FIG. 10, while the jetting distance is kept constant, the temperature in the vicinity of the tip end 402 (jetting port) of the nozzle 400 may be increased linearly at a predetermined temperature increasing rate with respect to time (temperature increasing pattern indicated by the dotted line of FIG. 10), or the temperature may be increased gradually with respect to time (temperature increasing pattern indicated by the solid line of FIG. 10).

Figure 11:
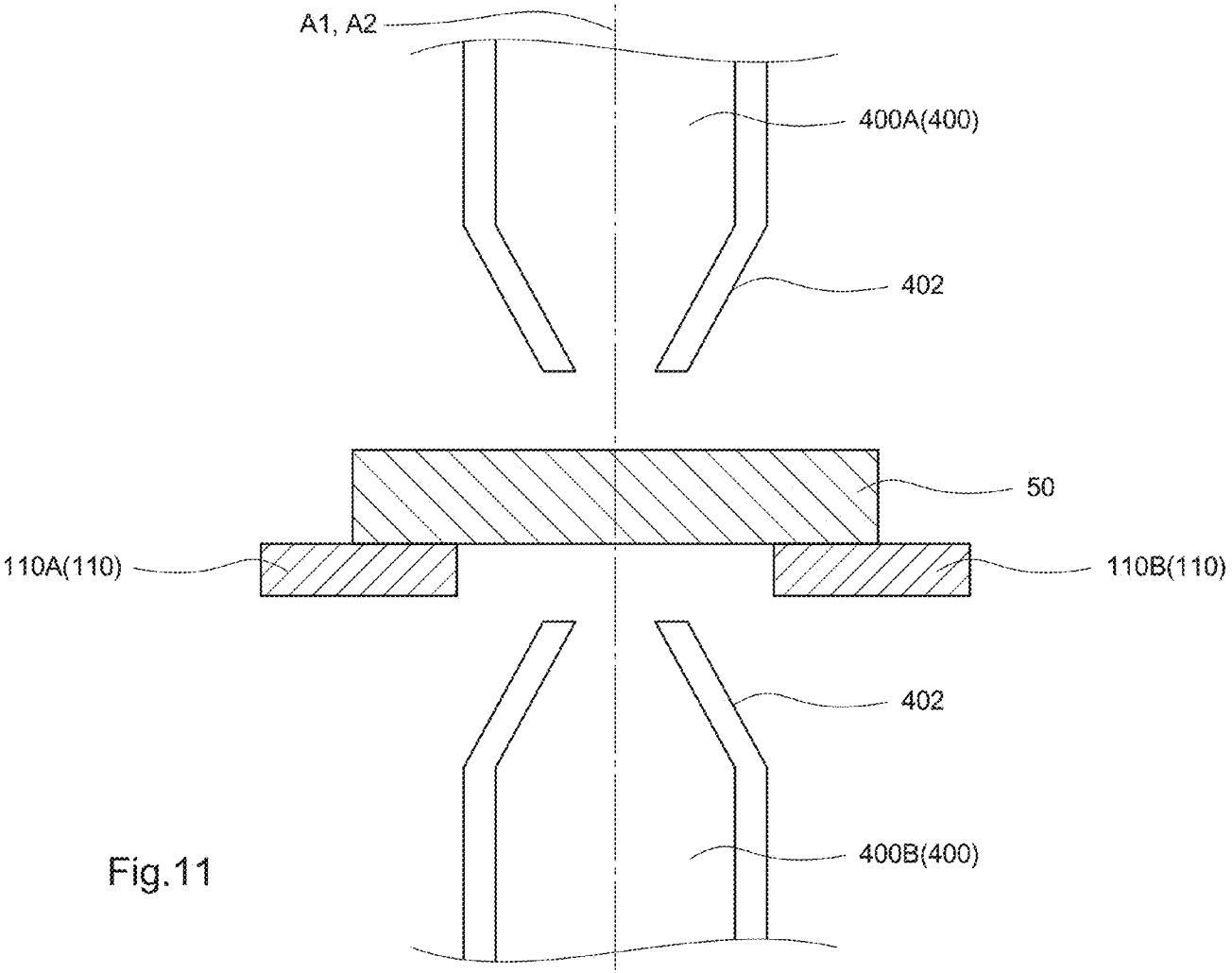
FIG. 11 is a schematic end view illustrating another example of soldering by the hot blast nozzle system in the method of manufacturing the antenna coil component according to the first embodiment.
Figure 12:
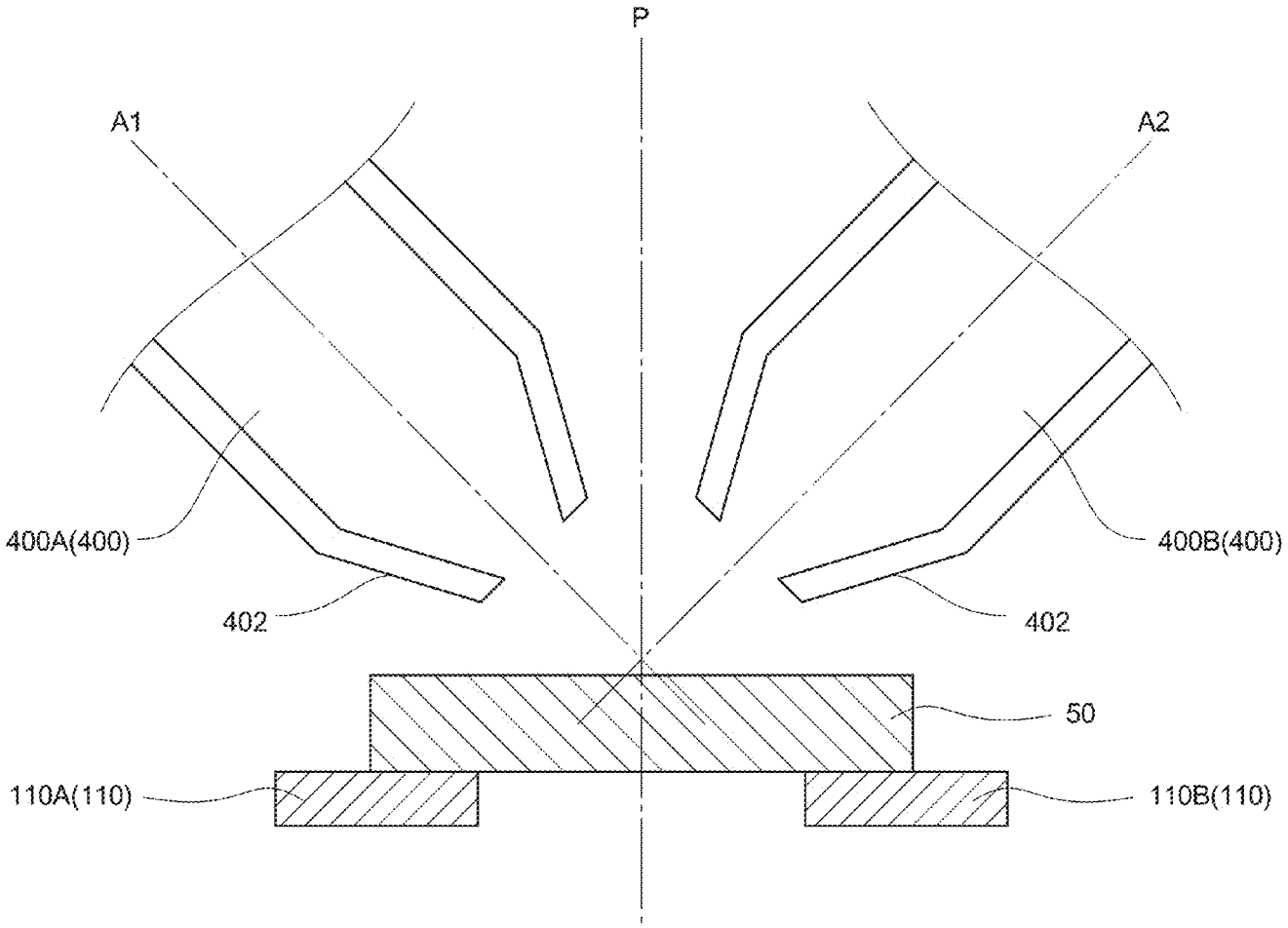
FIG. 12 is a schematic end view illustrating another example of soldering by the hot blast nozzle system in the method of manufacturing the antenna coil component according to the first embodiment.
Figure 13:
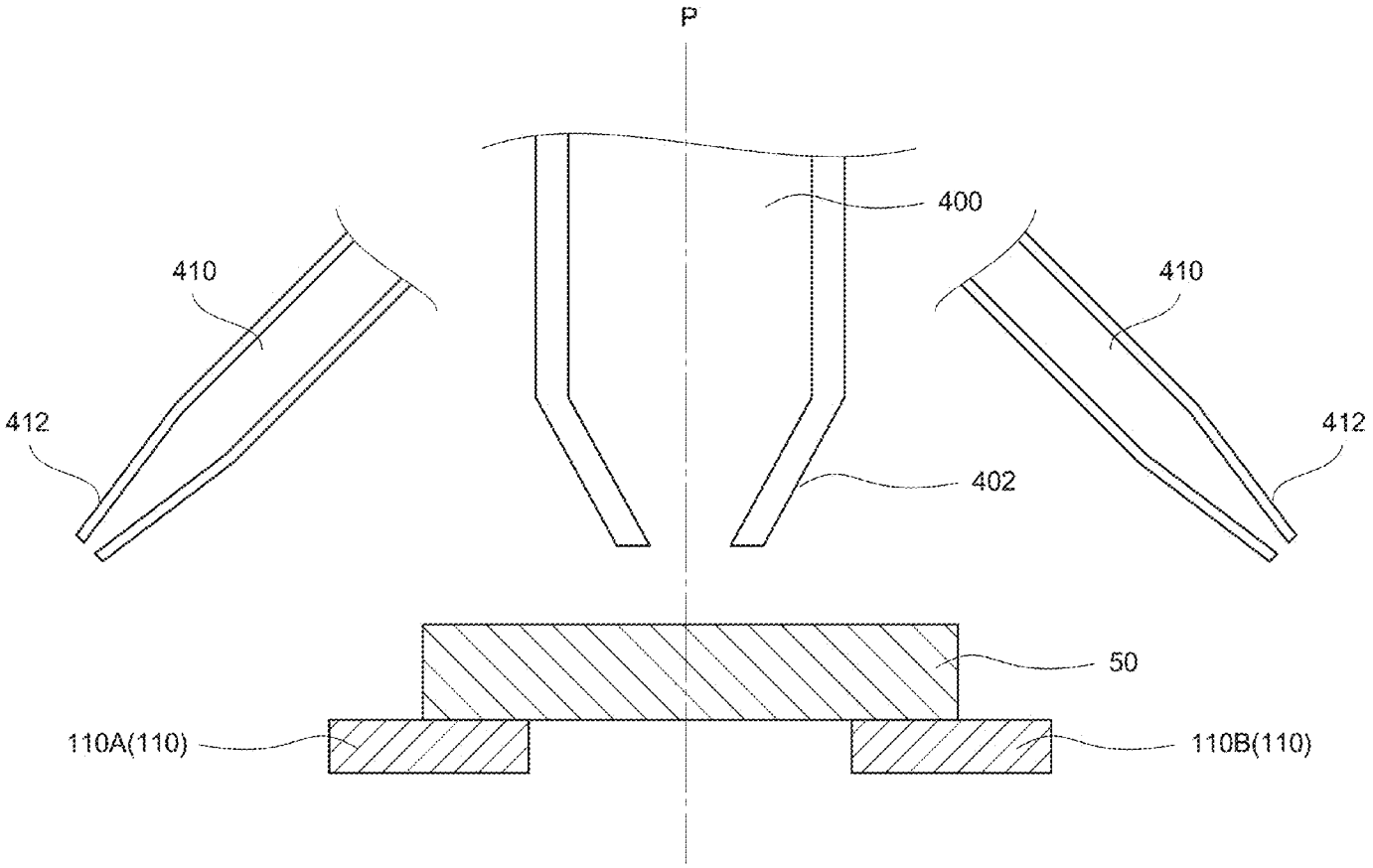
FIG. 13 is a schematic end view illustrating another example of soldering by the hot blast nozzle system in the method of manufacturing the antenna coil component according to the first embodiment.

Further, from the viewpoint of performing the soldering process more efficiently, a plurality of the nozzles 400 for jetting hot blast may be used as illustrated in FIGS. 11 and 12, or auxiliary nozzles 410 for jetting inert gas such as nitrogen gas or noble gas or cooling low-temperature gas may be used together with the nozzle 400 as illustrated in FIG. 13. In this case, the blast pressure, temperature, and change in the temperature with passage of time of gas jetted from the respective nozzles 400, 410, and the movement patterns of the respective nozzles 400, 410 can be appropriately selected, which may be the same or different between the same kind of nozzles.

Note that, FIGS. 11 and 12 each illustrate an example in which soldering is performed through use of a first nozzle 400A and a second nozzle 400B as the nozzle 400 for jetting hot blast. In this case, in the example illustrated in FIG. 11, respective center axes A1, A2 of the first nozzle 400A and the second nozzle 400B are substantially orthogonal to the front and rear surfaces of the mounting parts 110A, 110B. Further, the first nozzle 400A is disposed on one surface side of the chip capacitor 50, and the second nozzle 400B is disposed on the other surface side of the chip capacitor 50. Soldering is performed by jetting hot blast in this state. On the other hand, in the example illustrated in FIG. 12, the first nozzle 400A and the second nozzle 400B are arranged on a side of the mounting parts 110A, 110B on which the chip capacitor 50 is mounted and arranged at positions which are substantially symmetrical with respect to a straight line P substantially equally dividing the chip capacitor 50 in a width direction thereof. Then, soldering is performed by jetting hot blast to the chip capacitor 50 under the condition that the center axis A1 of the first nozzle 400A and the center axis A2 of the second nozzle 400B diagonally cross the straight line P (cross the straight line P so as to form an angle of about 40° to about 50° in FIG. 12), and each tip end 402 side of the nozzles 400A, 400B is directed to the chip capacitor 50 side.

Further, FIG. 13 illustrates an example of the case where two auxiliary nozzles 410 are used besides one nozzle 400. In the example illustrated in FIG. 13, the nozzle 400 is disposed substantially right above the chip capacitor 50 in the same way as in the case illustrated in FIG. 8. In addition, the two auxiliary nozzles 410 are respectively arranged around the nozzle 400 at positions which are substantially symmetrical with respect to an axial direction of the nozzle 400 on both sides of the nozzle 400. Note that, tip ends 412 of the auxiliary nozzles 410 are directed to sides of the auxiliary nozzles 410 opposite to the side on which the chip capacitor 50 is disposed (that is, the side on which the base (not shown) 30 is disposed). In this case, when soldering is performed, hot blast is jetted from the tip end 402 of the nozzle 400, and inert gas and/or cooling low-temperature gas are jetted from the tip end 412 of the auxiliary nozzle 410. Note that, in the case where inert gas such as nitrogen gas is jetted, thermal oxidation and deterioration of the base 30 and the like can be suppressed easily, and in the case where low-temperature gas such as air at about room temperature is jetted, the thermal shock or thermal oxidation and deterioration of the base 30 and the like by heating can be suppressed easily.

Further, in the case where soldering is performed continuously, (a) soldering may be performed by disposing a plurality of the antenna coil components 10, on each of which the chip capacitor 50 before being soldered to the mounting parts 110A, 110B is mounted, on a belt at a substantially equal interval and moving the belt in one direction so as to move the antenna coil component 10 to a position right below the nozzle 400 fixed at a predetermined position. Alternatively, (b) soldering may be performed by disposing a plurality of the antenna coil components 10 on a flat platform, and thereafter moving the nozzle 400 to a position right above each antenna coil component 10. Alternatively, soldering may be performed by combining the embodiments described in the items (a) and (b). Further, a plurality of the nozzles 400 can also be used in the embodiment (production line) described in the item (a) or (b).

Note that, the antenna coil component 10 according to the first embodiment may further include a structure of an antenna coil component according to a second embodiment of the present invention described later and/or a structure of an antenna coil component according to a third embodiment of the present invention described later. Further, when the antenna coil component 10 according to the first embodiment is manufactured, at least one manufacturing method selected from manufacturing methods of an antenna coil component according to second to fifth embodiments of the present invention described later may be used, and those manufacturing methods, the above-mentioned manufacturing method, and a known manufacturing method can also be combined appropriately.

Second Embodiment

Next, the second embodiment is described. First, in antenna coil components as described in Japanese Patent Application Laid-open No. 2010-16549, Japanese Patent No. 4883096, and Japanese Patent Application Laid-open No. 2006-121278, in general, a metal terminal connected to a lead forming a coil, an electronic component, and the like and a base for supporting and fixing the metal terminal are disposed at one end side of a long antenna coil component. An external connection terminal such as a connector pin is fitted to the metal terminal for connecting the antenna coil component to other devices and the like.

On the other hand, antenna coil components need to be designed in accordance with requested specifications from customers who use antenna units using the antenna coil components. Therefore, it is necessary to newly design a base and a metal terminal every time a new antenna coil component is developed. Therefore, a development period becomes long, and in addition, facility investment for manufacturing a new mold is entailed. On the other hand, although there are various requested specifications from customers, from the viewpoint of a change in specification with respect to existing antenna coil components, the requested specifications of new products are merely a change in mounting form of a connector pin mainly with respect to specifications of existing products in most cases.

The second embodiment has been made in view of the above-mentioned circumstance, and it is an object of the second embodiment to provide an antenna coil component to which a connector pin can be fitted by selecting a desired fitting form from 2 or more kinds of fitting forms, and an antenna unit using the antenna coil component.

In order to achieve the above-mentioned object, an antenna coil component according to the second embodiment includes at least a tubular bobbin formed of an insulating material, a winding wound around an outer circumferential side of the bobbin, a base provided at least at one end side of the bobbin and formed of an insulating material, and a metal terminal having conductivity and fixed to the base. The metal terminal is provided with 3 or more insertion holes for inserting connector pins and fixing them to the metal terminal.

In a modified example of the antenna coil component according to the second embodiment, it is preferred that the metal terminal be provided with 4 or more insertion holes.

In another modified example of the antenna coil component according to the second embodiment, it is preferred that an opening shape of at least one insertion hole selected from all the insertion holes provided in the metal terminal be formed so that a tip end of the connector pin can be inserted to be fixed to the metal terminal so as to be aligned in any direction selected from 2 or more kinds of different directions.

In another modified example of the antenna coil component according to the second embodiment, it is preferred that the metal terminal have a first insertion hole with an opening shape through which the tip end of the connector pin can be inserted to be fixed to the metal terminal so as to be aligned in only one kind of direction, and a second insertion hole with an opening shape through which the tip end of the connector pin can be inserted to be fixed to the metal terminal so as to be aligned in any direction selected from 2 or more kinds of different directions.

In another modified example of the antenna coil component according to the second embodiment, it is preferred that the opening shape of the first insertion hole be a rectangular shape, and the opening shape of the second insertion hole be any opening shape selected from a cross-shape and an L-shape formed by combining two rectangular shapes.

An antenna unit according to the second embodiment includes at least: (1) an antenna coil component including at least a tubular bobbin formed of an insulating material, a winding wound around an outer circumferential side of the bobbin, a base provided at least at one end side of the bobbin and formed of an insulating material, and a metal terminal having conductivity and fixed to the base, the metal terminal being provided with 3 or more insertion holes through which connector pins are inserted to be fixed to the metal terminal; (2) a magnetic core disposed in the bobbin; (3) an electronic component connected by soldering to the metal terminal; (4) a case for accommodating the antenna coil component; and (5) two connector pins respectively inserted to be fixed to the metal terminal through any two insertion holes selected from the 3 or more insertion holes.

Figure 14:
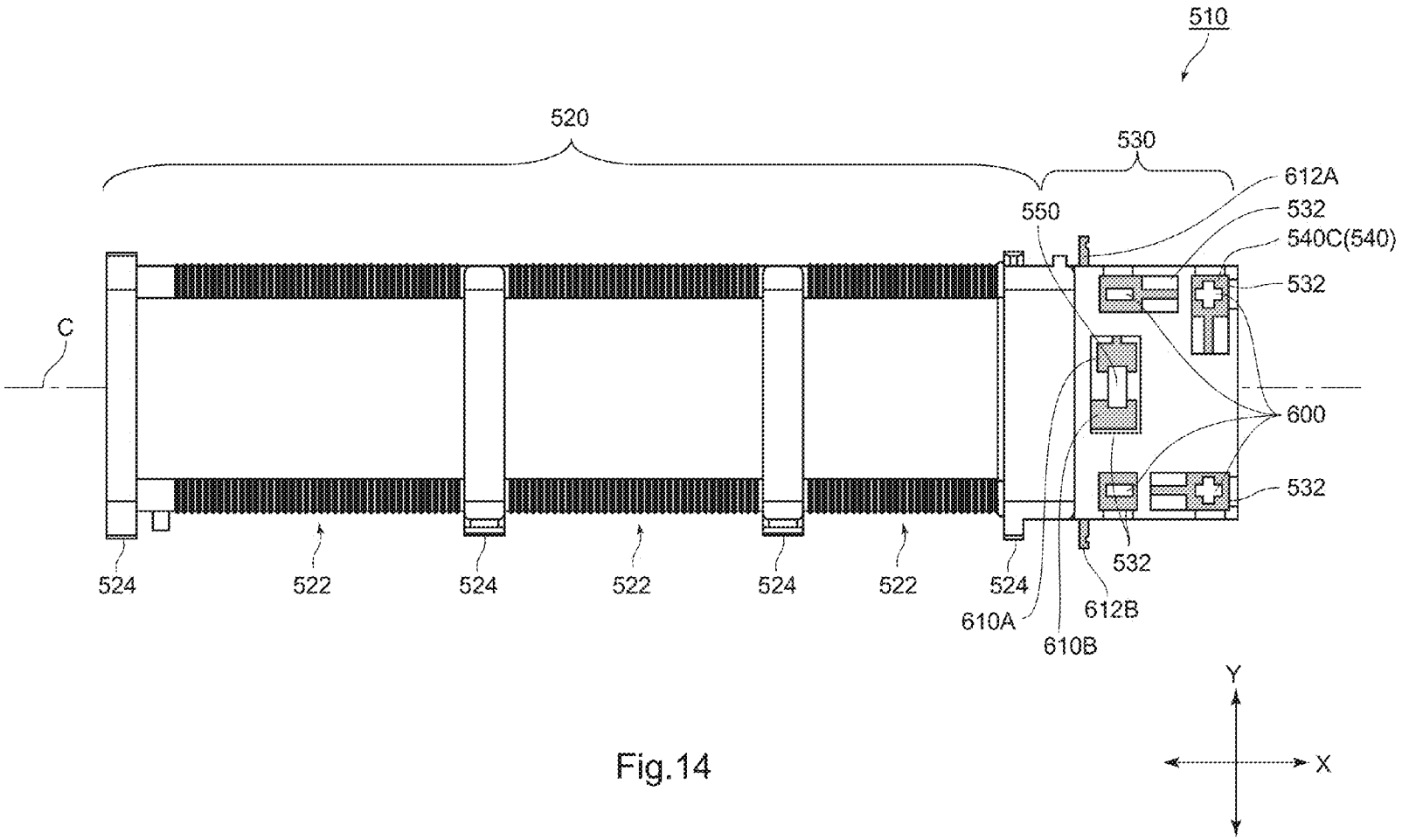
FIG. 14 is a schematic plan view illustrating an example of an antenna coil component according to a second embodiment of the present invention.

FIG. 14 is a schematic plan view illustrating an example of the antenna coil component according to the second embodiment, specifically, illustrating main parts of the antenna coil component.

An antenna coil component 510 illustrated in FIG. 14 includes a tubular bobbin 520 formed of an insulating material, a winding (metal wire covered with an insulating film (not shown)) wound around an outer circumferential side of the bobbin 520, a base 530 provided at least at one end side of the bobbin 520 and formed of an insulating material, and a plate-shaped metal terminal 540C (540) having conductivity and fixed to the base 530. The metal terminal 540C is provided with four insertion holes 600 for inserting connector pins and fixing them to the metal terminal 540C. Note that, it is sufficient that at least three insertion holes 600 be provided in the antenna coil component 510 according to the second embodiment, but it is preferred that 4 or more insertion holes 600 be provided as illustrated in FIG. 14. Further, although there is no particular limit to an upper limit of the number of the insertion holes 600 provided in the metal terminal 540, the number of the insertion holes 600 is preferably 10 or less, more preferably 5 or less from the viewpoint of practical use.

In the antenna coil component 510 according to the second embodiment, a pair of two connector pins can be inserted into any two insertion holes 600 selected from at least three insertion holes 600. Therefore, the connector pins can be fitted to the metal terminal by selecting a desired fitting form from 2 or more kinds of fitting forms. Therefore, in the case where specifications of a new antenna coil component requested by customers are changed merely in a fitting form of a connector pin with respect to related-art antenna coil components, it is sufficient to change the insertion hole 600 through which a connector pin is inserted without newly designing an antenna coil component. Accordingly, in the case of developing a new antenna coil component, it is not necessary to newly design the base 530 and the metal terminal 540, with the result that a development period can be shortened, and facility investment such as the manufacturing of a new mold can be greatly suppressed. In addition, the number of stock components for manufacturing the antenna coil component 510 having a plurality of different kinds of specifications can be easily reduced.

Note that, although the example illustrated in FIG. 14 shows a state before connector pins are inserted in the insertion holes 600, the antenna coil component 510 may be in a state in which the connector pins are inserted in the insertion holes 600.

Further, a plurality of flange parts 524 forming convex portions with respect to an outer circumferential surface 522 are provided on the bobbin 520 along an axial direction C thereof. In this case, the winding is wound around the outer circumferential surface 522 between respective two flange parts 524 adjacent to each other in the axial direction C. Note that, the flange parts 524 may be omitted. An opening part (not shown) is provided on the other end side (left end side in FIG. 4) of the bobbin 520. Further, the bobbin 520 and the base 530 are formed integrally with each other. In this case, the base 530 is provided with five opening parts 532 (also referred to as "hollow parts") passing through the base 530 in a thickness direction of the base 530 (direction orthogonal to an XY-plane of FIG. 14). Parts of the metal terminal 540C, that is, the vicinities of portions in which a pair of mounting parts 610A, 610B and the insertion holes 600 are provided, or the like are exposed in the opening parts 532. Further, the other portions of the metal terminal 540C, in particular, portions not exposed in the opening parts 532 are supported by and fixed to the base 530 by being buried in the base 530.

Note that, as the insulating material forming the bobbin 520 and the base 530, a resin material is generally used in the third embodiment, the fourth embodiment, and the fifth embodiment described later, as well as the second embodiment. As the resin material, any of a heat-resistant resin and a heat-labile resin, or a combination thereof may be used, and further an additive component such as a filler may be dispersed in the resin material. Note that, it is preferred to adopt a heat-labile resin as much as possible as long as it is permitted in terms of manufacturing of the antenna coil component 510 in any embodiment.

In the example illustrated in FIG. 14, a chip capacitor 550 is disposed on the pair of the mounting parts 610A, 610B, which form a part of the metal terminal 540C and are arranged opposed to each other, so as to bridge the mounting parts 610A and 610B. Note that, various electronic components such as the chip capacitor 550 may be connected to the metal terminal 540C by soldering or the like as illustrated in FIG. 14, or none of electronic components may not be connected to the metal terminal 540C. Further, one end of the winding (not shown) is connected to each of two winding connecting parts 612A, 612B (parts of the metal terminal 540C) provided so as to protrude to the outside of a frame of the base 530.

Figure 15:
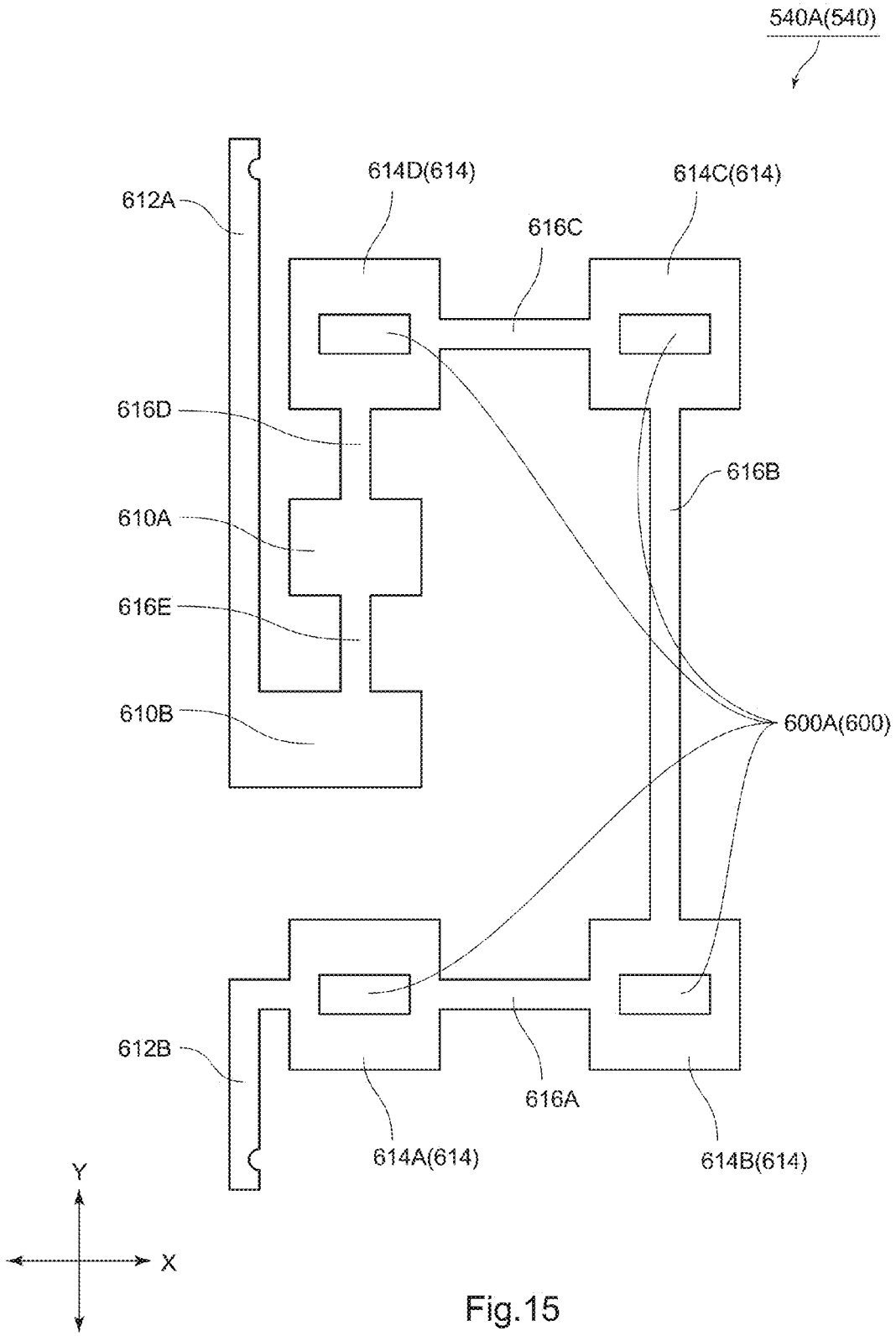
FIG. 15 is a schematic plan view illustrating an example of a metal terminal used for manufacturing the antenna coil component according to the second embodiment.

Next, the metal terminal 540 forming the antenna coil component 510 is described in more detail. FIG. 15 is a schematic plan view illustrating an example of the metal terminal used for manufacturing the antenna coil component according to the second embodiment. Specifically, FIG. 15 is a view illustrating a modified example of the metal terminal 540C before the connector pins and the electronic components such as the chip capacitor 550 are fitted and mounted thereto in the antenna coil component 510 illustrated in FIG. 14.

A metal terminal 540A (540) includes, as main parts thereof, the mounting part 610A, the mounting part 610B, the winding connecting part 612A, the winding connecting part 612B, and four wide parts 614 (first wide part 614A, second wide part 614B, third wide part 614C, and fourth wide part 614D). Note that, the mounting parts 610A and 610B have a rectangular shape whose vertical and horizontal sides are respectively parallel to the Y-direction and the X-direction, and the wide part 614 has a square shape or a rectangular shape close to a square shape whose vertical and horizontal sides are respectively parallel to the Y-direction and the X-direction.

In this case, the first wide part 614A, the second wide part 614B, the third wide part 614C, and the fourth wide part 614D are disposed in a counterclockwise direction in the stated order so as to be respectively positioned at four corners of a rectangle. That is, based on the first wide part 614A, the second wide part 614B is disposed on the right side of the first wide part 614A, the third wide part 614C is disposed on the upper right side of the first wide part 614A, and the fourth wide part 614D is disposed on the upper side of the first wide part 614A.

The first wide part 614A and the second wide part 614B are connected to each other through a band-shaped coupling part 616A extending in parallel to the X-direction, the second wide part 614B and the third wide part 614C are connected to each other through a band-shaped coupling part 616B extending in parallel to the Y-direction, and the third wide part 614C and the fourth wide part 614D are connected to each other through a band-shaped coupling part 616C extending in parallel to the X-direction.

Further, the mounting part 610A and the mounting part 610B are disposed between the fourth wide part 614D and the first wide part 614A in the stated order in a direction from the fourth wide part 614D side to the first wide part 614A side. In this case, the fourth wide part 614D and the mounting part 610A are connected to each other through a band-shaped coupling part 616D extending in parallel to the Y-direction, and the mounting part 610A and the mounting part 610B are connected to each other through a band-shaped coupling part 616E extending in parallel to the Y-direction.

Further, one end of the band-shaped winding connecting part 612A extending in parallel to the Y-direction is connected to an upper left side portion of the mounting part 610B, and the other end thereof is positioned on a further upper side from the third wide part 614C and the fourth wide part 614D in the Y-direction. Further, one end of the band-shaped winding connecting part 612B extending in parallel to the Y-direction is connected to a left side portion of the first wide part 614A, and the other end thereof is positioned on a further lower side from the first wide part 614A and the second wide part 614B in the Y-direction.

A total of four insertion holes 600A are provided so that each insertion hole is provided to a center portion of each of the four wide parts 614. The opening shape of each of the four insertion holes 600A is a rectangular shape whose long side is parallel to the X-direction, and the opening shapes and sizes of the four insertion holes 600A are all the same.

Figure 16A:
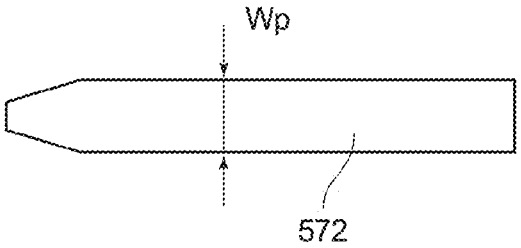
FIGS. 16A to 16C are schematic views illustrating an example of a connector pin fitted to the metal terminal forming the antenna coil component according to the second embodiment.
Figure 16B:
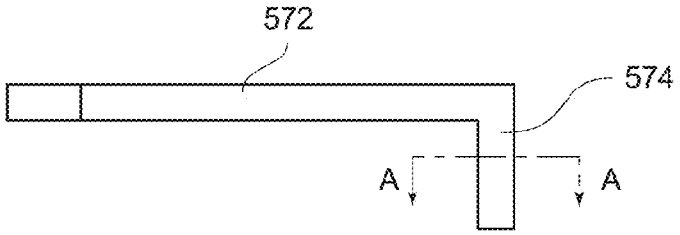
Figure 16C:
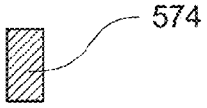

In this case, as a connector pin to be fitted to the metal terminal 540 illustrated in FIG. 15 and the like, for example, a connector pin illustrated in FIGS. 16A to 16C can be used. FIGS. 16A to 16C are schematic views illustrating an example of the connector pin. FIG. 16A is a top view, FIG. 16B is a side view, and FIG. 16C is a sectional view taken along the line A-A of FIG. 16B.

A connector pin 570 illustrated in FIG. 16 includes a band-shaped pin body part 572 pointed at a tip end, and a fitting part 574 extending in a direction which is substantially orthogonal to the pin body part 572 on the other end side opposite to the tip end of the pin body part 572. The cross-section of the fitting part 574 of the connector pin 570 has a rectangular shape as illustrated in FIG. 16C, and the shape and size thereof are substantially matched with the insertion hole 600A illustrated in FIG. 15. In this case, a short side of the cross-section of the fitting part 574 is parallel to a longitudinal direction of the pin body part 572. Therefore, when the fitting part 574 of the connector pin 570 is inserted in the insertion hole 600A of the metal terminal 540A, the connector pin 570 is fixed to the metal terminal 540A so that the tip end of the connector pin 570 is directed in one direction.

Figure 17:
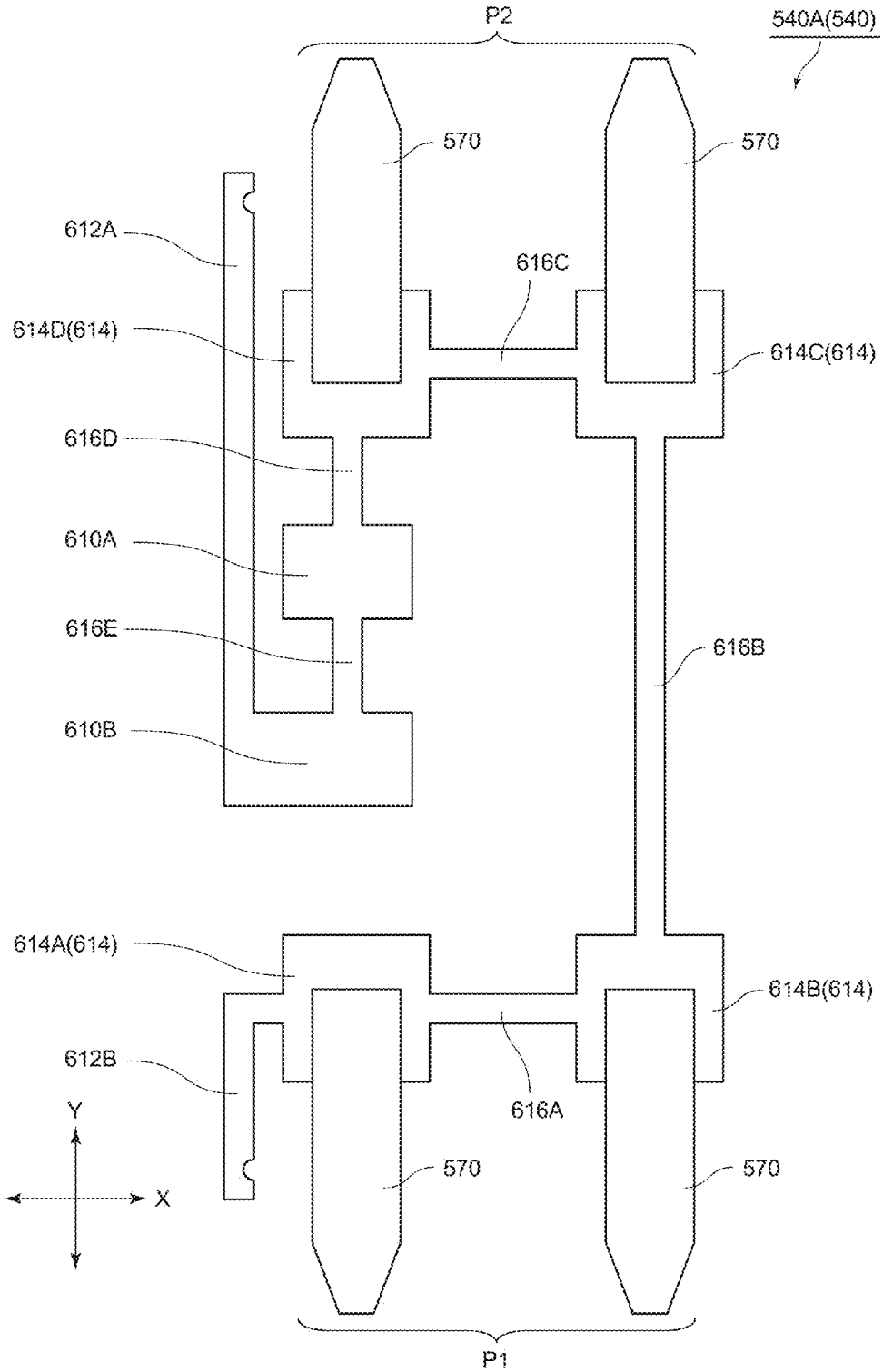
FIG. 17 is a schematic plan view illustrating a fitting form of the connector pin with respect to the metal terminal illustrated in FIG. 15.

Therefore, in the case where two connector pins 570 are fitted to the metal terminal 540A illustrated in FIG. 15, there exist two kinds of fitting forms. FIG. 17 is a schematic view illustrating a state in which two connector pins 570 are fitted to the metal terminal 540A illustrated in FIG. 15. As illustrated in FIG. 17, the fitting form of the connector pins 570 with respect to the metal terminal 540A can be selected from two kinds: a first fitting form P1 and a second fitting form P2 described below.

(1) First Fitting Form P1

Fitting form in which two connector pins 570 are respectively inserted in the insertion hole 600A of the first wide part 614A and the insertion hole 600A of the second wide part 614B so that the tip ends of the two connector pins 570 are directed downward and the positions of the tip ends in the Y-direction are matched with each other.

(2) Second fitting form P2

Fitting form in which two connector pins 570 are respectively inserted in the insertion hole 600A of the third wide part 614C and the insertion hole 600A of the fourth wide part 614D so that the tip ends of the two connector pins 570 are directed upward and the positions of the tip ends in the Y-direction are matched with each other.

Note that, in the case where ends of a winding are connected to the metal terminal 540A, and the electronic component such as the chip capacitor 550 and the connector pins 570 are mounted and fitted to the metal terminal 540A, the ends of the winding are respectively connected to the vicinities of tip ends of the winding connecting parts 612A, 612B, and the coupling part 616E for connecting the two mounting parts 610A, 610B on which the electronic component such as the chip capacitor 550 is disposed is cut. Further, a coupling part positioned between the two connector pins 570 is cut. For example, in the first fitting form P1, the coupling part 616A is cut, and in the second fitting form P2, the coupling part 616C is cut.

Figure 18:
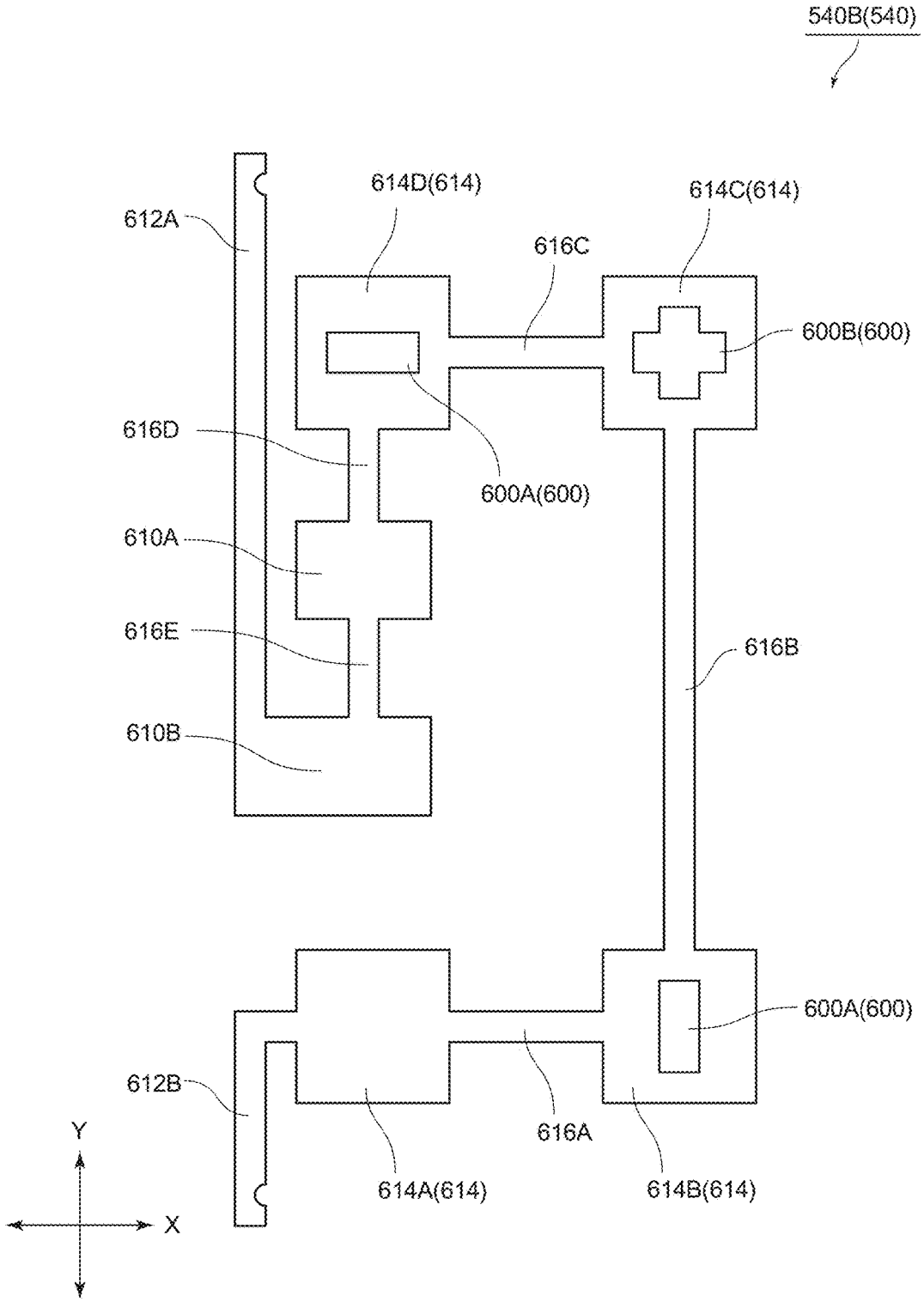
FIG. 18 is a schematic plan view illustrating another example of the metal terminal used for manufacturing the antenna coil component according to the second embodiment.

Next, another example of the metal terminal 540 is described. FIG. 18 is a schematic plan view illustrating another example of the metal terminal 540 used for manufacturing the antenna coil component 510 according to the second embodiment, specifically, illustrating a modified example of the metal terminal 540A illustrated in FIG. 15 and the like.

A metal terminal 540B (540) illustrated in FIG. 18 has the same shape and structure as those of the metal terminal 540A illustrated in FIG. 15 and the like except that the arrangement positions and opening shapes of the insertion holes 600 are partially different from those of the metal terminal 540A illustrated in FIG. 15. In this case, in the metal terminal 540B illustrated in FIG. 18, a total of three insertion holes 600 are provided. Specifically, one insertion hole 600A whose opening shape is rectangular is provided in a center portion of the second wide part 614B so that a long side of the insertion hole 600A is parallel to the Y-direction, one insertion hole 600B (600) is provided in a center portion of the third wide part 614C, and one insertion hole 600A whose opening shape is rectangular is provided in a center portion of the fourth wide part 614D so that a long side of the insertion hole 600A is parallel to the X-direction. Note that, the opening shape of the insertion hole 600B provided in the third wide part 614C is obtained by combining two insertion holes 600A whose opening shape is rectangular so that the combination forms a cross shape. The insertion hole 600B is disposed so that a horizontal axis line and a vertical axis line of the cross shape are respectively matched with the X-direction and the Y-direction. Therefore, in the case where the connector pin 570 is fitted to the metal terminal 540B through the insertion hole 600B, the connector pin 570 can be inserted in the insertion hole 600B by selecting any of a form in which the tip end of the connector pin 570 is directed to the X-direction side and a form in which the tip end of the connector pin 570 is directed in the Y-direction side.

Figure 19:
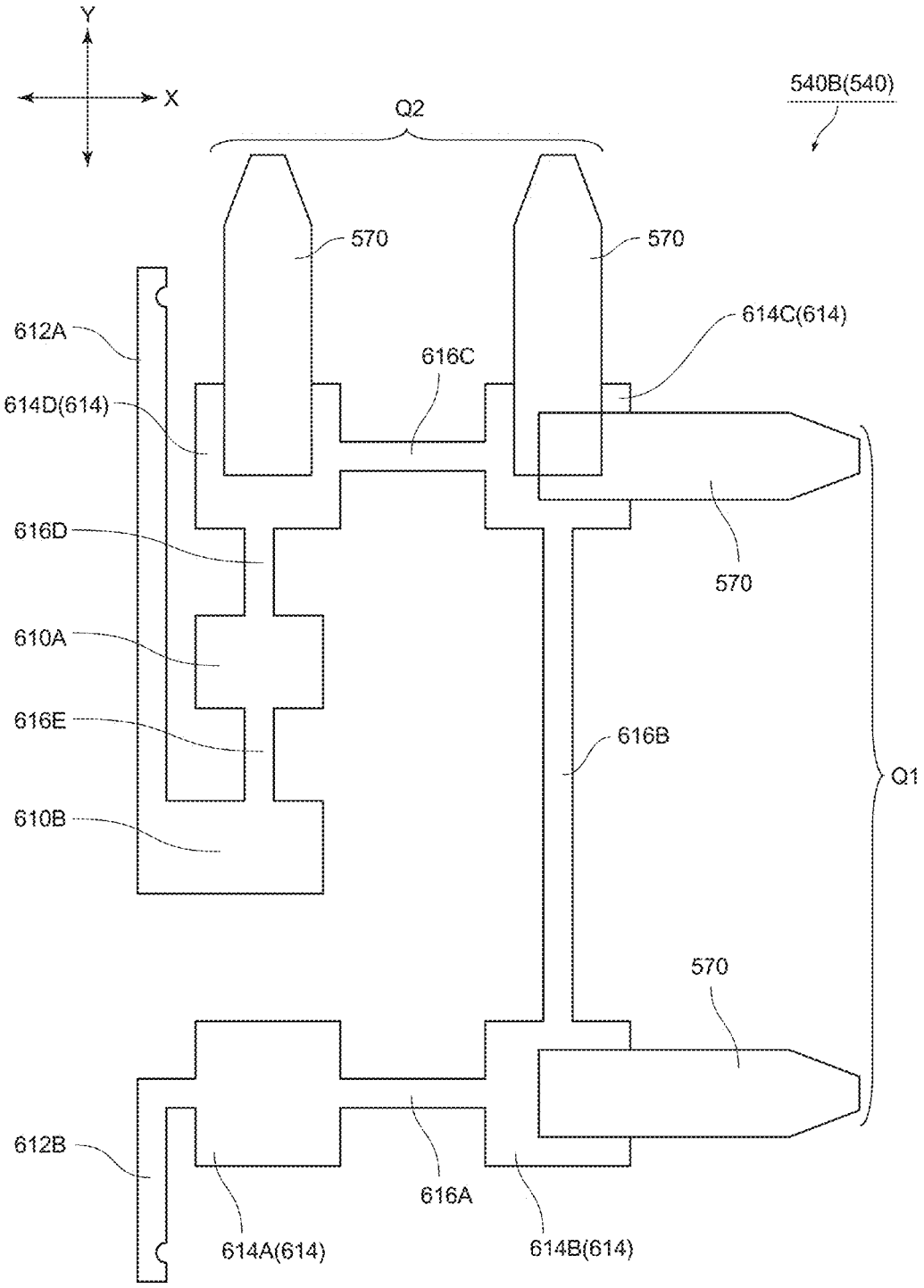
FIG. 19 is a schematic plan view illustrating a fitting form of the connector pin with respect to the metal terminal illustrated in FIG. 18.

Therefore, in the case where two connector pins 570 are fitted to the metal terminal 540B illustrated in FIG. 18, there exist two kinds of fitting forms. FIG. 19 is a schematic view illustrating a state in which two connector pins 570 are fitted to the metal terminal 540B illustrated in FIG. 18. As illustrated in FIG. 19, the fitting form of the connector pins 570 with respect to the metal terminal 540B can be selected from two kinds: a first fitting form Q1 and a second fitting form Q2 described below.

(1) First Fitting Form Q1

Fitting form in which two connector pins 570 are respectively inserted in the insertion hole 600A of the second wide part 614B and the insertion hole 600B of the third wide part 614C so that the tip ends of the two connector pins 570 are directed rightward and the positions of the tip ends in the X-direction are matched with each other.

(2) Second fitting form Q2

Fitting form in which two connector pins 570 are respectively inserted in the insertion hole 600B of the third wide part 614C and the insertion hole 600A of the fourth wide part 614D so that the tip ends of the two connector pins 570 are directed upward and the positions of the tip ends in the Y-direction are matched with each other.

Note that, in the case where ends of a winding are connected to the metal terminal 540B, and the electronic component such as the chip capacitor 550 and the connector pins 570 are mounted and fitted to the metal terminal 540B, the ends of the winding are respectively connected to the vicinities of tip ends of the winding connecting parts 612A, 612B, and the coupling part 616E for connecting the two mounting parts 610A, 610B on which the electronic component such as the chip capacitor 550 is disposed is cut. Further, a coupling part positioned between the two connector pins 570 is cut. For example, in the first fitting form Q1, the coupling part 616B is cut, and in the second fitting form Q2, the coupling part 616C is cut.

Figure 20:
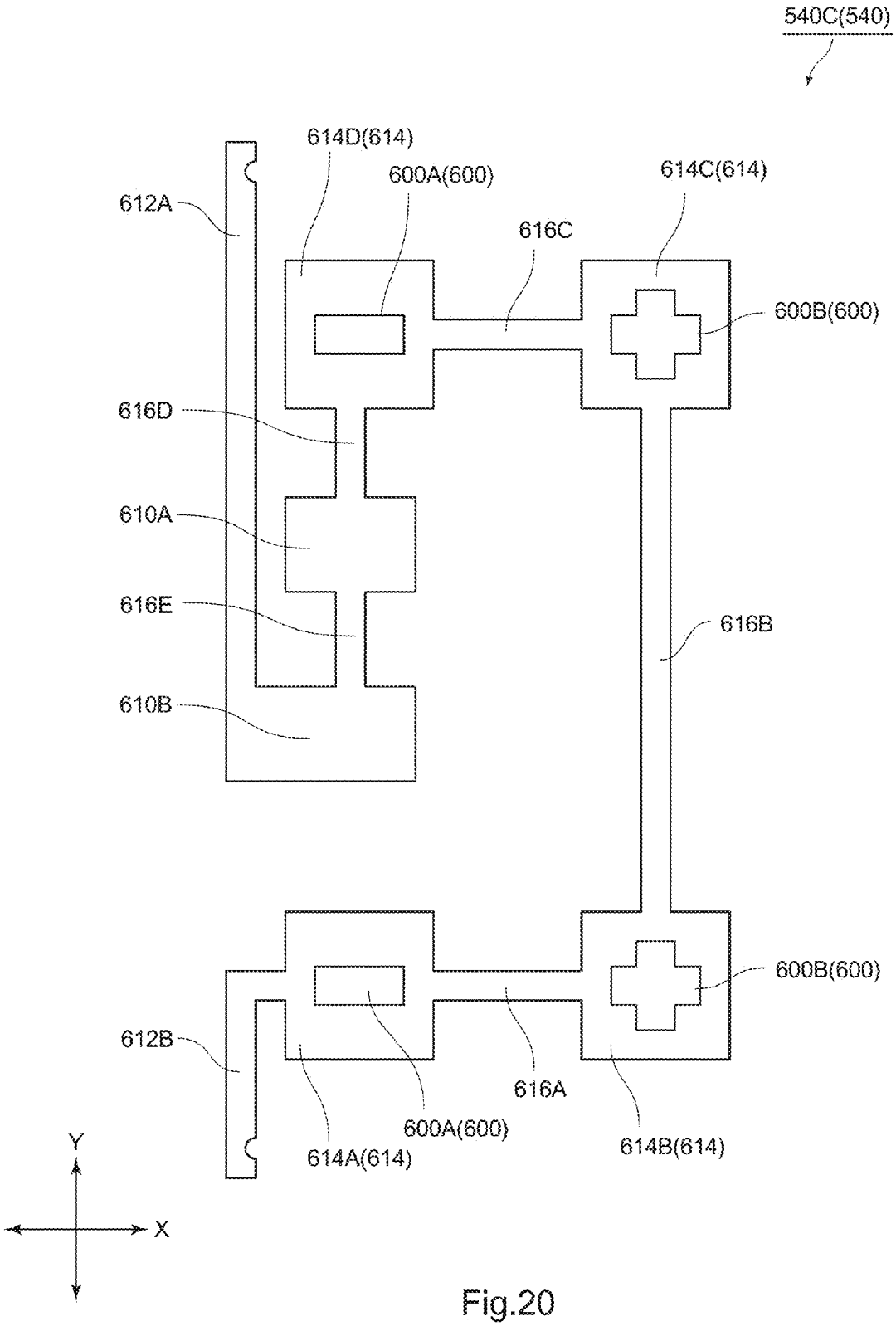
FIG. 20 is a schematic plan view illustrating another example of the metal terminal used for manufacturing the antenna coil component according to the second embodiment.

FIG. 20 is a schematic plan view illustrating another example of the metal terminal used for manufacturing the antenna coil component according to the second embodiment, specifically, illustrating the metal terminal 540C illustrated in FIG. 14 in an enlarged state.

The metal terminal 540C illustrated in FIG. 20 has the same shape and structure as those of the metal terminal 540A illustrated in FIG. 15 except that the arrangement positions and opening shapes of the insertion holes 600 are partially different from those of the metal terminal 540A illustrated in FIG. 15. In this case, in the metal terminal 540C illustrated in FIG. 20, a total of four insertion holes 600 are provided. Specifically, one insertion hole 600A whose opening shape is rectangular is provided in a center portion of the first wide part 614A so that a long side of the insertion hole 600A is parallel to the X-direction, one insertion hole 600B whose opening shape is a cross shape is provided in a center portion of the second wide part 614B, one insertion hole 600B whose opening shape is a cross shape is provided in a center portion of the third wide part 614C, and one insertion hole 600A whose opening shape is rectangular is provided in a center portion of the fourth wide part 614D so that a long side of the insertion hole 600A is parallel to the X-direction. Note that, the insertion holes 600B provided in the second wide part 614B and the third wide part 614C are respectively disposed so that a horizontal axis line and a vertical axis line of the cross shape are respectively matched with the X-direction and the Y-direction. Therefore, in the case where the connector pins 570 are fitted to the metal terminal 540C through the two insertion holes 600B, the connector pins 570 can be inserted in the insertion holes 600B by selecting any of a form in which the tip end of the connector pin 570 is directed to the X-direction side and a form in which the tip end of the connector pin 570 is directed in the Y-direction side.

Figure 21:
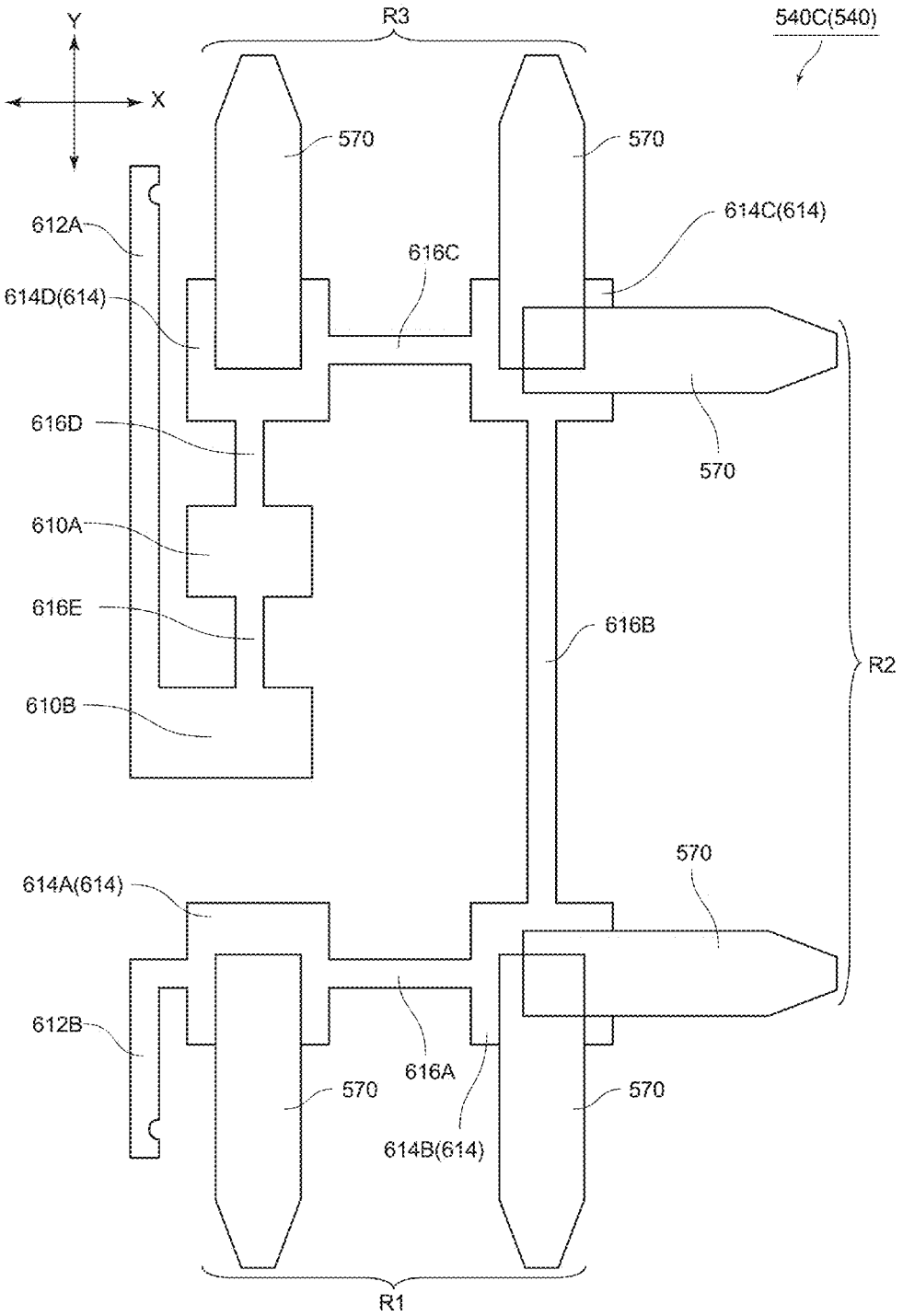
FIG. 21 is a schematic plan view illustrating a fitting form of the connector pin with respect to the metal terminal illustrated in FIG. 20.

Therefore, in the case where two connector pins 570 are fitted to the metal terminal 540C illustrated in FIG. 20, there exist three kinds of fitting forms. FIG. 21 is a schematic view illustrating a state in which two connector pins 570 are fitted to the metal terminal 540C illustrated in FIG. 20. As illustrated in FIG. 21, the fitting form of the connector pins 570 with respect to the metal terminal 540C can be selected from three kinds: a first fitting form R1, a second fitting form R2, and a third fitting form R3 described below.

(1) First Fitting Form R1

Fitting form in which two connector pins 570 are respectively inserted in the insertion hole 600A of the first wide part 614A and the insertion hole 600B of the second wide part 614B so that the tip ends of the two connector pins 570 are directed downward and the positions of the tip ends in the Y-direction are matched with each other.

(2) Second Fitting Form R2

Fitting form in which two connector pins 570 are respectively inserted in the insertion hole 600B of the second wide part 614B and the insertion hole 600B of the third wide part 614C so that the tip ends of the two connector pins 570 are directed rightward and the positions of the tip ends in the X-direction are matched with each other.

(3) Third Fitting Form R3

Fitting form in which two connector pins 570 are respectively inserted in the insertion hole 600B of the third wide part 614C and the insertion hole 600A of the fourth wide part 614D so that the tip ends of the two connector pins 570 are directed upward and the positions of the tip ends in the Y-direction are matched with each other.

Note that, in the case where ends of a winding are connected to the metal terminal 540C, and the electronic component such as the chip capacitor 550 and the connector pins 570 are mounted and fitted to the metal terminal 540C, the ends of the winding are respectively connected to the vicinities of tip ends of the winding connecting parts 612A, 612B, and the coupling part 616E for connecting the two mounting parts 610A, 610B on which the electronic component such as the chip capacitor 550 is disposed is cut. Further, a coupling part positioned between the two connector pins 570 is cut. For example, in the first fitting form R1, the coupling part 616A is cut. In the second fitting form. R2, the coupling part 616B is cut. In the third fitting form R3, the coupling part 616C is cut.

As described above, the metal terminal 540 provided with 3 or more insertion holes 600 is used in the antenna coil component 510 according to the second embodiment, and hence the connector pins 570 can be fitted to the metal terminal 540 by selecting a desired fitting form from 2 or more kinds of fitting forms. Further, in the antenna coil component 510 according to the second embodiment, (1) as in the opening shape of the insertion hole 600A illustrated in FIG. 15, all the insertion holes 600 provided in the metal terminal 540 may have an opening shape enabling the connector pin 570 to be inserted to be fixed to the metal terminal 540 so that the tip end of the connector pin 570 can be aligned only in one kind of direction (note that, the insertion hole 600 having this opening shape is referred to as "first insertion hole") or (2) as in the insertion hole 600B illustrated in FIGS. 18 and 20, at least one insertion hole 600 selected from all the insertion holes 600 provided in the metal terminal 540 may have an opening shape enabling the connector pin 570 to be inserted to be fixed to the metal terminal 540 so that the tip end of the connector pin 570 can be aligned in any direction selected from two kinds (or 2 or more kinds) of different directions (note that, the insertion hole 600 having this opening shape is referred to as "second insertion hole").

Note that, from the viewpoint of realizing more kinds of fitting forms of the connector pin 570 despite a small total number of insertion holes 600 provided in the metal terminal 540, it is particularly preferred that the metal terminal 540 have the first insertion hole and the second insertion hole as in the metal terminal 540B illustrated in FIG. 18 and the metal terminal 540C illustrated in FIG. 20.

Further, it is sufficient that the number of the wide parts 614 capable of being provided with the insertion holes 600 be at least three, but the number of the wide parts 614 is preferably four as illustrated in FIGS. 15, 18, and 20, and 5 or more wide parts 614 can also be provided. Further, although there is no particular limit to an upper limit of the number of the wide parts 614 provided in the metal terminal 540, the number of the wide parts 614 is 10 or less practically. Note that, in the case where 5 or more wide parts 614 are provided, for example, in the metal terminal 540 illustrated in FIGS. 15, 18, and 20, (1) one or two new wide parts 614 can be provided between the second wide part 614B and the third wide part 614C, (2) an interval between the first wide part 614A and the second wide part 614B in the X-direction can be widened, and then one or two new wide parts 614 can be provided between the first wide part 614A and the second wide part 614B, and (3) an interval between the third wide part 614C and the fourth wide part 614D in the X-direction can be widened, and then one or two new wide parts 614 can be provided between the third wide part 614C and the fourth wide part 614D.

In this case, a combination ($\alpha$, $\beta$) of the number $\alpha$ of the first insertion holes and the number $\beta$ of the second insertion holes can be selected from, for example, (2, 1), (3, 1), (4, 1), (2, 2), and (3, 2). Further, it is preferred that the arrangement position of the second insertion hole in the metal terminal 540 be one or both of two corner portions farthest from the bobbin 520 (as a specific example, the second wide part 614B and/or the third wide part 614C as illustrated in FIG. 18 or 20) in a state in which the metal terminal 540 is mounted to the antenna coil component 510.

Note that, the connector pin 570 may be inserted in the insertion hole 600 with the axial direction of the fitting part 574 being bent in advance so as to be substantially orthogonal to the axial direction of the pin body part 572 as illustrated in FIG. 16B. Alternatively, after the connector pin 570 extending in a straight manner is inserted in the insertion hole 600, the tip end of the connector pin 570 may be directed in a predetermined direction by bending an intermediate portion of the straight connector pin 570 at an angle of 90° as illustrated in FIG. 16B. In the case of using the connector pin 570 extending in a straight manner, the connector pin 570 can be easily inserted in the insertion hole 600 by applying sufficient pressing force to the straight connector pin 570 from the axial direction of the insertion hole 600. Note that, in the case of fitting the connector pin 570 to the metal terminal 540, the connector pin 570 may be fixed to the metal terminal 540 merely by inserting the connector pin 570 in the insertion hole 600, but from the viewpoint of ensuring the reliable connection, welding such as soldering may be further performed.

Further, the opening shape of the first insertion hole is not limited to a rectangular shape as in the insertion hole 600A illustrated in FIGS. 15, 18, and 20, and the opening shape of the second insertion hole is not limited to a cross shape or an L-shape formed by combining two rectangular shapes (opening shape of the insertion hole 600A) as in the insertion hole 600B illustrated in FIGS. 18 and 20. Those opening shapes are appropriately selected in accordance with a sectional shape of the fitting part 574 of the connector pin 570 to be used. For example, if the sectional shape of the fitting part 574 of the connector pin 570 is a regular polygon such as a regular triangle, a square, a regular hexagon, and a regular octagon, the opening shape of the insertion hole 600 can also be set to a regular polygon having a shape and a size substantially matched with the regular polygon of the cross-sectional shape of the fitting part 574. Note that, when the opening shape of the insertion hole 600 is a regular polygon, the connector pin 570 can be fitted to the metal terminal so that the tip end of the connector pin 570 is aligned in any direction selected from 2 or more kinds of directions.

Figure 22:
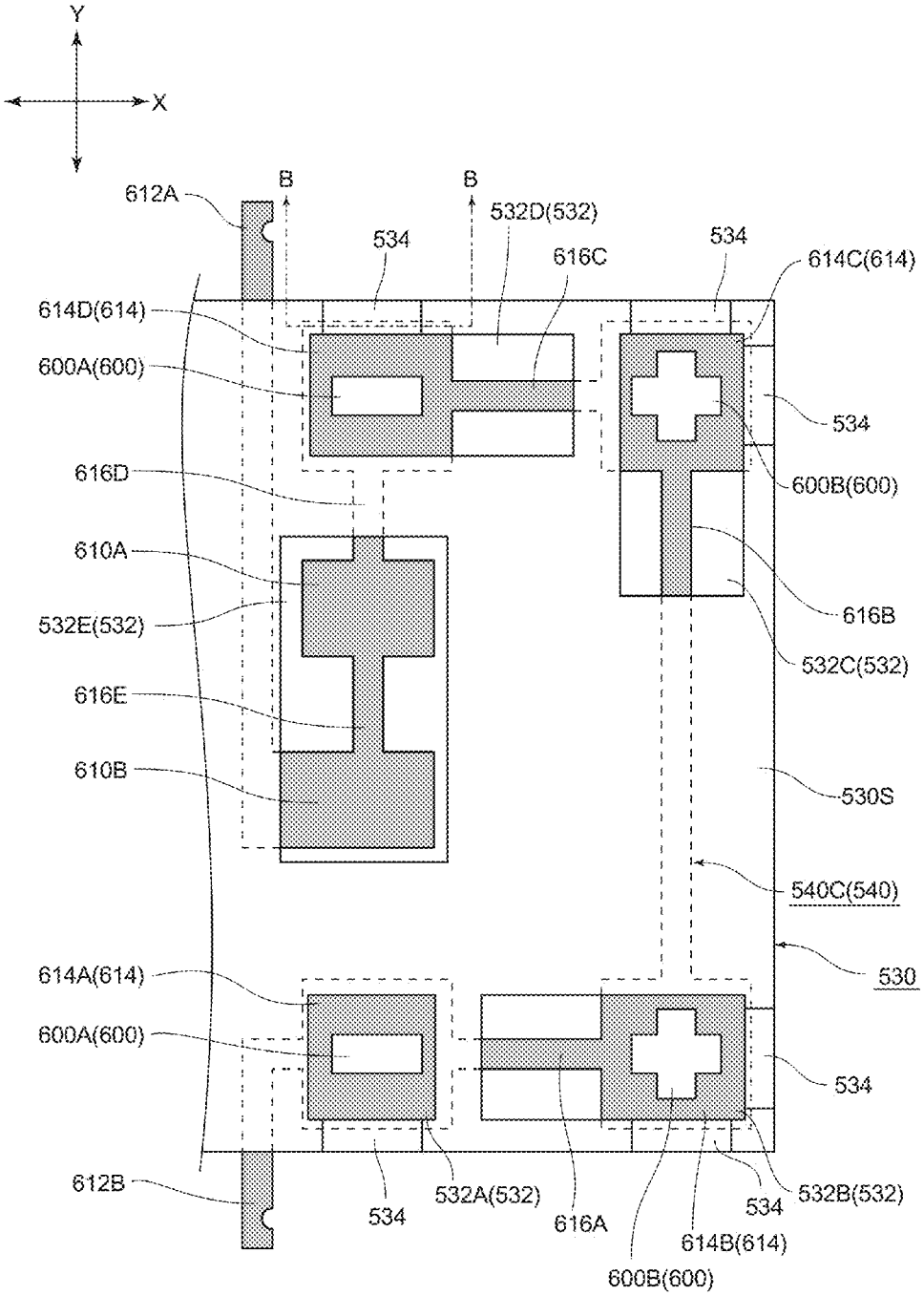
FIG. 22 is an enlarged top view illustrating an example of a base forming the antenna coil component according to the second embodiment.
Figure 23:
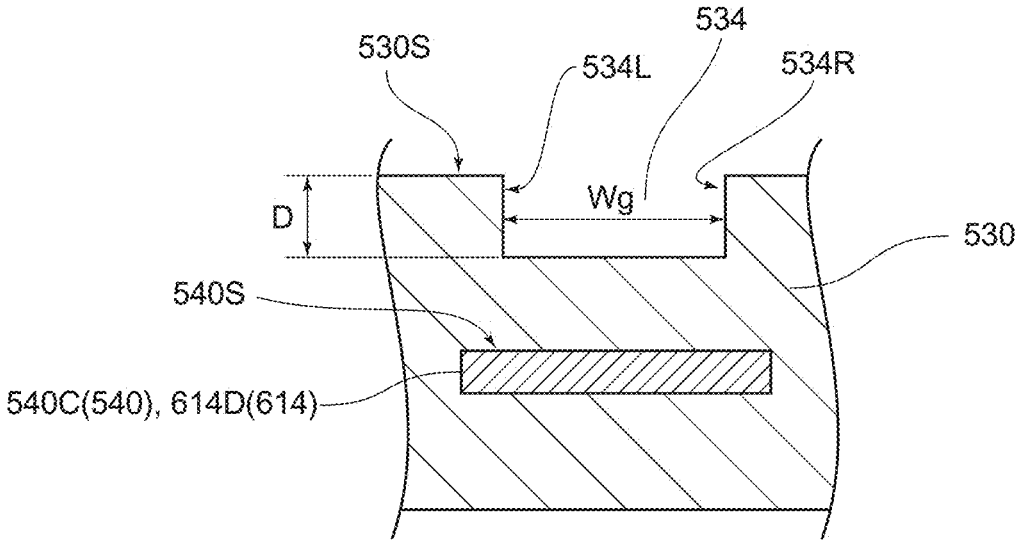
FIG. 23 is a sectional view illustrating an example of a sectional structure taken along the line B-B of FIG. 22.

Next, the base 530 is described in more detail. FIG. 22 is an enlarged top view illustrating an example of the base forming the antenna coil component according to the second embodiment, specifically, illustrating the enlarged structure of the base 530 illustrated in FIG. 14 in more detail. In this case, the example illustrated in FIG. 22 shows a state in which the metal terminal 540C before the connector pins 570 and the electronic component such as the chip capacitor 550 are fitted and mounted thereto is fixed to the base 530. Further, the dotted line in FIG. 22 indicates a contour line of the metal terminal 540C, which is not originally seen because the contour line is covered with the base 530. Further, FIG. 23 is an enlarged sectional view of a portion taken along the line B-B of FIG. 22.

The base 530 is provided with five opening parts 532 passing through the base 530 in a thickness direction of the base 530. That is, (1) a first opening part 532A (532) whose opening shape is substantially square in which vertical and horizontal sides are parallel to the Y-direction and the X-direction is provided in a lower left side portion of the base 530, (2) a second opening part 532B (532) whose opening shape is rectangular in which a long side is parallel to the X-direction is provided in a region from a lower center portion to a lower right side portion of the base 530, (3) a third opening part 532C (532) whose opening shape is rectangular in which a long side is parallel to the Y-direction is provided in an upper right side portion of the base 530, (4) a fourth opening part 532D (532) whose opening shape is rectangular in which a long side is parallel to the X-direction is provided in a region from an upper center portion to an upper left side portion of the base 530, and (5) a fifth opening part 532E (532) whose opening shape is rectangular in which a long side is parallel to the Y-direction is provided in a left center portion of the base 530.

Specifically, the first opening part 532A is provided so as to correspond to the first wide part 614A, the second opening part 532B is provided so as to correspond to the second wide part 614B and a part of the coupling part 616A, the third opening part 532C is provided so as to correspond to the third wide part 614C and a part of the coupling part 616B, the fourth opening part 532D is provided so as to correspond to the fourth wide part 614D and a part of the coupling part 616C, and the fifth opening part 532E is provided so as to correspond to the mounting parts 610A, 610B, a part of the coupling part 616D, and the coupling part 616E.

Therefore, in the five opening parts 532, the main parts of the metal terminal 540C, that is, a portion obtained by excluding a part or a whole of a peripheral portion of the wide part 614, portions of the coupling parts 616A, 616B, 616C, 616D, a whole of the mounting part 610A, a portion obtained by excluding a part in the vicinity on a left end side of the mounting part 610B, and a whole of the coupling part 616E are exposed. Therefore, in order to configure a desired electric circuit such as an LC series resonance circuit, and enable the antenna coil component 510 to be connected to external equipment, a desired position selected from the coupling parts 616A, 616B, 616C, 616D, 616E can be cut, the electronic component such as the chip capacitor 550 can be connected by soldering so as to bridge the mounting parts 610A and 610B, and the connector pin 570 can be fitted to the metal terminal 540C through the opening parts 532.

Note that, at least one dimension selected from the dimension in the X-direction and the dimension in the Y-direction of each of the first opening part 532A, the second opening part 532B, the third opening part 532C, and the fourth opening part 532D, in which the wide part 614 is exposed, is set to be one size smaller than at least one dimension selected from the in the X-direction and the dimension in the Y-direction of the wide part 614 so as to fix the peripheral portion of the wide part 614 so that the peripheral portion is buried in the base 530.

Further, in an upper surface 530S of the base 530, the peripheries of the first opening part 532A, the second opening part 532B, the third opening part 532C, and the fourth opening part 532D, in which the wide parts 614 are exposed, are provided with guide grooves 534 extending from the opening parts 532A, 532B, 532C, 532D sides to the peripheral portion of the upper surface 530S of the base 530. The guide grooves 534 are provided at positions corresponding to the first fitting form R1, the second fitting form R2, and the third fitting form R3 of the metal terminal 540C illustrated in FIG. 21. Therefore, when the connector pin 570 is fitted to the metal terminal 540C through the insertion hole 600, the connector pin 570 can be more stably fixed to the metal terminal 540C by fitting the pin body part 572 in the guide groove 534.

Note that, from the viewpoint of stably fixing the connector pin 570, it is preferred that the width (length Wg in FIG. 23) of the guide groove 534 be slightly narrower than the width (length Wp in FIG. 16) of the connector pin 570. A depth D of the guide groove 534 can be appropriately selected in a range equal to or smaller than the distance from an upper surface 540S of the metal terminal 540 to the upper surface of the base 530. Further, left and right inner wall surfaces 534L, 534R of the guide groove 534 may be provided with, for example, one or more hook portions such as cut-away grooves or protrusions extending in a direction parallel to the upper surface 530S in a direction of the depth D of the guide groove 534. In this case, by appropriately using the hook portion, the connector pin 570 can be fixed in the guide groove 534 with the pin body part 572 hooked at any position in the direction of the depth D of the guide groove 534. Thus, the connector pin 570 can be easily fixed so that the tip end of the connector pin 570 is disposed at a desired position in a direction of the thickness of the base 530.

Further, from the viewpoint of further increasing the connection strength between the connector pin 570 and the metal terminal 540C and enhancing a waterproofing property, the base 530 portion may be covered with a resin material after the connector pin 570 is fitted to the metal terminal 540C.

Figure 24:
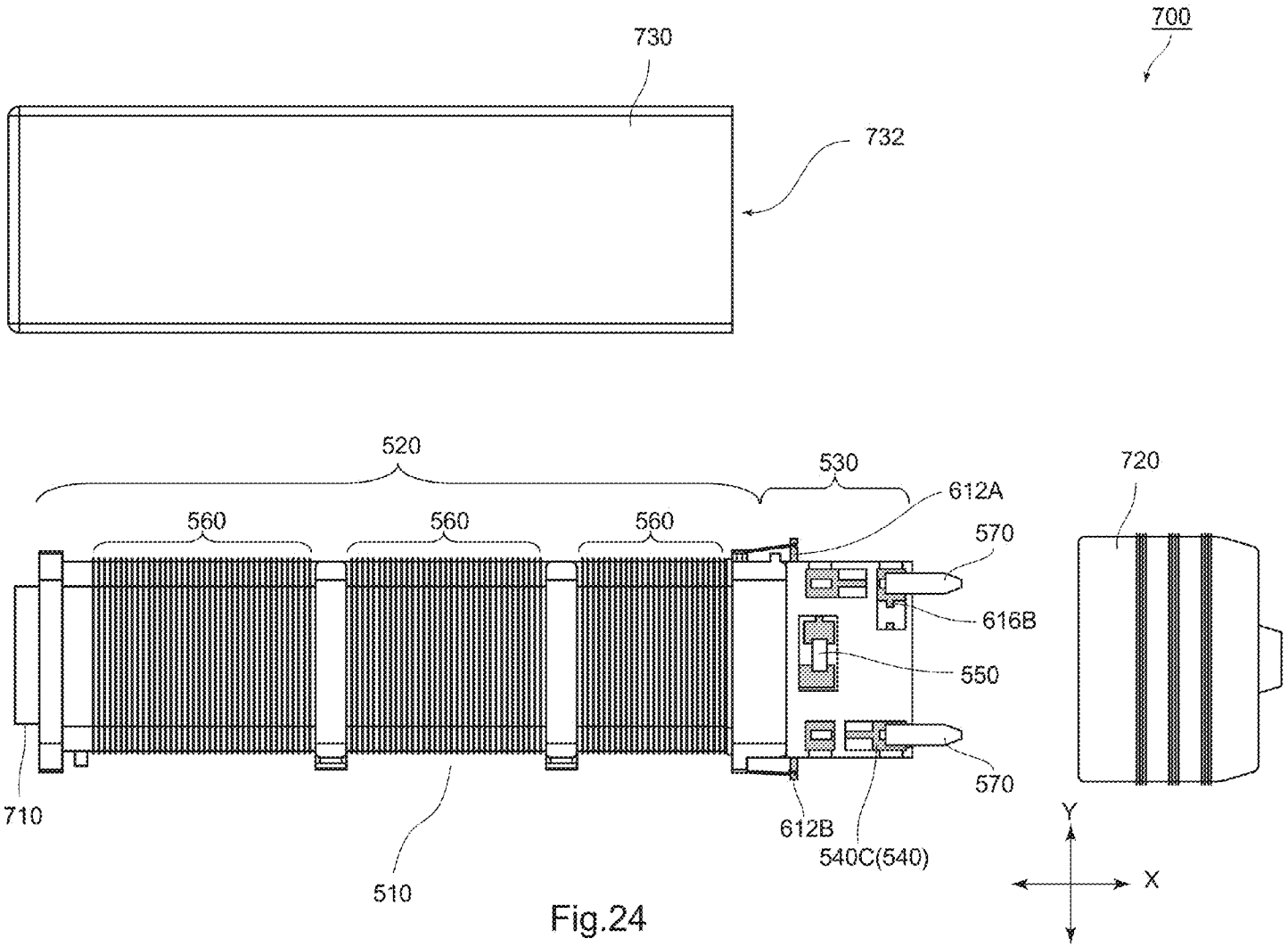
FIG. 24 is an exploded plan view illustrating an example of an antenna unit according to the second embodiment.

Next, an antenna unit using the antenna coil component 510 according to the second embodiment is described. FIG. 24 is an exploded plan view illustrating an example of the antenna unit according to the second embodiment. An antenna unit 700 illustrated in FIG. 24 includes the antenna coil component 510 with the chip capacitor 550 illustrated in FIG. 14 mounted thereon, a bar-shaped magnetic core 710 disposed in the bobbin 520 of the antenna coil component 510, a tubular grommet 720, and a bottomed tubular case 730 for accommodating the antenna coil component 510 accommodating the magnetic core 710 and the grommet 720. Note that, unlike FIG. 14, FIG. 24 illustrates a state in which a winding 560 is wound around the outer circumferential surface 522 of the bobbin 520 in the antenna coil component 510 illustrated in FIG. 24. The connector pins 570 are further fitted to the metal terminal 540C in the second fitting form R2 of FIG. 21, the two winding connecting parts 612A, 612B are respectively connected to the winding 560 by binding one end of the winding 560, and the coupling part 616B is cut in a portion exposed in the opening part 532C. Further, in FIG. 24, the coupling part 616E is completely removed by cutting.

Note that, the metal terminal 540C which has been one continuous member in the manufacturing process is formed of three portions (metal terminals) physically separated independently by being cut in the coupling parts 616B and 616E in a state of the antenna coil component 510 illustrated in FIG. 24. That is, the metal terminal 540C in the antenna coil component 510 includes (1) a metal terminal formed of the winding connecting part 612B, the first wide part 614A, the coupling part 616A, the second wide part 614B, and a part of the coupling part 616B, (2) a metal terminal formed of a part of the coupling part 616B, the third wide part 614C, the coupling part 616C, the fourth wide part 614D, the coupling part 616D, and the mounting part 610A, and (3) a metal terminal formed of the mounting part 610B and the winding connecting part 612A.

Then, the antenna coil component 510 is accommodated in the case 730 together with the grommet 720 so that the base 530 side is directed to an opening part 732 side of the case 730 in a state in which the grommet 720 is mounted so as to cover the base 530 portion. Further, the opening part 732 of the case 730 for accommodating the antenna coil component 510 and the like is sealed with a sealing member such as a resin material.

A method of manufacturing the antenna coil component 510 according to the second embodiment is not particularly limited, and the antenna coil component 510 can be manufactured through use of any known manufacturing method appropriately. For example, the metal terminal 540C illustrated in FIG. 20 or a metal member formed of an outer frame and the metal terminal 540C connected to the outer frame is disposed in a mold, and thereafter, a resin is injection-molded in the mold. Thus, the base 530 formed of a resin material is formed, and at the same time, apart of the metal terminal 540C is buried in and fixed to the base 530 as illustrated in FIGS. 22 and 23. Note that, in the case of using the metal member for performing the injection molding step, an unnecessary portion (outer frame) other than the metal terminal 540C is removed by cutting after the injection molding step is performed. Further, the base 530 and the bobbin 520 may be joined to each other after the base 530 and the bobbin 520 are manufactured separately. However, in general, the bobbin 520 as well as the base 530 is integrally formed during injection molding. This enables the antenna coil component 510 having a minimal configuration to be obtained.

Further, after the injection molding step is completed, the winding 560 is wound around the bobbin 520, and the ends of the winding 560 are connected to the winding connecting parts 612A, 612B. In addition, for example, after the coupling part 616E is cut, the electronic component such as the chip capacitor 550 may be soldered so as to bridge the mounting parts 610A and 610B, and further, before or after the cutting of the coupling part 616B, the connector pins may be fitted to the metal terminal 540C in the second fitting form R2 illustrated in FIG. 21.

Note that, when the metal terminal 540 having 3 or more insertion holes 600 enabling a connector pin to be fitted by selecting a desired fitting form from 2 or more kinds of fitting forms is used as in the metal terminals 540A, 540B, 540C, the structure of the antenna coil component 510 according to the second embodiment and the method of manufacturing the antenna coil component 510 according to the second embodiment are not particularly limited. For example, as the structure of the antenna coil component 510 according to the second embodiment, the structure of the antenna coil component according to the first embodiment and/or the structure of the antenna coil component according to the third embodiment described later may be further adopted, and the structures of other known antenna coil components can be further adopted. Further, as the method of manufacturing the antenna coil component 510 according to the second embodiment, at least one manufacturing method selected from the method of manufacturing an antenna coil component according to the first embodiment and methods of manufacturing antenna coil components according to the third to fifth embodiments described later may be used, other known methods of manufacturing antenna coil components can also be used, and those manufacturing methods may be combined appropriately.

Third Embodiment

Next, the third embodiment is described. First, when an antenna coil component is manufactured, in general, an electronic component such as a chip capacitor can be soldered to a mounting part of a metal terminal fixed to a base formed of a resin material by a spot reflow method. In the spot reflow method, soldering can be performed by local heating, and hence manufacturing efficiency of the spot reflow method is higher than that of soldering using a reflow furnace. As specific examples of the spot reflow method, a hot blast nozzle system of performing soldering by jetting hot blast from a nozzle and an optical beam system of performing soldering by irradiating an object with focused light from a light source such as a halogen lamp or irradiating an object with laser light are known. However, when heating is weak during soldering by the spot reflow method, it takes a long period of time to melt solder, resulting in a decrease in productivity. On the other hand, when heating is increased so as to accelerate the melting of solder, heat is transmitted from the mounting part of the metal terminal to the base, and in addition, the electronic component is also strongly heated. Therefore, an insulating material such as a resin forming the base and/or the electronic component is likely to be thermally damaged.

The third embodiment has been made in view of the above-mentioned circumstance, and it is an object of the third embodiment to provide a method of manufacturing an antenna coil component capable of suppressing thermal damages to members on the periphery of a solder connecting part without increasing a period of time required for soldering in the case of soldering an electronic component to a metal terminal by a spot reflow method during manufacturing of an antenna coil component, and an antenna coil component and an antenna unit using the manufacturing method.

In order to achieve the above-mentioned object, a method of manufacturing an antenna coil component according to the third embodiment includes at least: an injection molding step of molding at least a base formed of a resin material and simultaneously burying a fixing part in the base by disposing a metal member in a mold and injecting the resin material into the mold, the metal member including at least the fixing part, a plate-shaped mounting part provided at a position spaced from the fixing part, and a neck part for connecting the fixing part and the mounting part to each other; and a soldering step of soldering an electronic component to the mounting part, in which (I) as the metal member, a metal member processed in advance is used so that the thickness of the mounting part is smaller than that of the neck part, or (II) a mounting part pressing step of pressing the mounting part is performed so that the thickness of the mounting part is smaller than that of the neck part after the injection molding step, and the soldering step is performed after the mounting part pressing step.

Further, the antenna coil component according to the third embodiment includes at least: a tubular bobbin formed of an insulating material; a winding wound around an outer circumferential side of the bobbin; a base provided at least on one end side of the bobbin and formed of a resin material; and a metal terminal having conductivity and including a fixing part fixed into the base, a mounting part provided at a position spaced from the base, and a neck part for connecting the fixing part and the mounting part to each other, in which the thickness of the mounting part is smaller than that of the neck part.

Further, the antenna unit according to the third embodiment includes at least: the antenna coil component according to the third embodiment; a magnetic core disposed in the bobbin; an electronic component soldered to the mounting part of the metal terminal; and a case for accommodating the antenna coil component.

In the case of manufacturing the antenna coil component according to the third embodiment, first, the injection molding step is performed through use of a metal member. As the metal member, for example, a metal member illustrated in FIG. 25 can be used.

Figure 25:
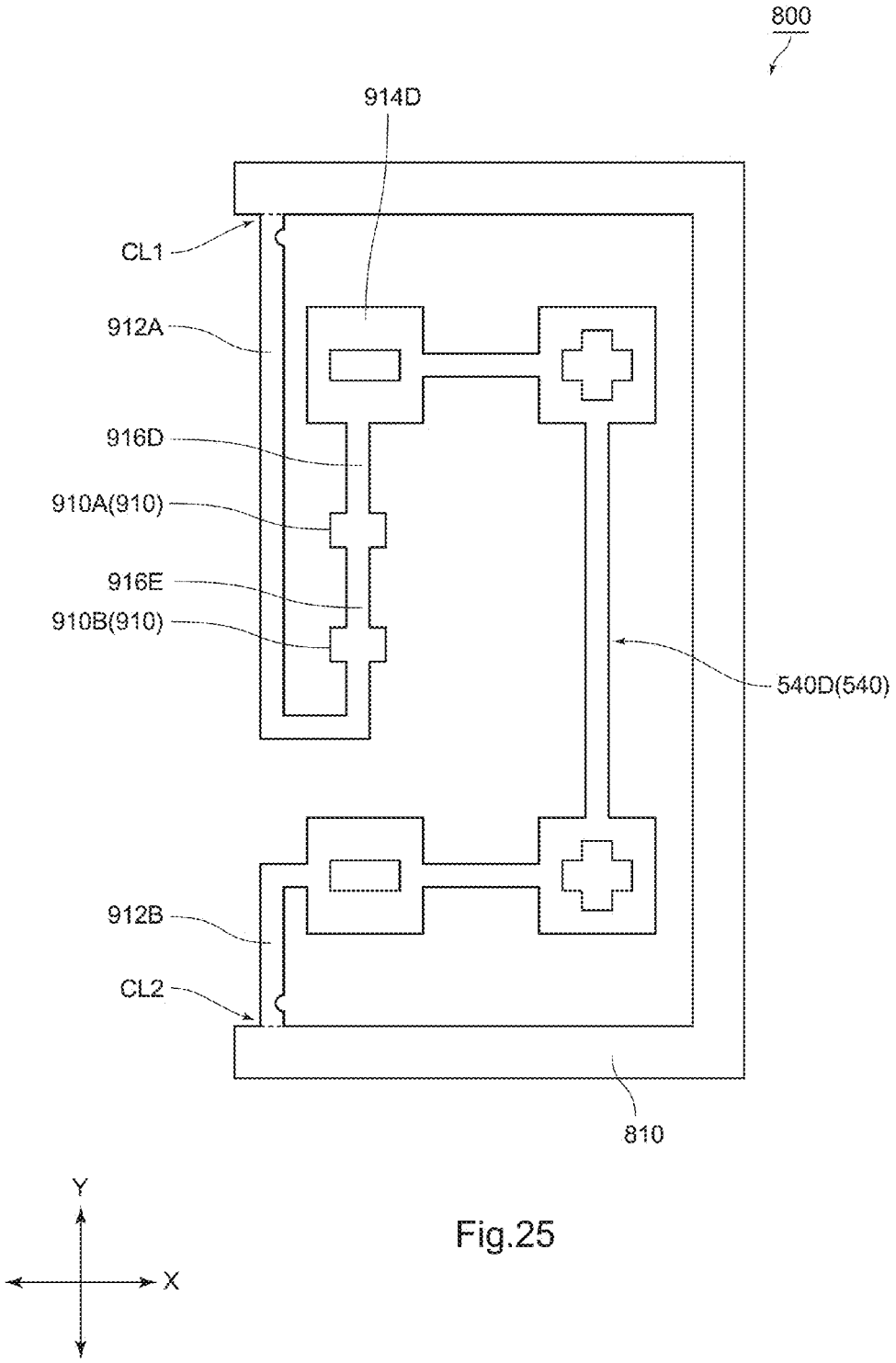
FIG. 25 is a schematic plan view illustrating an example of a metal member used for manufacturing an antenna coil component according to a third embodiment of the present invention.

A metal member 800 illustrated in FIG. 25 is a plate-shaped member including an outer frame 810 having a U-shape brought down to the left side and a metal terminal 540D (540) connected to the vicinities of both ends of the outer frame 810 so as to be positioned inside the outer frame 810. Note that, the plate thickness of the metal terminal 540D connected to the outer frame 810 is identical in any portion. In this case, the metal terminal 540D is a member having the same structure as that of the metal terminal 540C illustrated in FIG. 20 except that the structures of a mounting part 910A (910), a mounting part 910B (910), and the vicinity of a connecting part between the mounting part 910B and a winding connecting part 912A are different. In the metal terminal 540D, the tip end of the winding connecting part 912A and the tip end of a winding connecting part 912B are each connected to the outer frame 810. In the course of manufacturing an antenna coil component, the metal terminal 540D and the outer frame 810 are disconnected from each other with a boundary line CL1 between the winding connecting part 912A and the outer frame 810 and a boundary line CL2 between the winding connecting part 912B and the outer frame 810 being cutting lines. Note that, the mounting part 910A, the mounting part 910B, the winding connecting part 912A, the winding connecting part 912B, a fourth wide part 914D, a coupling part 916D, and a coupling part 916E illustrated in FIG. 25 are members respectively corresponding to the mounting part 610A, the mounting part 610B, the winding connecting part 612A, the winding connecting part 612B, the fourth wide part 614D, the coupling part 616D, and the coupling part 616E illustrated in FIG. 20.

In this case, the metal terminal 540D illustrated in FIG. 25 is different from the metal terminal 540C illustrated in FIG. 20 in that the mounting parts 910A, 910B are set to be one size smaller, and the winding connecting part 912A is connected to a lower side of the mounting part 910B.

In the injection molding step, a base formed of a resin material is at least molded and simultaneously a part (fixing part) of the metal terminal 540D is buried in the base by disposing the metal member 800 in a mold and thereafter injecting a resin material into the mold. When injection molding is performed, for example, the base 530 as illustrated in FIG. 22 can be formed.

Figure 26:
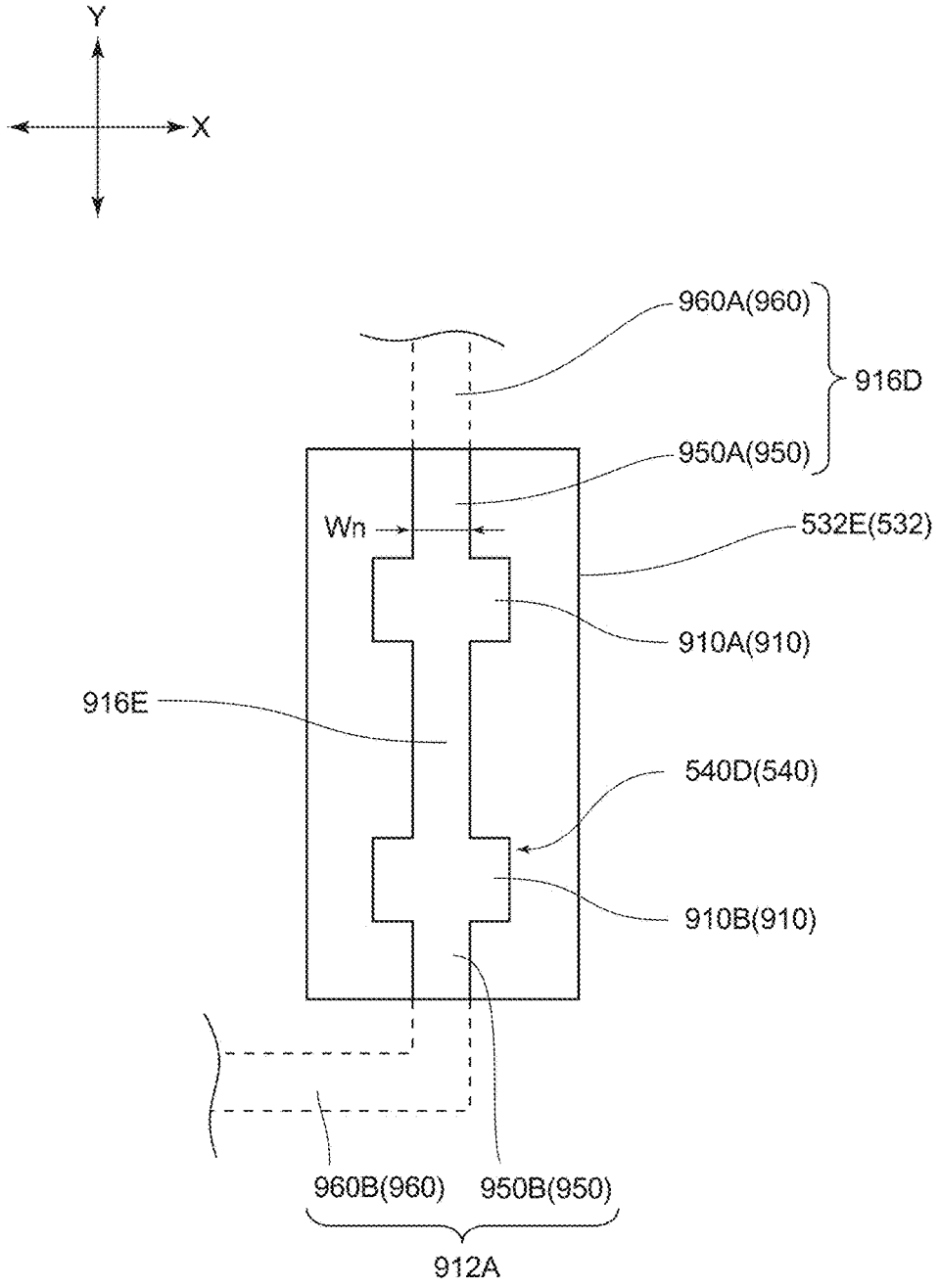
FIG. 26 is an enlarged top view illustrating an arrangement relationship between a metal terminal and a base in the vicinity of a mounting part of the metal terminal in the case where the metal terminal illustrated in FIG. 25 is fixed to the base illustrated in FIG. 22 by injection molding.

FIG. 26 is a top view illustrating an arrangement relationship between the metal terminal 540D and the base 530 in the vicinity of the mounting part 910 of the metal terminal 540D in the case where the metal terminal 540D illustrated in FIG. 25 is fixed to the base 530 illustrated in FIG. 22 by injection molding, specifically, illustrating an enlarged arrangement position of the metal terminal 540D in the vicinity of the opening part 532E. As illustrated in FIG. 26, in the opening part 532E, the mounting parts 910A, 910B, the coupling part 916E, a part (neck part 950A (950)) of the coupling part 916D, and a part (neck part 950B (950)) of the winding connecting part 912A are exposed. Further, the coupling part 916D other than the neck part 950A serves as a portion (fixing part 960A (960)) buried in and fixed to the resin material forming the base 530. Further, in the winding connecting part 912A in the vicinity of the opening part 532E, the winding connecting part 912A other than the neck part 950B also serves as a portion (fixing part 960B (960)) buried in and fixed to the resin material forming the base 530.

That is, the metal terminal 540D includes a portion serving as the fixing part 960, a portion serving as the plate-shaped mounting part 910 provided at a position spaced from the fixing part 960, and a portion serving as the neck part 950 for connecting the fixing part 960 and the mounting part 910 to each other when the antenna coil component 510 is manufactured.

In this case, in related art, after the coupling part 916E is cut, a soldering step is performed, in which an electronic component such as the chip capacitor 550 is soldered to the mounting parts 910A, 910B by a spot reflow method under the state in which the electronic component is disposed so as to bridge the mounting parts 910A and 910B. However, in the method of manufacturing an antenna coil component according to the third embodiment, the mounting part pressing step of pressing the mounting part 910 so that the thickness of the mounting part 910 is smaller than that of the neck part 950 is performed after the injection molding step, and the soldering step is performed after the mounting part pressing step. Note that, the pressing method is not particularly limited. The pressing can be performed, for example, by applying a pressure to the mounting parts 910A, 910B by punching from upper and lower surface sides of the mounting parts 910A, 910B. Thus, the mounting parts 910A, 910B are extended thinly in planar directions thereof. In this case, the peripheral portion of the mounting part 910A and the peripheral portion of the mounting part 910B are prevented from coming into contact with each other.

Further, it is preferred that the peripheral portions of the mounting parts 910A, 910B be pressed so as not to come into contact with an inner wall surface of the opening part 532E, either. In addition, it is preferred that the mounting parts 910A, 910B be pressed so that the shape and size thereof after pressing become substantially the same. Further, when the mounting part pressing step is performed, for example, the mounting part pressing step may be performed after cutting the coupling part 916E at both ends thereof and removing the coupling part 916E in advance, or the coupling part 916E may be removed by cutting after the mounting part pressing step is performed.

Figure 27:
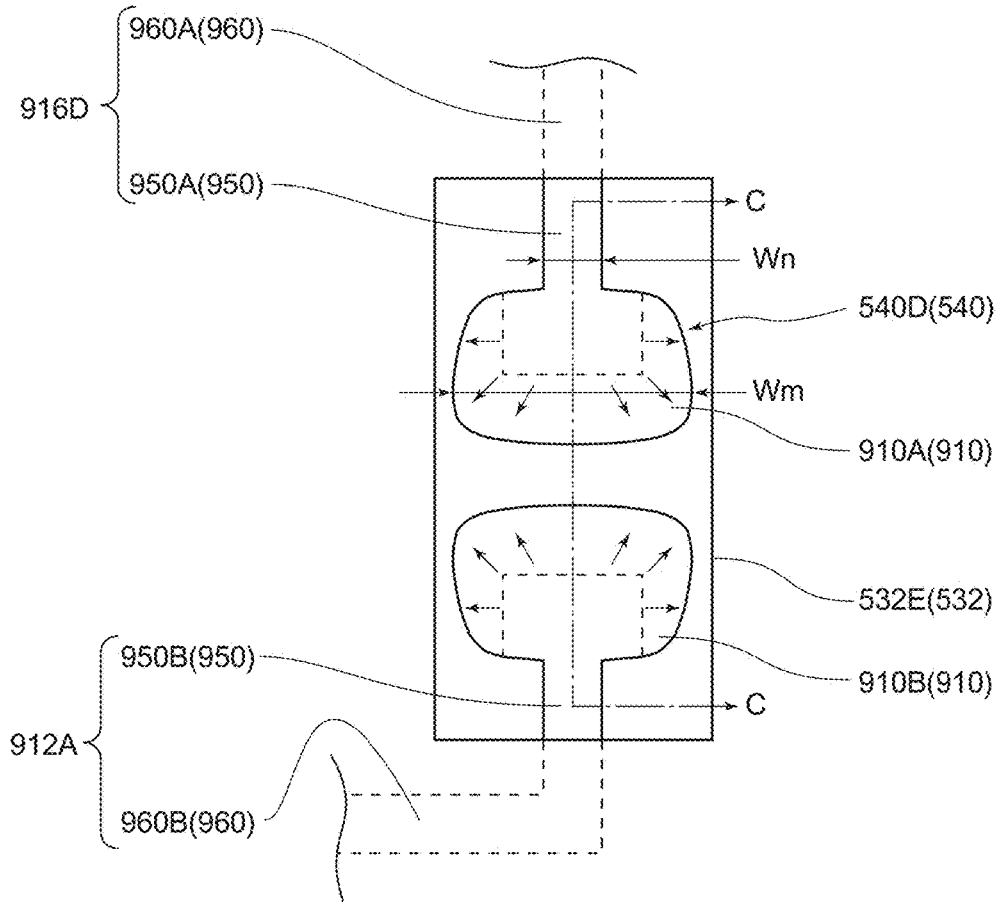
FIG. 27 is an enlarged top view illustrating an example of the vicinity of an opening part after amounting part pressing step is completed with respect to the metal terminal illustrated in FIG. 26.
Figure 27:
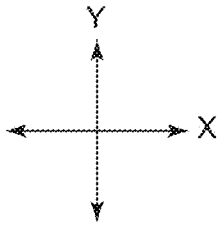
Figure 28:
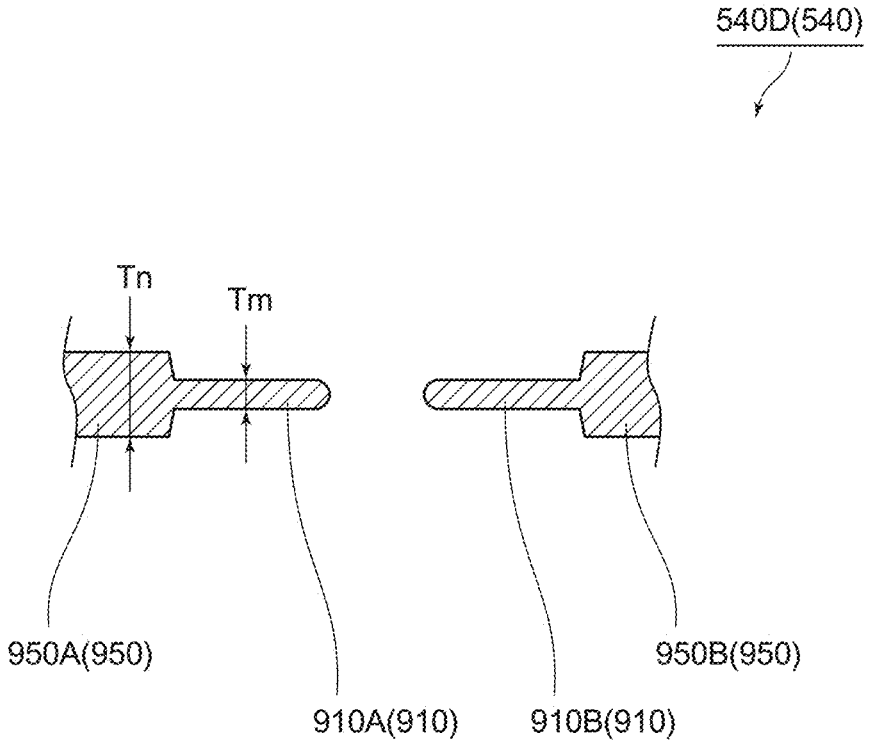
FIG. 28 is a sectional view illustrating an example of a sectional structure of a metal terminal taken along the line C-C of FIG. 27.

FIG. 27 is an enlarged top view illustrating an example of the vicinity of the opening part 532E after the mounting part pressing step is completed with respect to the metal terminal 540D illustrated in FIG. 26, specifically, illustrating a state after the mounting part pressing step is performed with respect to the mounting parts 910A, 910B illustrated in FIG. 26 and the coupling part 916E is removed by cutting. Further, FIG. 28 is a sectional view illustrating an example of a sectional structure of the metal terminal 540D taken along the line C-C of FIG. 27. As illustrated in FIGS. 27 and 28, each planar shape of the mounting parts 910A, 910B spreads more than the vertical and horizontal sizes before pressing (shape indicated by the dotted line of FIG. 27), and each thickness of the mounting parts 910A, 910B is smaller than that of the neck parts 950A, 950B.

Thus, in the case of performing the soldering step through use of the spot reflow method, the mounting part 910 after pressing has a shape which is thinner and spreads more compared to the mounting part 910 before pressing. Therefore, the heating efficiency of the mounting part 910 per unit area is enhanced significantly. Therefore, compared to a related-art method of manufacturing an antenna coil component in which the mounting part 910 is not pressed, in the method of manufacturing an antenna coil component according to the third embodiment, the electronic component such as the chip capacitor 550 can be soldered to the mounting part 910 even without heating the vicinity of the mounting part 910 strongly over a long period of time. Thus, thermal damages to the members positioned on the periphery of the solder connecting part between the mounting part 910 and the electronic component can be suppressed more easily than the related art. For example, the degradation and deformation of a resin material forming the base 530 in the vicinity of the boundary between the neck part 950 and the fixing part 960 can be suppressed, and the damages and deterioration in performance of the electronic component caused by thermal shock can be suppressed. In addition, as a resin material forming the base 530, it also becomes very easy to adopt a heat-labile resin as a generally inexpensive resin material although it has poor heat resistance.

Note that, from the viewpoint of ensuring the above-mentioned effect and ensuring the strength of the mounting part 910 in a balanced manner, it is preferred that a thickness Tm of the mounting part 910 in a state after the antenna coil component 510 is completed be in a range of about ⅓ to about ⅔ of a thickness Tn of the neck part 950. For example, when the thickness Tn is 0.64 mm, the thickness Tm can be set to 0.21 mm to 0.43 mm.

Further, in the case of considering the mounting stability of the electronic component such as the chip capacitor 550, in particular, the area of a solder fillet between the electronic component and the mounting part 910, it is preferred that the ratio (Wm/Wn) of a width Wm of the mounting part 910 with respect to a width Wn of the neck part 950 be in a range of 1.5 to 4.5 in a state after the antenna coil component 510 is completed.

The width Wm of the mounting part 910 refers to the maximum length in a direction substantially orthogonal to a direction from the fixing part 960 to the mounting part 910 and substantially parallel to front and rear surfaces of the mounting part 910, in other words, the maximum length in a direction parallel to the width direction of the neck part 950.

Note that, in the method of manufacturing an antenna coil component according to the third embodiment, a metal member processed in advance so that the thickness of the mounting part 910 becomes smaller than that of the neck part 950 may be used as the metal member 800 used for manufacturing the antenna coil component 510, instead of performing the above-mentioned mounting part pressing step. Further, as the soldering step, a soldering method of a known local heating system such as the spot reflow method can be used appropriately.

Note that, the antenna coil component 510 according to the third embodiment can be manufactured in the same way as in manufacturing of the antenna coil component 510 according to the second embodiment except for the above-mentioned points. Further, the method of manufacturing an antenna coil component according to the third embodiment may be used together with at least one manufacturing method selected from the method of manufacturing an antenna coil component according to the first embodiment, a method of manufacturing an antenna coil component according to the fourth embodiment described later, a method of manufacturing an antenna coil component according to the fifth embodiment described later, and other known methods of manufacturing an antenna coil component.

The structure of the antenna coil component 510 according to the third embodiment may be the same as that of the antenna coil component 10 according to the first embodiment and/or that of the antenna coil component 510 according to the second embodiment as long as the thickness of the mounting part 910 is smaller than that of the neck part 950 in a state after the antenna coil component is completed or may be different from the antenna coil component 10 according to the first embodiment and the antenna coil component 510 according to the second embodiment. Further, the structure of a known antenna coil component can also be adopted appropriately.

Specifically, it is sufficient that the antenna coil component 510 according to the third embodiment include at least: a tubular bobbin 520 formed of an insulating material; a winding 560 wound around an outer circumferential side of the bobbin 520; a base 530 provided at least on one end side of the bobbin 520 and formed of a resin material; and the metal terminal 540D having conductivity and including the fixing part 960 fixed into the base 530, the mounting part 910 provided at a position spaced from the base 530, and the neck part 950 for connecting the fixing part 960 and the mounting part 910 to each other. In this case, a thickness Tm of the mounting part 910 is smaller than a thickness Tn of the neck part 950. Further, an antenna unit 700 according to the third embodiment includes at least: the antenna coil component 510 according to the third embodiment; a magnetic core 710 disposed in the bobbin 520; an electronic component (for example, a chip capacitor 550) soldered to the mounting part 910 of the metal terminal 540D; and a case 730 for accommodating the antenna coil component.

Fourth Embodiment

Next, the fourth embodiment is described. First, when an antenna coil component is manufactured, an electronic component such as a chip capacitor is soldered to a mounting part of a metal terminal. For soldering, in general, a reflow furnace for heating an entire antenna coil component is used. Therefore, as a resin material forming the antenna coil component, it is necessary to use a heat-resistant resin which is unlikely to be changed in size or degraded even by heating in the reflow furnace. However, the heat-resistant resin is generally more expensive than a heat-labile resin, and as a result, a manufacturing cost of an antenna coil component becomes high.

It is an object of the fourth embodiment to provide a method of manufacturing an antenna coil component using a process of soldering an electronic component to a mounting part of a metal terminal without using a reflow furnace.

In order to achieve the above-mentioned object, a method of manufacturing an antenna coil component according to the fourth embodiment includes at least: an injection molding step of molding at least a base formed of a resin material and simultaneously burying a fixing part in the base by disposing a metal member in a mold and injecting the resin material into the mold, the metal member including at least the fixing part and a plate-shaped mounting part connected to the fixing part directly or connected thereto indirectly through intermediation of a neck part; and a soldering step of soldering an electronic component to the mounting part, in which the soldering step includes any manufacturing process selected from a first manufacturing process and a second manufacturing process described below.

<First Manufacturing Process>

A manufacturing process involves the following in the stated order:

(1) a mounting part heating step of heating one surface of a mounting part;

(2) a solder supply step of supplying solder to the other surface of the mounting part; and (3) an electronic component arrangement step of arranging an electronic component on the other surface to which the solder has been supplied.

<Second Manufacturing Process>

A manufacturing process involves the following in the stated order:

(1) a solder supply step of supplying solder to one surface of the mounting part;

(2) an electronic component arrangement step of arranging an electronic component on one surface to which the solder has been supplied; and (3) a mounting part heating step of heating the other surface of the mounting part.

Figure 29:
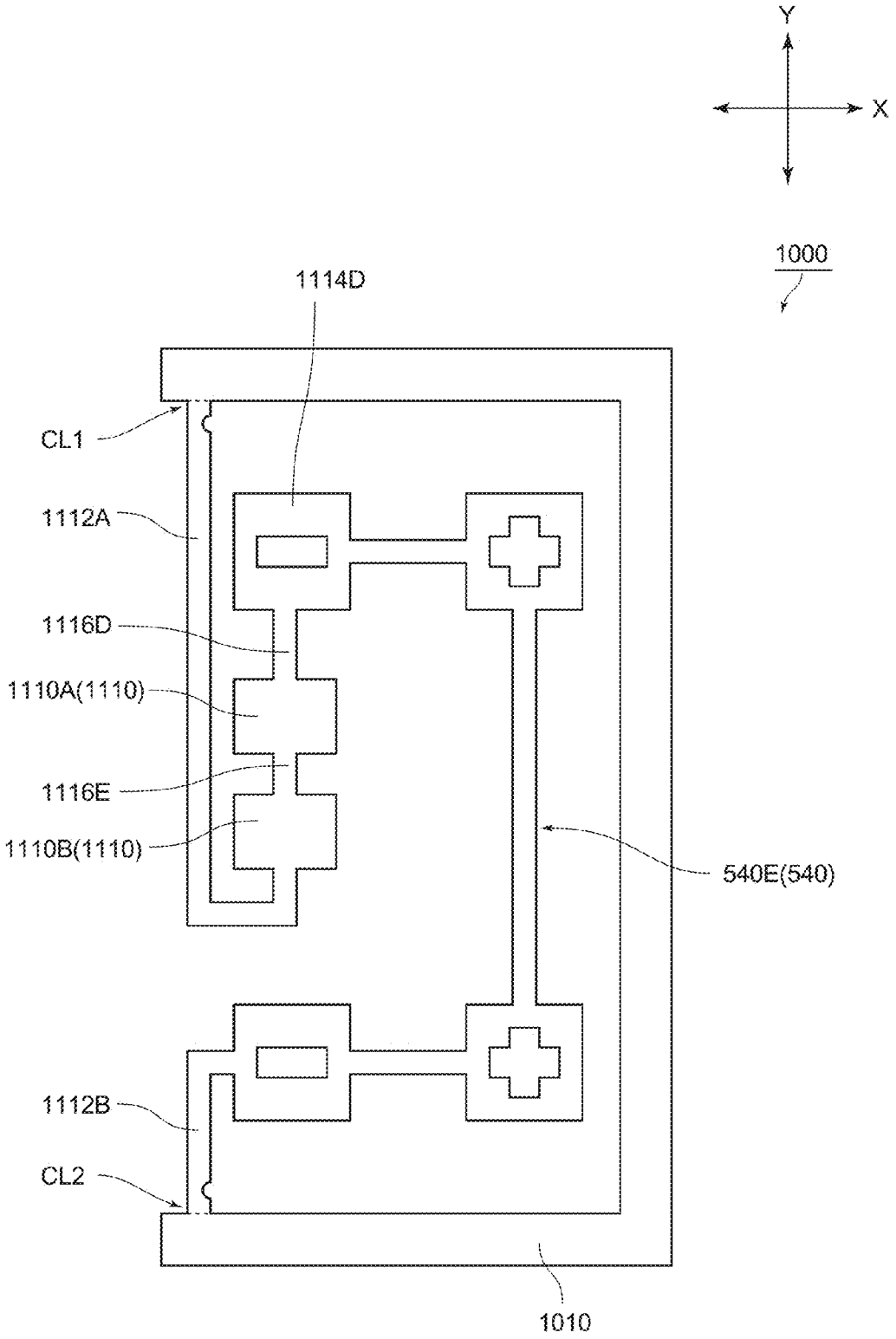
FIG. 29 is a schematic plan view illustrating an example of a metal member used in a method of manufacturing an antenna coil component according to a fourth embodiment of the present invention.

First, in the method of manufacturing an antenna coil component according to the fourth embodiment, for example, each step can be performed through use of a metal member 1000 illustrated in FIG. 29. In this case, a metal member 1000 illustrated in FIG. 29 is a plate-shaped member including an outer frame 1010 having a U-shape brought down to the left side and a metal terminal 540E (540) connected to the vicinities of both ends of the outer frame 1010 so as to be positioned inside the outer frame 1010. In this case, the metal terminal 540E is a member having the same structure as that of the metal terminal 540C illustrated in FIG. 20 except that the structure of the vicinity of a connecting part between a mounting part 1110B (1110) and a winding connecting part 1112A is different. Further, regarding the shape of the outer frame 1010, the connection form between the outer frame 1010 and the metal terminal 540E, and the boundary line between the outer frame 1010 and the metal terminal 540E, the metal member 1000 illustrated in FIG. 29 has the same structure as that of the metal member 800 illustrated in FIG. 25. Note that, the mounting part 1110A (1110), the mounting part 1110B, the winding connecting part 1112A, the winding connecting part 1112B, a fourth wide part 1114D, a coupling part 1116D, and a coupling part 1116E illustrated in FIG. 29 are members each corresponding to the mounting part 610A, the mounting part 610B, the winding connecting part 612A, the winding connecting part 612B, the fourth wide part 614D, the coupling part 616D, and the coupling part 616E illustrated in FIG. 20.

In this case, the metal terminal 540E illustrated in FIG. 29 is different from the metal terminal 540C illustrated in FIG. 20 only in that the winding connecting part 1112A is connected to a lower side of the mounting part 1110B.

In the injection molding step, a base formed of a resin material is at least molded and simultaneously a part (fixing part) of the metal terminal 540E is buried in the base by disposing the metal member 1000 in a mold and thereafter injecting a resin material into the mold. When injection molding is performed, for example, the base 530 as illustrated in FIG. 22 can be formed.

Figure 30:
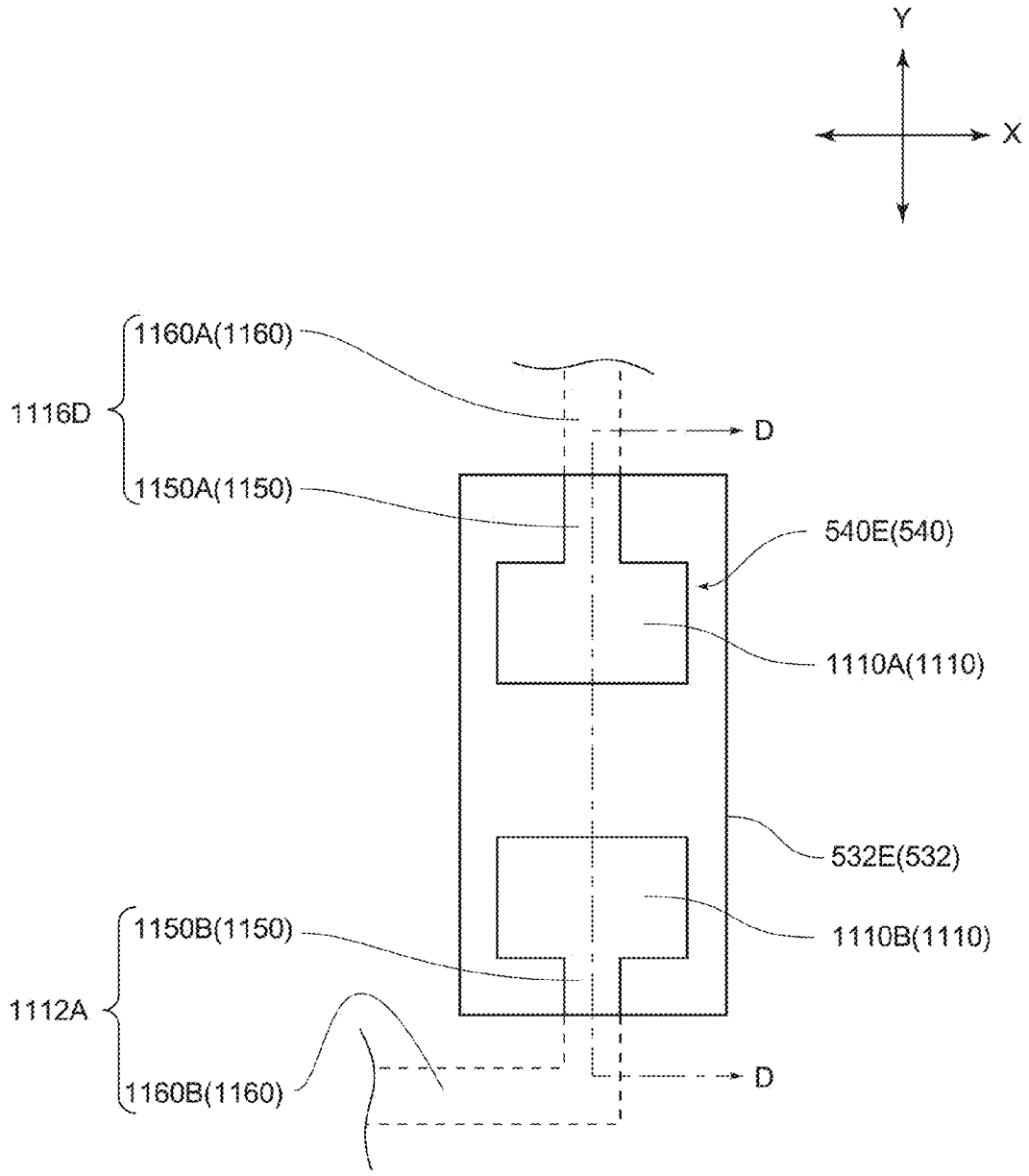
FIG. 30 is an enlarged top view illustrating an arrangement relationship between a metal terminal and a base in the vicinity of a mounting part of the metal terminal in the case where the metal terminal illustrated in FIG. 29 is fixed to the base illustrated in FIG. 22 by injection molding.
Figure 31:
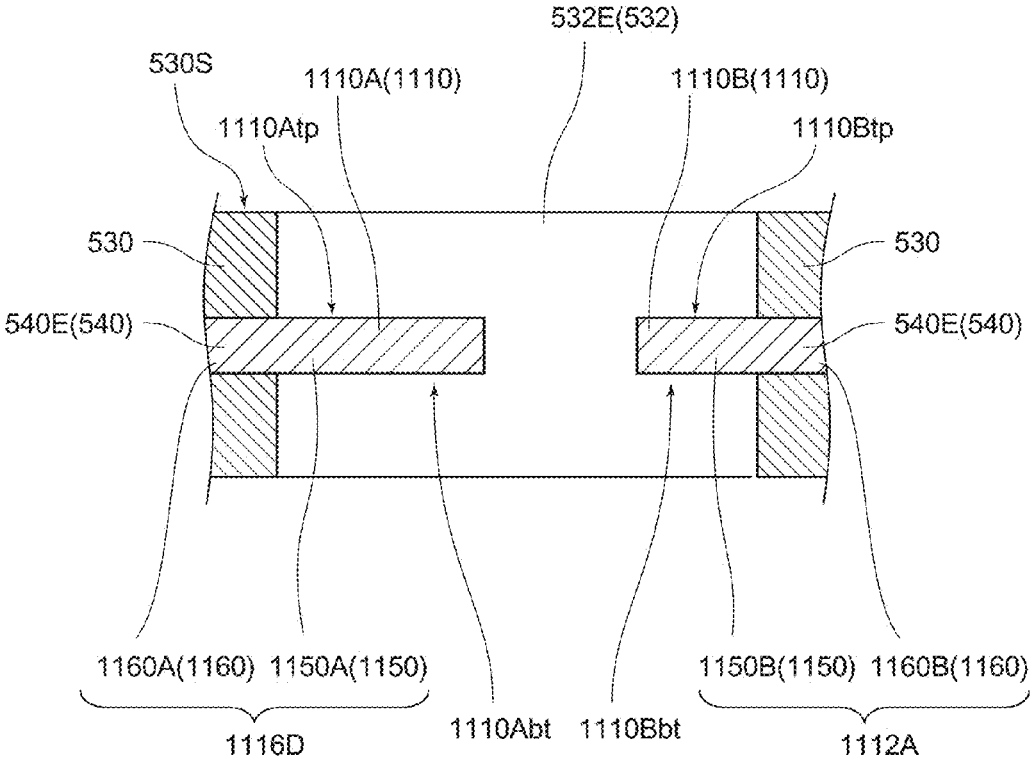
FIG. 31 is a sectional view illustrating an example of a sectional structure taken along the line D-D of FIG. 30.

FIG. 30 is an enlarged top view illustrating an arrangement relationship between the metal terminal 540E and the base 530 in the vicinity of the mounting part 1110 of the metal terminal 540E in the case where the metal terminal 540E illustrated in FIG. 29 is fixed to the base 530 by injection molding, specifically, illustrating an enlarged arrangement position of the metal terminal 540E in the vicinity of the opening part 532E. Note that, FIG. 30 illustrates a state after the coupling part 1116E is removed by cutting at both ends thereof. Further, FIG. 31 is a schematic sectional view illustrating an example of a sectional structure taken along the line D-D of FIG. 30. Note that, in FIG. 31, for convenience of description, the thickness of the metal terminal 540E is drawn thick with respect to the base 530.

As illustrated in FIGS. 30 and 31, in the opening part 532E, the mounting parts 1110A, 1110B, a part (neck part 1150A (1150)) of the coupling part 1116D, and a part (neck part 1150B (1150)) of the winding connecting part 1112A are exposed. Further, the coupling part 1116D other than the neck part 950A serves as a portion (fixing part 1160A (1160)) buried in and fixed to the resin material forming the base 530. Further, in the winding connecting part 1112A in the vicinity of the opening part 532E, the winding connecting part 1112A other than the neck part 1150B also serves as a portion (fixing part 1160B (1160)) buried in and fixed to the resin material forming the base 530.

Specifically, the metal terminal 540E forming the metal member 1000 includes a portion serving as the fixing part 1160, the neck part 1150, and a portion serving as the plate-shaped mounting part 1110 connected to the fixing part 1160 indirectly through intermediation of the neck part 1150 when the antenna coil component 510 has been manufactured. Note that, the metal member 1000 may have a structure in which the neck part 1150 is omitted, and the mounting part 1110 is connected to the fixing part 1160 directly.

Next, the soldering step of soldering an electronic component such as the chip capacitor 550 to the mounting part 1110 is performed. The soldering step can be performed by any of a first manufacturing process and a second manufacturing process described below. Note that, FIGS. 32A to 32C and 33A to 33C described in the following illustrate the same portion as the sectional portion illustrated in FIG. 31.

<First Manufacturing Process>

Figure 32A:
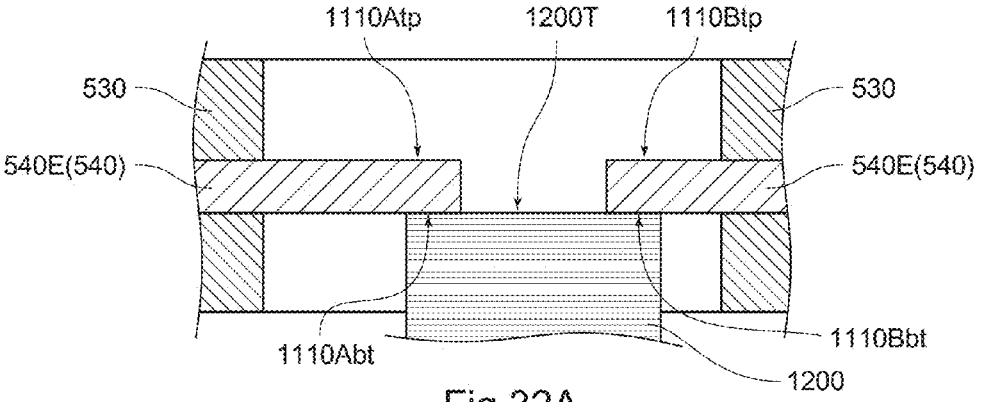
FIGS. 32A to 32C are sectional views illustrating an example of the case where a soldering step is performed by a first manufacturing process in the method of manufacturing an antenna coil component according to the fourth embodiment.

In the first manufacturing process, first, the mounting part heating step of heating each one surface (rear surfaces 1110Abt, 1110Bbt) of the mounting parts 1110A, 1110B is performed. In the mounting part heating step, for example, as illustrated in FIG. 32A, the mounting parts 1110A, 1110B are heated directly by bringing a soldering iron 1200, in which a top surface 1200T of a tip end is flat, serving as a local heating source into direct contact with the rear surfaces 1110Abt, 1110Bbt. The temperature of the tip end of the soldering iron 1200 is selected appropriately depending on the melting point of solder to be used and the like, but in general, it is preferred to set the temperature to 220° C. or more. Note that, in order to suppress thermal damages such as deterioration and deformation of a resin material forming the base 530, it is desired to control the temperature of the tip end of the soldering iron 1200 so that the temperature does not become higher than necessary. Thus, it is preferred to control the temperature of the tip end of the soldering iron 1200 in a range of about 220° C. to 230° C. The temperature setting of the tip end of the soldering iron 1200 is preferred, in particular, in the case of using a heat-labile resin as the resin material forming the base 530. Further, as the soldering iron 1200 to be used for performing the mounting part heating step, a soldering iron is used which is capable of ensuring a predetermined gap between the tip end thereof and the inner wall surface of the opening part 532 when the soldering iron 1200 is disposed in the opening part 532.

Figure 32B:
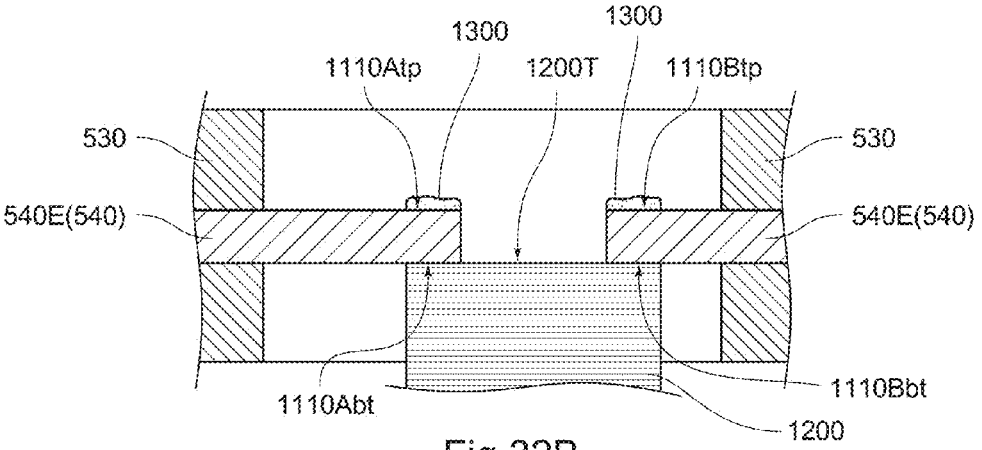

Next, as illustrated in FIG. 32B, the solder supply step of supplying solder 1300 to the other surfaces (surfaces 1110Atp, 1110Btp) of the mounting parts 1110A, 1110B is performed. In this case, the mounting parts 1110A, 1110B are heated sufficiently, and hence the solder supplied onto the surfaces 1110Atp, 1110Btp takes a molten state. Note that, the method of supplying the solder 1300 is not particularly limited, and for example, a method of applying cream solder to the surfaces 1110Atp, 1110Btp with a solder dispenser or a method of supplying the solder 1300 onto the surfaces 1110Atp, 1110Btp by melting thread solder while pressing the thread solder onto the surfaces 1110Atp, 1110Btp can be used.

Figure 32C:
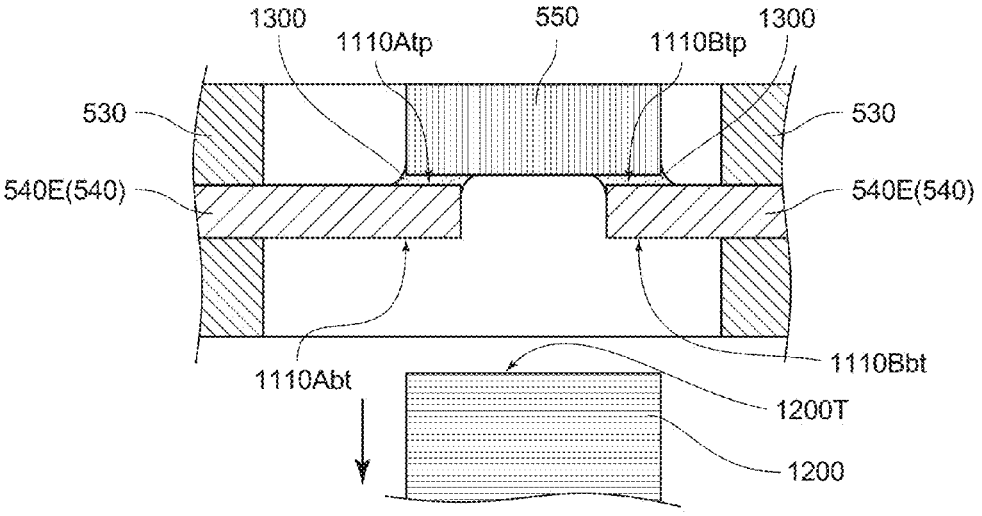

As illustrated in FIG. 32C, the electronic component arrangement step of arranging an electronic component such as the chip capacitor 550 so that the chip capacitor 550 bridges the mounting parts 1110A and 1110B is performed with respect to the other surfaces (surfaces 1110Atp, 1110Btp) to which the solder 1300 has been supplied.

Note that, the mounting part heating step can be completed at any timing during a period from a time before the solder supply step is performed to a time after the electronic component arrangement step is completed. However, in general, as illustrated in FIG. 32C, it is desired to complete the mounting part heating step in substantially the same period as the completion of the electronic component arrangement step by separating the soldering iron 1200 from the rear surfaces 1110Abt, 1110Bbt after arranging the electronic component such as the chip capacitor 550 on the mounting parts 1110A, 1110B. In this case, soldering at lower heating temperature can be performed.

After the electronic component arrangement step is completed, the solder 1300 in a molten state is solidified to form a solder connecting part, with the result that the electronic component such as the chip capacitor 550 and the mounting parts 1110A, 1110B are soldered to each other.

<Second Manufacturing Process>

Figure 33A:
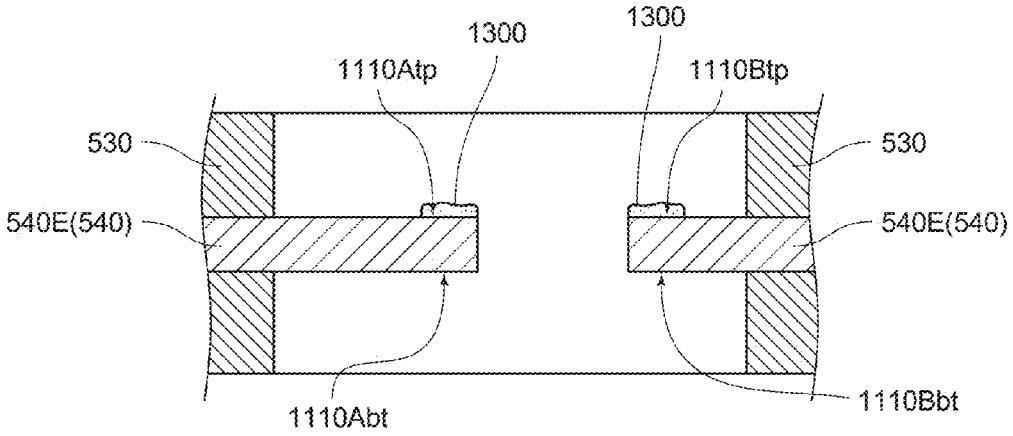
FIGS. 33A to 33C are sectional views illustrating an example of the case where a soldering step is performed by a second manufacturing process in the method of manufacturing an antenna coil component according to the fourth embodiment.
Figure 33B:
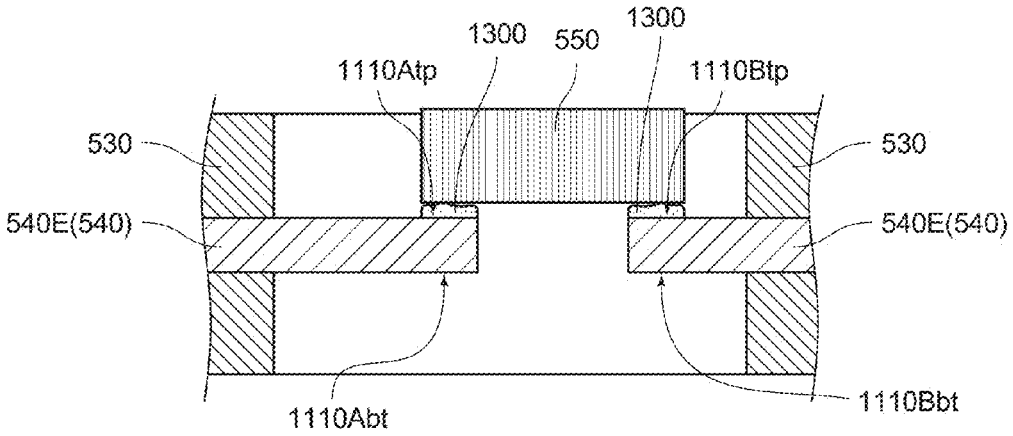
Figure 33C:
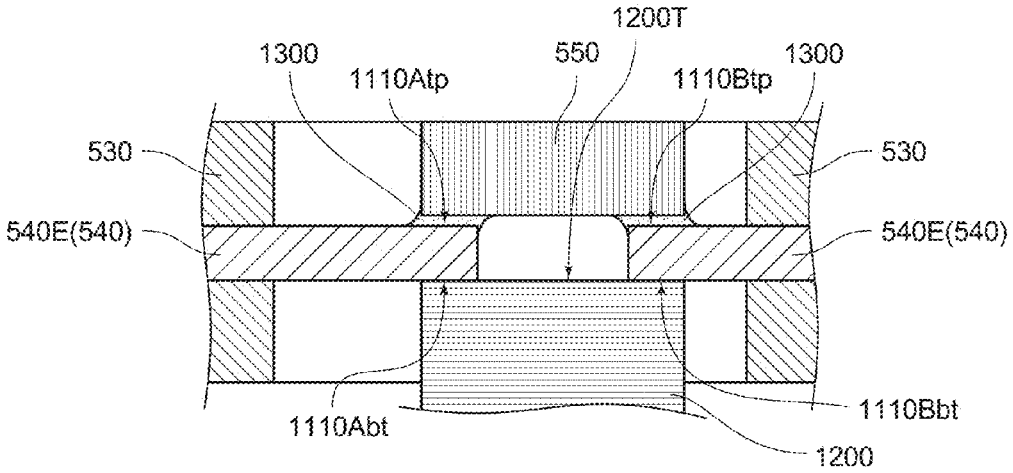

On the other hand, in the second manufacturing process, first, as illustrated in FIG. 33A, the solder supply step of supplying the solder 1300 to each one surface (surfaces 1110Atp, 1110Btp) of the mounting parts 1110A, 1110B is performed. Note that, the method of supplying the solder 1300 is not particularly limited, and for example, a method of applying cream solder to the surfaces 1110Atp, 1110Btp with a solder dispenser or the like can be adopted. Next, as illustrated in FIG. 33B, the electronic component arrangement step of arranging an electronic component on each one surface (surfaces 1110Atp, 1110Btp) to which the solder 1300 in a non-molten state has been supplied is performed. Then, the mounting part heating step of heating the other surfaces (rear surfaces 1110Abt, 1110Bbt) of the mounting parts 1110A, 1110B is performed. In this case, the mounting part heating step is performed by bringing the soldering iron 1200, in which the top surface 1200T of the tip end is flat, serving as the local heating source into direct contact with the rear surfaces 1110Abt, 1110Bbt, as illustrated in FIG. 33C. Thus, the mounting parts 1110A, 1110B are directly heated with the soldering iron 1200. Then, when the solder 1300 in a non-molten state is melted sufficiently by heating, the mounting part heating step is completed by, for example, separating the soldering iron 1200 from the rear surfaces 1110Abt, 1110Bbt. Consequently, the solder 1300 in a molten state is solidified to forma solder connecting part, with the result that the electronic component such as the chip capacitor 550 and the mounting parts 1110A, 1110B are soldered to each other.

Note that, the second manufacturing process can be performed in the same way as in the first manufacturing process except that the mounting part heating step, the solder supply step, and the electronic component arrangement step are different. Further, the second manufacturing process is effective in particular in the case where the soldering iron 1200 is used as a local heating source and each thickness of the mounting parts 1110A, 1110B is small. In this case, the soldering step can be completed within a very short period of time such as five seconds. Note that, as the case where each thickness of the mounting parts 1110A, 1110B is small, for example, there is given a case where the thickness Tm of the mounting part 910 is set to be small with respect to the thickness Tn of the neck part 950 as in the metal terminal 540D illustrated in FIG. 28 or a case where the thickness of the entire metal terminal 540E is small. In the case where only the thickness of the mounting parts 1110A, 1110B or the entire thickness of the metal terminal 540E is set to be small, the thickness can be set, for example, in a range of 0.21 mm to 0.43 mm.

In the mounting part heating step in the first manufacturing process and the second manufacturing process, various local heating sources to be used in the spot reflow method, for example, local heating sources of an indirect heating system such as a hot blast nozzle for performing soldering by jetting hot blast from a nozzle, a condensing light source for irradiating an object with condensed light from a light source such as a halogen lamp, and a laser light source for irradiating an object with laser light can also be used instead of the soldering iron 1200 serving as a local heating source illustrated in FIGS. 32 and 33. However, those local heating sources of an indirect heating system can heat the mounting part 1110 only indirectly because the local heating sources are disposed at a position spaced from the mounting part 1110. Therefore, when the mounting part heating step is performed, those local heating sources easily cause thermal damages to the resin material forming the base 530 on the periphery of the opening part 532, compared to the soldering iron 1200 serving as a local heating source of a direct heating system. Further, the soldering iron 1200 has high heating efficiency, and the facility is inexpensive. Thus, in the mounting part heating step, it is particularly preferred to use the soldering iron 1200.

On the other hand, depending on an electronic component to be used, there is a risk in that the electronic component may be thermally damaged through the mounting part 1110 and the solder 1300 due to heating in the mounting part heating step. For example, in the case where the electronic component is the chip capacitor 550, in particular, a laminated ceramics capacitor, cracks are likely to occur due to a rapid change in temperature (for example, a change in temperature with a temperature increasing rate of 350° C./sec or more). For example, a laminated ceramics capacitor with a size of 3216 or smaller is generally recommended to have a temperature increasing rate during heating and a cooling rate during cooling of 150° C./sec or less, and a laminated ceramics capacitor with a size of 3225 or larger is generally recommended to have a temperature increasing rate and a cooling rate of 130° C./sec or less. Thus, in the case where there is a risk in that an electronic component may be thermally damaged due to heating in the mounting part heating step, it is preferred to perform an electronic component preheating step of preheating an electronic component before performing the electronic component arrangement step in the first manufacturing process and the second manufacturing process.

The heating schedule in the electronic component preheating step is not particularly limited, and it is sufficient that the temperature be increased so as to exceed room temperature up to a target heating temperature set in a range less than the heating temperature in the mounting part heating step at a temperature increasing rate equal to or less than the generally recommended temperature increasing rate. The target heating temperature in the electronic component preheating step can be selected, for example, in a range of 140° C.±40° C. If the electronic component is preheated in advance, it becomes very easy to regulate the temperature increasing rate of an electronic component to the temperature increasing rate equal to or less than the recommended temperature increasing rate in the mounting part heating step.

Figure 34:
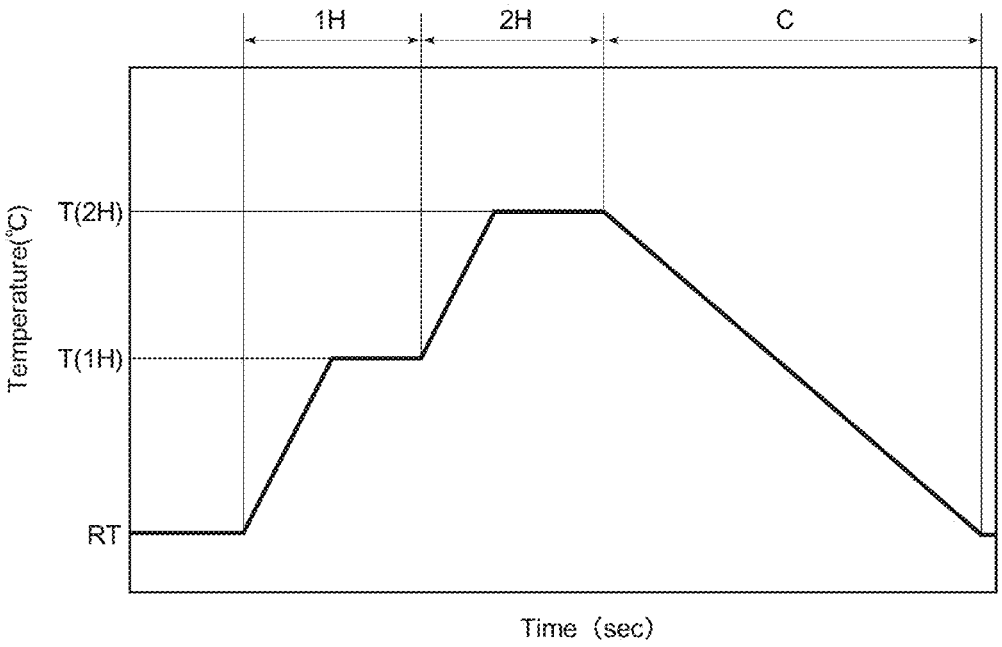
FIG. 34 is a graph showing an example of a heating treatment schedule in the case of using a chip capacitor of a laminated ceramics capacitor type as an electronic component in the method of manufacturing an antenna coil component according to the fourth embodiment.

FIG. 34 is a graph showing an example of a heating processing schedule in the case of using the chip capacitor 550 of a laminated ceramics capacitor type as an electronic component. In FIG. 34, a horizontal axis represents time (sec) and a vertical axis represents temperature (° C.), an interval 1H means that the electronic component preheating step is being performed, an interval 2H means that the mounting part heating step is being performed, and an interval C means that the cooling step after the completion of the mounting part heating step is completed. In the example illustrated in FIG. 34, first, in the electronic component preheating step (interval 1H), the temperature is increased from room temperature RT (about 25° C.) to a target control temperature T (1H) at a predetermined temperature increasing rate ΔT(1H), and when the target control temperature T(1H) is reached, this temperature is kept for a while. Then, in the mounting part heating step (interval 2H), the temperature is increased from the target control temperature T(1H) to a target control temperature T(2H) at a predetermined temperature increasing rate ΔT(2H), and when the target control temperature T(2H) is reached, this temperature is kept for a while. After that, in a cooling step (interval C), the temperature is decreased to the room temperature RT at a predetermined temperature decreasing rate ΔT(C). In this case, the temperature increasing rates ΔT(1H) and ΔT(2H) can be selected appropriately from a range of 90 to 130° C./sec, the temperature decreasing rate ΔT(C) can be selected appropriately from a range of 10° C./sec to 130° C./sec, the target control temperature T(1H) can be selected appropriately from 140±40° C., and the target control temperature T(2H) can be selected appropriately from 240±20° C. Further, the cooling step (interval C) may be performed by natural cooling. Note that, in order to render the temperature increasing rate gentler, for example, two levels of target control temperature T(1H) may be provided. In this case, the temperature is increased to target control temperature T(2H) in three stages instead of increasing the temperature to the target control temperature T(2H) in two stages as illustrated in FIG. 34.

Further, the heating method in the electronic component preheating step is not particularly limited as long as the desired heating schedule as illustrated in FIG. 34 can be realized. For example, there is given a method involving disposing electronic components on a belt conveyer which moves in one direction at a predetermined speed and heating the electronic components in this state with a heating source disposed above the belt conveyer over a period of time. In this case, as the heating source, for example, a halogen heater, a hot blast heater, or the like can be used.

Note that, the steps other than those described above in detail can be performed by combining conventionally known steps appropriately as needed. Thus, the antenna coil component 510 can be manufactured. Note that, the structure of the antenna coil component 510 manufactured by the method of manufacturing an antenna coil component according to the fourth embodiment is not particularly limited as long as the structure is a structure to which the method of manufacturing an antenna coil component according to the fourth embodiment is applicable, that is, the mounting part 1110 is exposed inside the opening part 532E. Accordingly, as long as an antenna coil component has a structure in which the mounting part 1110 is exposed inside the opening part 532E, the method of manufacturing an antenna coil component according to the fourth embodiment can be applied to manufacturing of any of the antenna coil component 10 according to the first embodiment, the antenna coil component 510 according to the second embodiment, the antenna coil component 510 according to the third embodiment, and a conventionally known antenna coil component.

Fifth Embodiment

Next, the fifth embodiment is described. In the case of soldering an electronic component such as a chip capacitor to a mounting part of a metal terminal fixed to a base formed of a resin material when manufacturing an antenna coil component, a local heating method such as a spot reflow method can also be used besides an entire heating method of heating the entire antenna coil component in the course of manufacturing with a reflow furnace. In the case of performing soldering through use of the local heating method, the mounting part is subjected to local heating. However, when the mounting part is subjected to local heating during soldering, there is a risk in that the electronic component such as a chip capacitor may be thermally damaged. For example, a chip capacitor, in particular, a laminated ceramics capacitor may be easily cracked.

The fifth embodiment has been made in view of the above-mentioned circumstance, and it is an object of the fifth embodiment to provide a method of manufacturing an antenna coil component capable of further suppressing thermal damages to an electronic component when soldering the electronic component to a metal terminal by a local heating method during manufacturing of an antenna coil component.

In order to achieve the above-mentioned object, the method of manufacturing an antenna coil component according to the fifth embodiment includes at least: an injection molding step of molding at least abase formed of a resin material and simultaneously burying a fixing part in the base by disposing a metal member in a mold and injecting the resin material into the mold, the metal member including at least the fixing part and a plate-shaped mounting part which is connected to the fixing part directly or indirectly and to which an arm part is connected; and a soldering step of soldering an electronic component to the mounting part, in which the soldering step is performed by locally heating at least a part of the arm part.

Figure 35:
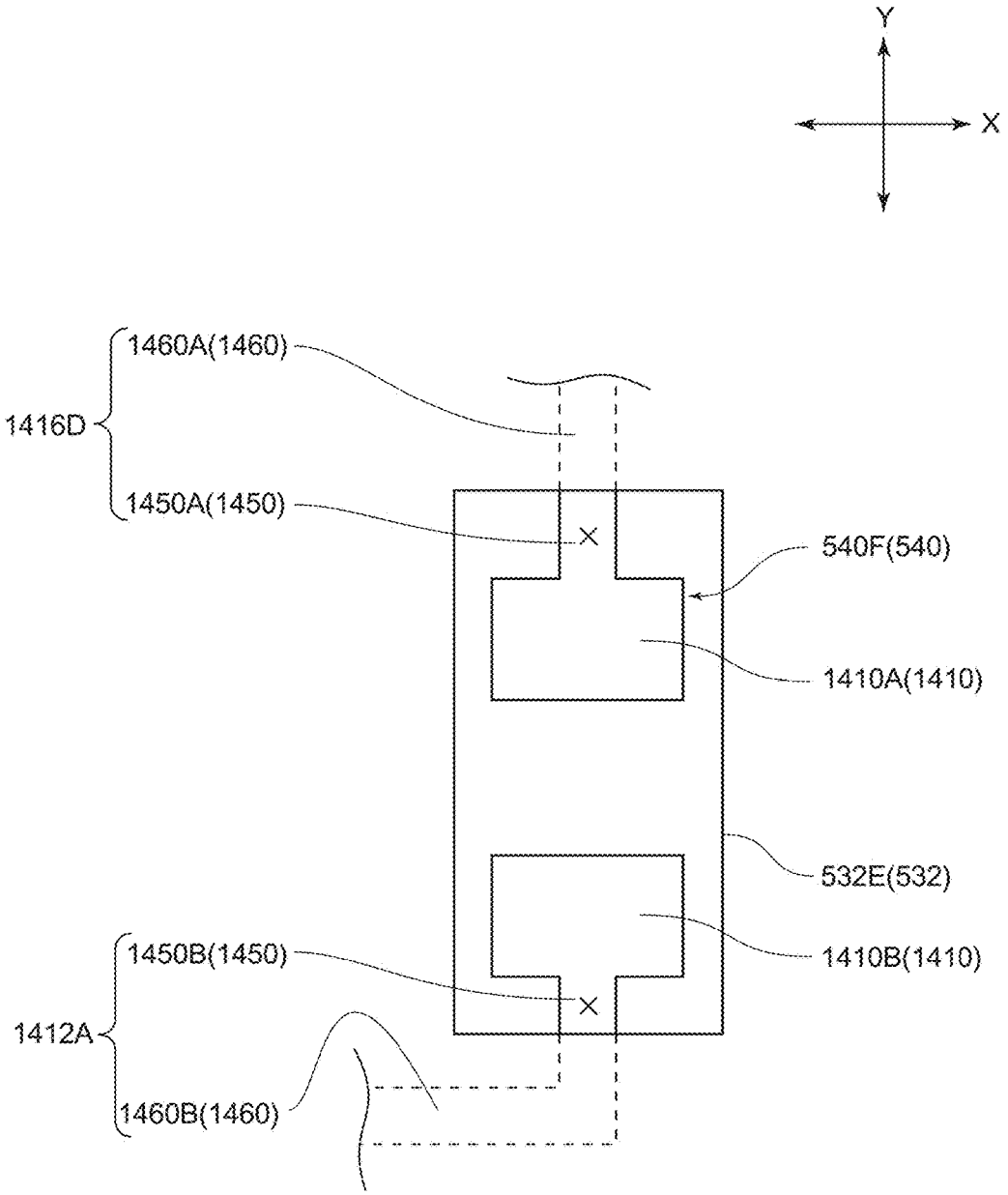
FIG. 35 is an enlarged top view illustrating an example of a method of manufacturing an antenna coil component according to a fifth embodiment of the present invention.

FIG. 35 is an enlarged top view illustrating an example of the method of manufacturing an antenna coil component according to the fifth embodiment, specifically, an enlarged top view illustrating an example of a structure in the vicinity of amounting part after a fixing part of a metal terminal is buried in the base. FIG. 35 illustrates the same structure as that of the state (FIG. 30) after the coupling part 1116E is removed by cutting after a part of the metal terminal 540E is fixed so as to be buried in the base 530 as illustrated in FIG. 29 by the injection molding step. In FIG. 35, a metal terminal 540F (540), amounting part 1410A (1410), a mounting part 1410B (1410), a coupling part 1416D, a winding connecting part 1412A, a neck part 1450A (1450), a neck part 1450B (1450), a fixing part 1460A (1460), and a fixing part 1460B (1460) are respectively the same members, in the shape and structure, as the metal terminal 540E, the mounting part 1110A, the mounting part 1110B, the coupling part 1116D, the winding connecting part 1112A, the neck part 1150A, the neck part 1150B, the fixing part 1160A, and the fixing part 1160B in FIG. 30.

In the example illustrated in FIG. 35, the mounting part 1410A is connected to the fixing part 1460A indirectly through the neck part 1450A, and the mounting part 1410B is connected to the fixing part 1460B indirectly through the neck part 1450B. In this case, in the example illustrated in FIG. 35, when the soldering step is performed, for example, after solder is supplied to the mounting parts 1410A, 1410B, the electronic component such as the chip capacitor 550 is disposed so as to bridge the mounting parts 1410A and 1410B. Next, the neck parts 1450A and 1450B are each heated locally. In this case, a position indicated by an "X" mark in FIG. 35 is a center point of a place to be heated locally. In this case, the mounting part 1410A is heated through the neck part 1450A, and the mounting part 1410B is heated through the neck part 1450B. Therefore, the electronic component such as the chip capacitor 550 is soldered to the mounting parts 1410A, 1410B. Specifically, in the example illustrated in FIG. 35, the neck part 1450 is used as an arm part to be heated locally. In other words, the neck part 1450 also serves an arm part.

As illustrated in FIG. 35, in the method of manufacturing an antenna coil component according to the fifth embodiment, the mounting part 1410 is not locally heated but the arm part (neck part 1450 in the example illustrated in FIG. 35) connected to the mounting part 1410 is heated locally. Therefore, the temperature increasing rate of the electronic component is rendered gentler and/or the maximum heating temperature of the electronic component is decreased easily compared to the case of heating the mounting part 1410 locally. Therefore, the thermal damages to the electronic component can be suppressed. Note that, the planar shape and arrangement position of the arm part are not particularly limited as long as the arm part is a member exposed together with the mounting part 1410 and connected to at least the mounting part 1410 in the opening part 532E of the base 530 after injection molding. However, it is preferred that the planar shape of the arm part be basically a band shape whose width is smaller than the vertical and horizontal lengths of the mounting part 1410 as in the neck part 1450 illustrated in FIG. 35.

Note that, in the example illustrated in FIG. 35, soldering may be performed by disposing the solder 1300 and the electronic component after performing local heating in advance. Note that, steps other than the injection molding step and the soldering step are not particularly limited, and known steps or various steps described above can be performed appropriately. Thus, the antenna coil component 510 according to the second embodiment, the antenna coil component 510 according to the third embodiment, or a known antenna coil component can be obtained. Needless to say, the method of manufacturing an antenna coil component according to the fifth embodiment can also be used for manufacturing the antenna coil component 10 according to the first embodiment. Further, in the case of performing the soldering step, the method of manufacturing an antenna coil component according to the fifth embodiment may be combined with the method of manufacturing an antenna coil component according to the third embodiment, and in the method of manufacturing an antenna coil component according to the fourth embodiment, the mounting part 1410 may be heated by bringing the soldering iron 1200 into contact with the arm part instead of the mounting part 1410. Note that, those points similarly apply to examples illustrated in FIGS. 36 to 38 described later.

Note that, in the example illustrated in FIG. 35, the neck part 1450 serving as the arm part is adjacent to the fixing part 1460 and has a short length. Therefore, even when the neck part 1450 is heated locally, a surrounding portion is likely to be heated incidentally because the heat transfer distance from the neck part 1450 to the fixing part 1460 is short. Therefore, the resin material forming the base 530 in the vicinity of the fixing part 1460 is likely to be thermally damaged, and in addition, it is difficult to use a heat-labile resin as the resin material in some cases. Thus, in order to facilitate the use of a heat-labile resin as the resin material forming the base 530, it is preferred that the arm part having a largest possible heat transfer distance from the fixing part 1460 be heated during the soldering step.

Figure 36:
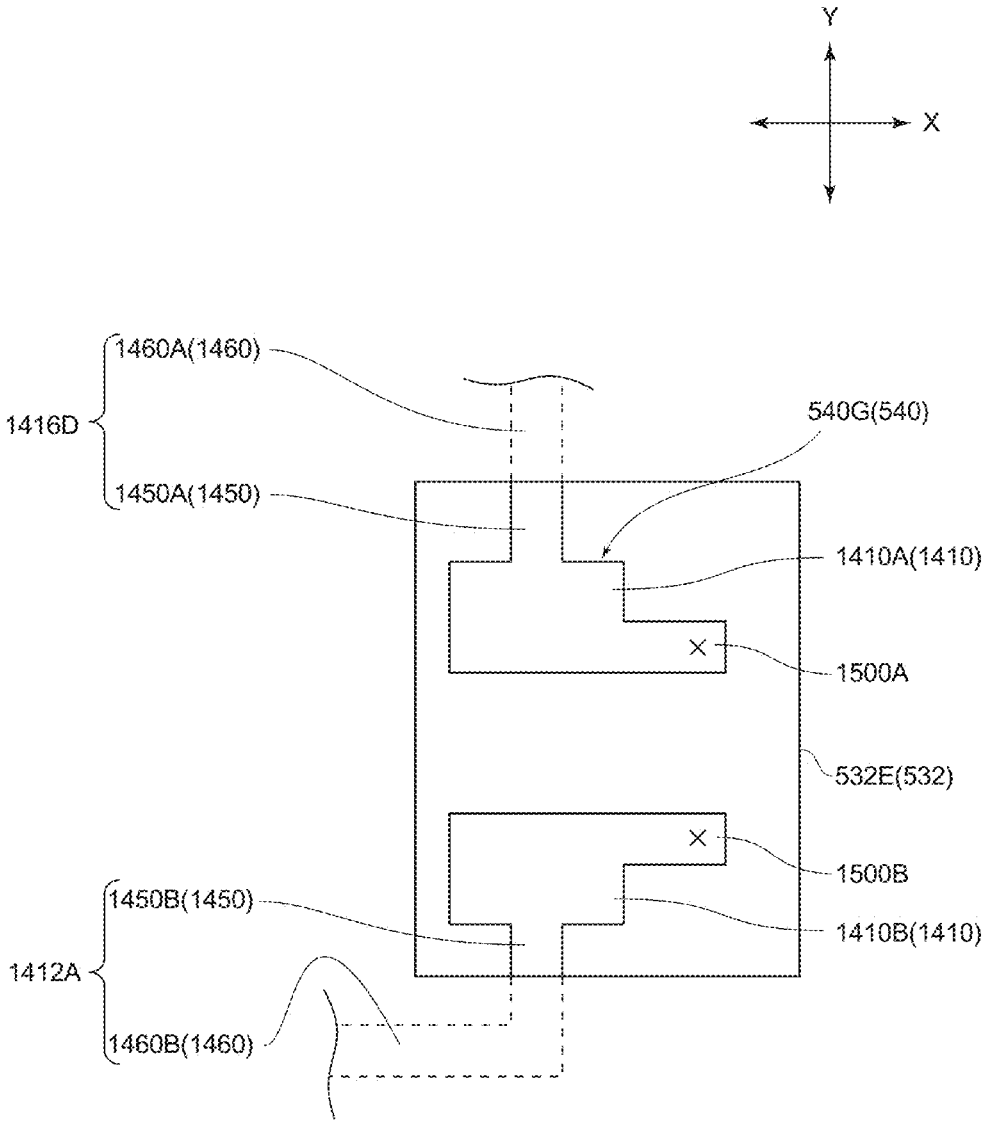
FIG. 36 is an enlarged top view illustrating another example of the method of manufacturing an antenna coil component according to the fifth embodiment.

FIG. 36 is an enlarged top view illustrating another example of the method of manufacturing an antenna coil component according to the fifth embodiment, specifically, an enlarged top view illustrating an example of the structure in the vicinity of a mounting part after a fixing part of a metal terminal is buried in a base. In the example illustrated in FIG. 36, the opening part 532E is extended to the right side with respect to the example illustrated in FIG. 35. Further, the metal terminal 540G (540) used in the example illustrated in FIG. 36 has the same structure as that of the metal terminal 540F illustrated in FIG. 35 except that an arm part 1500A having a free end, in which an end is not connected to or in contact with another member, is connected to the right side of the mounting part 1410A, and an arm part 1500B having a free end, in which an end is not connected to or in contact with another member, is connected to the right side of the mounting part 1410B. Note that, the arm parts 1500A, 1500B have a band shape extending in a direction parallel to the X-direction.

In the example illustrated in FIG. 36, the tip ends of the arm parts 1500A, 1500B are heated locally during the soldering step. In this case, a position indicated by an "X" mark in FIG. 36 is a center point of a place to be heated locally. The mounting part 1410A and the neck part 1450A are interposed between the arm part 1500A and the fixing part 1460A. That is, in the example illustrated in FIG. 36, the heat transfer distance from the arm part 1500A to the fixing part 1460A is very long compared to the example illustrated in FIG. 35. This similarly applies to the arm part 1500B.

Thus, in the example illustrated in FIG. 36, the heat transfer amount to the base 530 can be greatly suppressed compared to the example illustrated in FIG. 35, and hence the thermal damages to the resin material forming the base 530 can be suppressed. Therefore, as the resin material forming the base 530, a heat-labile resin can be also adopted. However, in the example illustrated in FIG. 36, it is necessary to locally heat two portions, specifically, the tip end of the arm part 1500A and the tip end of the arm part 1500B. In this case, it is appropriate to bring the soldering iron 1200 having the top surface 1200T in a rectangular shape into contact with the tip end of the arm part 1500A and the tip end of the arm part 1500B while the long side of the top surface 1200T is disposed so as to be parallel to the Y-direction. Consequently, the two portions, specifically, the tip end of the arm part 1500A and the tip end of the arm part 1500B can be simultaneously heated locally. However, in the case where a heating source to be used is a hot blast discharge nozzle, a laser light source, or a condensing light source of condensing light from a halogen lamp, it is necessary to perform local heating twice or prepare two heating sources. Therefore, in order to prevent such a local heating process from being cumbersome or prevent heating facility from being enlarged, it is preferred that the tip end of the arm part 1500A and the tip end of the arm part 1500B be connected to each other.

Figure 37:
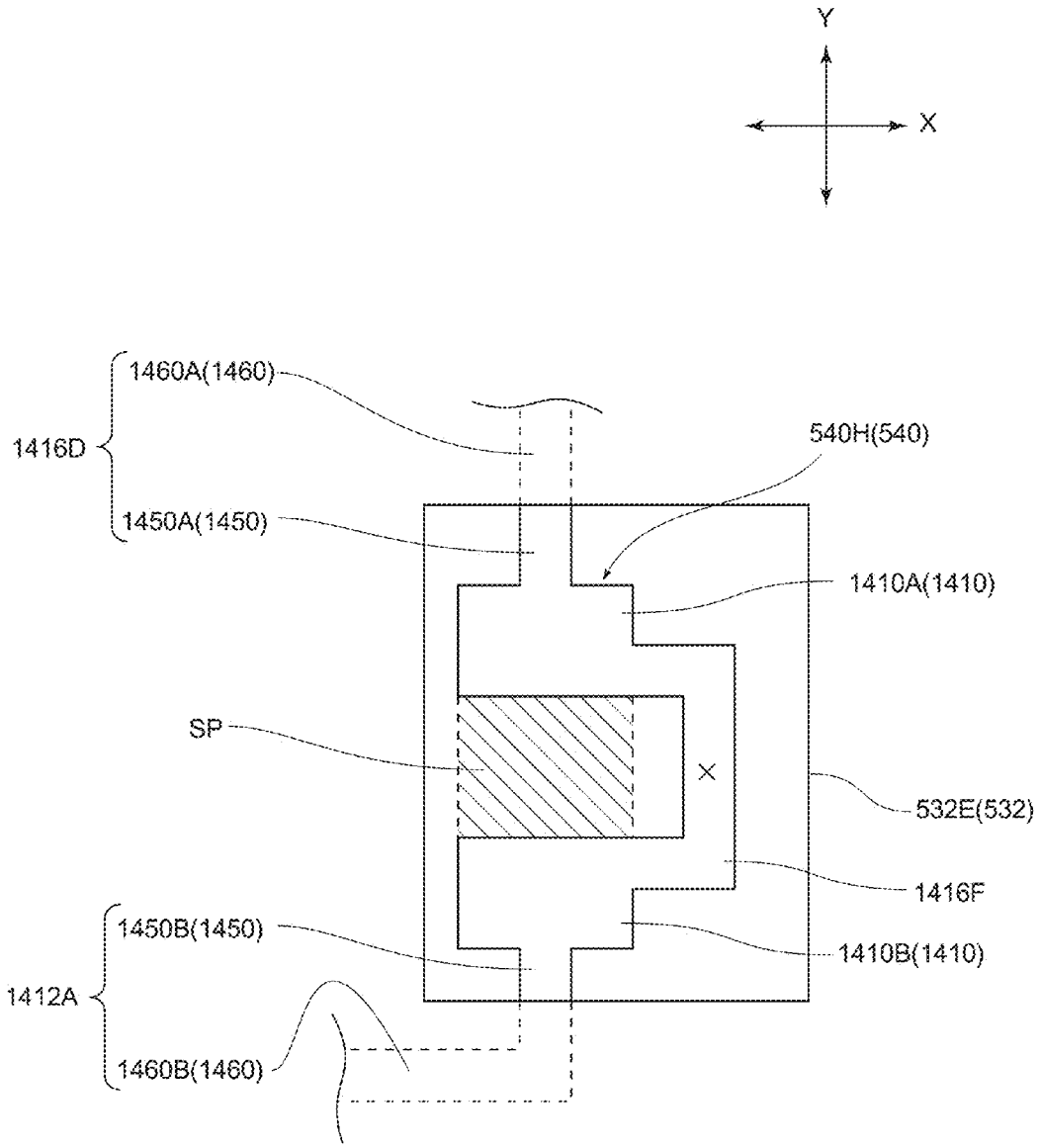
FIG. 37 is an enlarged top view illustrating another example of the method of manufacturing an antenna coil component according to the fifth embodiment.

FIG. 37 is an enlarged top view illustrating another example of the method of manufacturing an antenna coil component according to the fifth embodiment, specifically, an enlarged top view illustrating an example of the structure in the vicinity of the mounting part after the fixing part of the metal terminal is buried in the base. The example illustrated in FIG. 37 is the same as the example illustrated in FIG. 36 except that the shape of the metal terminal 540H (540) to be disposed in the opening part 532 is slightly different from the metal terminal 540G illustrated in FIG. 36. In this case, the metal terminal 540H illustrated in FIG. 37 has the same structure as that of the metal terminal 540G illustrated in FIG. 36 except that a coupling part 1416F having a structure of connecting the tip end of the arm part 1500A and the tip end of the arm part 1500B to each other is provided instead of the arm parts 1500A, 1500B. Note that, the coupling part 1416F has a U-shape brought down to the left side.

In the example illustrated in FIG. 37, the coupling part 1416F also serves as an arm part, and during the soldering step, any position of the coupling part 1416F can be heated locally. However, in the case of heating the coupling part 1416F locally, it is particularly preferred to locally heat the vicinity of the position (intermediate point) indicated by an "X" mark in FIG. 37, that is the vicinity of a position at which the heat transfer distance to the mounting part 1410A is substantially equal to the heat transfer distance to the mounting part 1410B. In the case of locally heat the vicinity of the intermediate point of the coupling part 1416F, it becomes easier to heat the mounting parts 1410A and 1410B equally. Thus, it also becomes easier to prevent the non-uniformity of a soldered state between the mounting part 1410A side and the mounting part 1410B side. Further, after the soldering step is completed, the coupling part 1416F serving as a bypass of an electric path including the mounting part 1410A, the electronic component such as the chip capacitor 550, and the mounting part 1410B is cut.

Note that, it is particularly preferred that the coupling part 1416F also serving as an arm part be provided in a region other than a region SP between the mounting parts 1410A and 1410B in a planar direction of the mounting parts 1410A, 1410B. This is because, in the case of providing the coupling part 1416F also serving as an arm part in the region SP, there is a high possibility that the position at which the coupling part 1416F is disposed and the position at which the electronic component such as the chip capacitor 550 is disposed overlap each other. Further, in the case where the position at which the coupling part 1416F is disposed and the position at which the electronic component such as the chip capacitor 550 is disposed overlap each other, the electronic component and the mounting parts 1410A, 1410B need to be soldered after the coupling part 1416F is removed by cutting after the local heating of the coupling part 1416F. In this case, the soldering step becomes very complicated and cumbersome.

Figure 38:
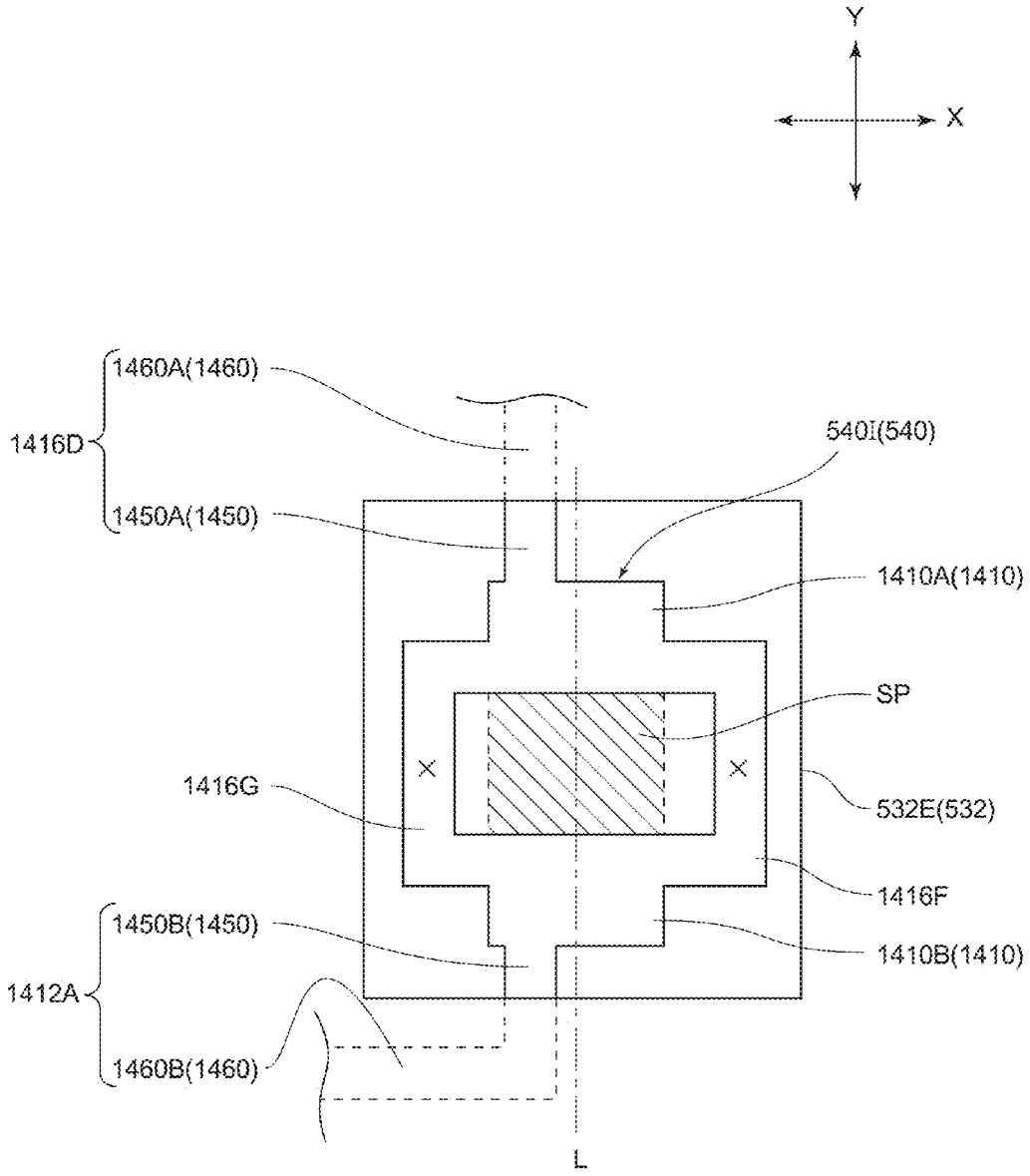
FIG. 38 is an enlarged top view illustrating another example of the method of manufacturing an antenna coil component according to the fifth embodiment.

FIG. 38 is an enlarged top view illustrating another example of the method of manufacturing an antenna coil component according to the fifth embodiment, specifically, an enlarged top view illustrating an example of the structure in the vicinity of the mounting part after the fixing part of the metal terminal is buried in the base. The example illustrated in FIG. 38 is the same as that illustrated in FIG. 37 except that the structure of the metal terminal 540I (540) is slightly different from the metal terminal 540H illustrated in FIG. 37. In this case, the metal terminal 540I illustrated in FIG. 38 has the same structure as that of the metal terminal 540H illustrated in FIG. 37 except that the coupling part 1416D is connected to an upper left side of the mounting part 1410A, the winding connecting part 1412A is connected to a lower left side of the mounting part 1410B, and a coupling part 1416G for connecting the mounting part 1410A and the mounting part 1410B to each other is further provided on a left side of the mounting parts 1410A, 1410B. Note that, the coupling part 1416G has a U-shape brought down to the right side. Further, two "X" marks in FIG. 38 respectively indicate intermediate points of the coupling parts 1416F, 1416G.

In the example illustrated in FIG. 38, anyone selected from the coupling parts 1416F and 1416G or both thereof can be used as arm parts. Further, the position of local heating in this case can be selected arbitrarily; however, it is preferred to select the vicinity of the intermediate point of the coupling part 1416F and/or the vicinity of the intermediate point of the coupling part 1416G in the same way as in the example illustrated in FIG. 37. In this case, compared to the example illustrated in FIG. 37, the mounting parts 1410A and 1410B can be heated more equally.

Note that, for the same reason as that for the coupling part 1416F, it is particularly preferred that the coupling part 1416G be also disposed in a region other than the region SP. Further, from the viewpoint of heating the mounting parts 1410A and 1410B equally, it is preferred that the mounting parts 1416G and 1416F be disposed on one side and the other side with respect to a center line L which is parallel to the Y-direction and bisects the mounting parts 1410A and 1410B in the Y-direction as illustrated in FIG. 38, and it is particularly preferred that the mounting parts 1416G and 1416F be disposed at positions which are substantially line-symmetric with respect to the center line L. Further, after the soldering step is completed, both the coupling parts 1416G and 1416F are cut.

Note that, in the example illustrated in FIG. 37, a cutting mark caused by cutting the coupling part 1416F remains in the metal terminal 540H of the completed antenna coil component 510, and in the example illustrated in FIG. 38, cutting marks caused by cutting the coupling parts 1416F and 1416G remain in the metal terminal 540I of the completed antenna coil component 510.

What is claimed is:

1. An antenna coil component, comprising at least:

a bobbin having a tubular shape and formed of an insulating material;

a winding wound around an outer circumferential side of the bobbin;

a base provided at least at one end side of the bobbin and formed of an insulating material; and one or more metal terminals each having conductivity and fixed to the base, wherein at least one metal terminal among the one or more metal terminals comprises a mounting part having a plate shape on which an electric component is mounted; and an entire periphery of an end of the mounting part is spaced from the base.

2. The antenna coil component according to claim 1, wherein the at least one metal terminal among the one or more metal terminals further comprises at least:

a fixing part for fixing the at least one metal terminal to the base; and a neck part for connecting the fixing part and the mounting part to each other, the neck part having a length narrower than a length of the mounting part in a direction substantially orthogonal to a direction from the fixing part to the mounting part and substantially parallel to front and rear surfaces of the mounting part.

3. An antenna coil component according to claim 1, wherein the mounting part has the electronic component disposed thereon through intermediation of a solder connecting part.

4. An antenna coil component according to claim 1, wherein the electronic component comprises a chip capacitor.

5. An antenna coil component according to claim 2, wherein the at least one metal terminal comprises two metal terminals each including at least the fixing part, the mounting part, and the neck part.

6. An antenna coil component according to claim 2, wherein the at least one metal terminal including at least the fixing part, the mounting part, and the neck part comprises one mounting part and one neck part.

7. An antenna coil component according to claim 6, wherein the fixing part is buried in the base.

8. An antenna coil component according to claim 2, wherein:

the bobbin and the base are formed integrally with each other;

the base has a ring shape forming a hollow part which passes through the base in a direction substantially orthogonal to an axial direction of the bobbin; and the at least one metal terminal including at least the fixing part, the mounting part, and the neck part is disposed so that the mounting part and the neck part are positioned in the hollow part.

9. An antenna coil component according to claim 1, wherein the insulating material forming the bobbin and the insulating material forming the base comprise heat-labile resins.

10. An antenna coil component according to claim 1, wherein the antenna coil component is used for an in-vehicle antenna unit.

* * * * *